US011139133B2

(12) United States Patent
Ozaki et al.

(10) Patent No.: US 11,139,133 B2
(45) Date of Patent: Oct. 5, 2021

(54) CONTACT DEVICE, ELECTROMAGNETIC RELAY AND ELECTRICAL DEVICE

(71) Applicant: PANASONIC INTELLECTUAL PROPERTY MANAGEMENT CO., LTD., Osaka (JP)

(72) Inventors: Ryosuke Ozaki, Osaka (JP); Shinya Kimoto, Osaka (JP); Kazuhiro Kodama, Hokkaido (JP); Seiya Sakaguchi, Aichi (JP); Yasutaka Hieda, Osaka (JP); Masahiro Ito, Hyogo (JP); Hideki Watanabe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 225 days.

(21) Appl. No.: 16/477,136

(22) PCT Filed: Jan. 11, 2018

(86) PCT No.: PCT/JP2018/000450
§ 371 (c)(1),
(2) Date: Jul. 10, 2019

(87) PCT Pub. No.: WO2018/131639
PCT Pub. Date: Jul. 19, 2018

(65) Prior Publication Data

US 2019/0355536 A1 Nov. 21, 2019

(30) Foreign Application Priority Data

Jan. 11, 2017 (JP) ..... JP2017-002493

(51) Int. Cl.
*H01H 63/02* (2006.01)
*H01H 50/14* (2006.01)
*H01H 50/44* (2006.01)

(52) U.S. Cl.
CPC ..... *H01H 50/14* (2013.01); *H01H 50/44* (2013.01)

(58) Field of Classification Search
CPC ..... H01H 50/14; H01H 50/44; H01H 50/645; H01H 50/02; H01H 9/443
(Continued)

(56) References Cited

U.S. PATENT DOCUMENTS 4,467,301 A 8/1984 Goodrich
2012/0092095 A1 4/2012 Lim
(Continued)

FOREIGN PATENT DOCUMENTS

CN 102456511 A 5/2012
CN 111418039 A 7/2020
(Continued)

OTHER PUBLICATIONS

Official Communication issued in International Bureau of WIPO Patent Application No. PCT/JP2018/000450, dated Apr. 17, 2018.

*Primary Examiner* — Shawki S Ismail
*Assistant Examiner* — Lisa N Homza
(74) *Attorney, Agent, or Firm* — Greenblum & Bernstein, P.L.C.

(57) ABSTRACT

A first conductive member is fixed to a first fixed terminal having a longitudinal direction, and a second conductive member is fixed to a second fixed terminal having a longitudinal direction. The first fixed terminal and the second fixed terminal are fixed to a partition member. A first extension portion of the first conductive member includes a first opposed portion opposed to at least one of the first fixed
(Continued)

terminal at a first fixed contact side of the partition member. The first opposed portion extends in the longitudinal direction of the first fixed terminal.

28 Claims, 43 Drawing Sheets

(58) Field of Classification Search
USPC ..... 335/133
See application file for complete search history.

(56) References Cited

U.S. PATENT DOCUMENTS

2012/0092098 A1 4/2012 Choi
2013/0021121 A1 1/2013 Uchida
2013/0021122 A1* 1/2013 Uchida ..... H01H 1/54 335/131
2014/0002092 A1* 1/2014 Kodama ..... G01R 31/3278 324/418
2015/0002250 A1* 1/2015 Kashimura ..... H01H 50/10 335/204
2016/0181038 A1* 6/2016 Shimizu ..... H01H 50/54 335/165
2016/0254113 A1* 9/2016 Nishimura ..... H01H 50/02 335/202
2017/0148596 A1* 5/2017 Ozaki ..... H01H 51/065
2018/0166244 A1* 6/2018 Kobayashi ..... H01H 50/645
2019/0148095 A1* 5/2019 Minowa ..... H01H 50/54 335/185
2020/0286702 A1* 9/2020 Kodama ..... H01H 1/54
2020/0381203 A1* 12/2020 Sakaguchi ..... H01H 50/048
2021/0151271 A1* 5/2021 Kodama ..... H01H 50/42

FOREIGN PATENT DOCUMENTS

EP 3 719 825 A1 10/2020
JP 59-211928 A 11/1984
JP 2009-199893 A 9/2009
JP 2012-89485 A 5/2012
JP 2013-25906 A 2/2013
JP 201341815 A 2/2013
WO 2013/051264 A1 4/2013
WO 2015/049880 A1 4/2015
WO 2017/183305 A1 10/2017

* cited by examiner

CONTACT DEVICE, ELECTROMAGNETIC RELAY AND ELECTRICAL DEVICE

TECHNICAL FIELD

The present disclosure relates to a contact device, an electromagnetic relay, and an electrical device, and more particularly relates to a contact device, an electromagnetic relay, and an electric device capable of switching contact and separation of a movable contact with respect to a fixed contact.

BACKGROUND ART

There has been known a contact device that includes a first fixed terminal having a first fixed contact and a second fixed terminal having a second fixed contact, and a movable contactor having a pair of movable contacts brought into contact with and separated from the first fixed contact and the second fixed contact (for example, see Patent Literature 1).

Patent Literature 1 discloses that a movable contactor is moved toward the first fixed terminal and the second fixed terminal to bring the pair of the movable contacts into contact with the first fixed contact and the second fixed contact or separate the pair of the movable contacts from the first fixed contact and the second fixed contact, so as to switch an electrical connection between the first fixed terminal and the second fixed terminal.

CITATION LIST

Patent Literature

Patent Literature 1: Japanese Patent Application Publication No. 2009-199893

SUMMARY OF INVENTION

Technical Problem

As disclosed in Patent Literature 1, when the pair of the movable contacts is brought into contact with the first fixed contact and the second fixed contact to electrically connect the first fixed terminal with the second fixed terminal, a current flows through the first fixed terminal and the second fixed terminal via the movable contactor. The current flowing through the first fixed terminal and the second fixed terminal via the movable contactor causes an electromagnetic repulsion force between the first fixed contact and the movable contactor and between the second fixed contact and the movable contactor.

In order to improve the reliability of connection between the contacts, it is preferable to reduce the electromagnetic repulsion force caused between the first fixed contact and the movable contactor and between the second fixed contact and the movable contactor.

An object of the present disclosure is to provide a contact device capable of reducing an electromagnetic repulsion force between contacts more reliably; and an electromagnetic relay equipped with the contact device.

Solution to Problem

The contact device according to the present disclosure includes a first fixed terminal having a first fixed contact on one end side in a longitudinal direction, and a second fixed terminal having a second fixed contact on one end side in the longitudinal direction. The contact device also includes a movable contactor moved relative to at least one of the first fixed contact and the second fixed contact, so as to switch an electrical connection between the first fixed terminal and the second fixed terminal. The contact device further includes a first conductive member having a first fixed portion fixed to the other end side of the first fixed terminal in the longitudinal direction, and a second conductive member having a second fixed portion fixed to the other end side of the second fixed terminal in the longitudinal direction. The contact device also includes a partition member having the first and second fixed terminals fixed thereto for partitioning one end and the other end of the first fixed terminal in the longitudinal direction and for partitioning one end and the other end of the second terminal in the longitudinal direction. An extension portion is connected to at least one of the first fixed portion and the second fixed portion. The extension portion has an opposed portion opposed to at least one of the fixed terminal, to which the fixed portion having the extension portion connected thereto is fixed, and the movable contactor, at one end side of the partition member in the longitudinal direction of the fixed terminal to which the fixed portion having the extension portion connected thereto is fixed. The opposed portion extends in the longitudinal direction of the fixed terminal to which the fixed portion having the extension portion connected thereto is fixed.

The electromagnetic relay according to the present disclosure includes the contact device and an electromagnetic device that moves the movable contactor.

The electrical device according to the present disclosure includes an inner unit consisting of the contact device or the electromagnetic relay, and a housing holding the inner unit.

Advantageous Effects

The present disclosure can provide a contact device capable of reducing an electromagnetic repulsion force between contacts more reliably, and an electromagnetic relay equipped with the contact device.

BRIEF DESCRIPTION OF DRAWINGS

FIG. 13A is a diagram for explaining a positional relationship between a conductive member and a movable contactor included in the contact device according to the second embodiment and a repulsion force caused between the conductive member and the movable contactor, while

FIG. 16A is a diagram for explaining a length of a first electrical path portion connected to the first conductive member according to the second embodiment, while

FIG. 18A is a perspective view of an electrical device according to the second embodiment, while

FIG. 20A is a perspective view of an electromagnetic relay according to a first modified example of the second embodiment, while

FIG. 23A is a diagram for explaining a positional relationship between a conductive member and a movable contactor included in the contact device according to the first modified example of the second embodiment and a repulsion force caused between the conductive member and the movable contactor, while

FIG. 25A is a diagram for explaining a length of a first electrical path portion connected to the first conductive member according to the first modified example of the second embodiment, while

FIG. 31A is a longitudinal sectional view taken along the plane extending in an alignment direction of first and second fixed terminals and a moving direction of a movable contactor, for explaining a first yoke according to a sixth modified example of the second embodiment, while

FIG. 32A is a longitudinal sectional view taken along the plane extending in an alignment direction of first and second fixed terminals and a moving direction of a movable contactor, for explaining a first yoke according to a seventh modified example of the second embodiment, while

FIG. 40A is a plan view of an electromagnetic relay according to a thirteenth modified example of the second embodiment, while

FIG. 41A is a perspective view of an electromagnetic relay according to a fourteenth modified example of the second embodiment, while

DESCRIPTION OF EMBODIMENTS

Hereinafter, an embodiment of the present disclosure will be described with reference to the drawings.

First Embodiment

A contact device 40 and an electromagnetic relay 1 according to the present embodiment will be described below with reference to FIGS. 1 to 8.

Figure 4:
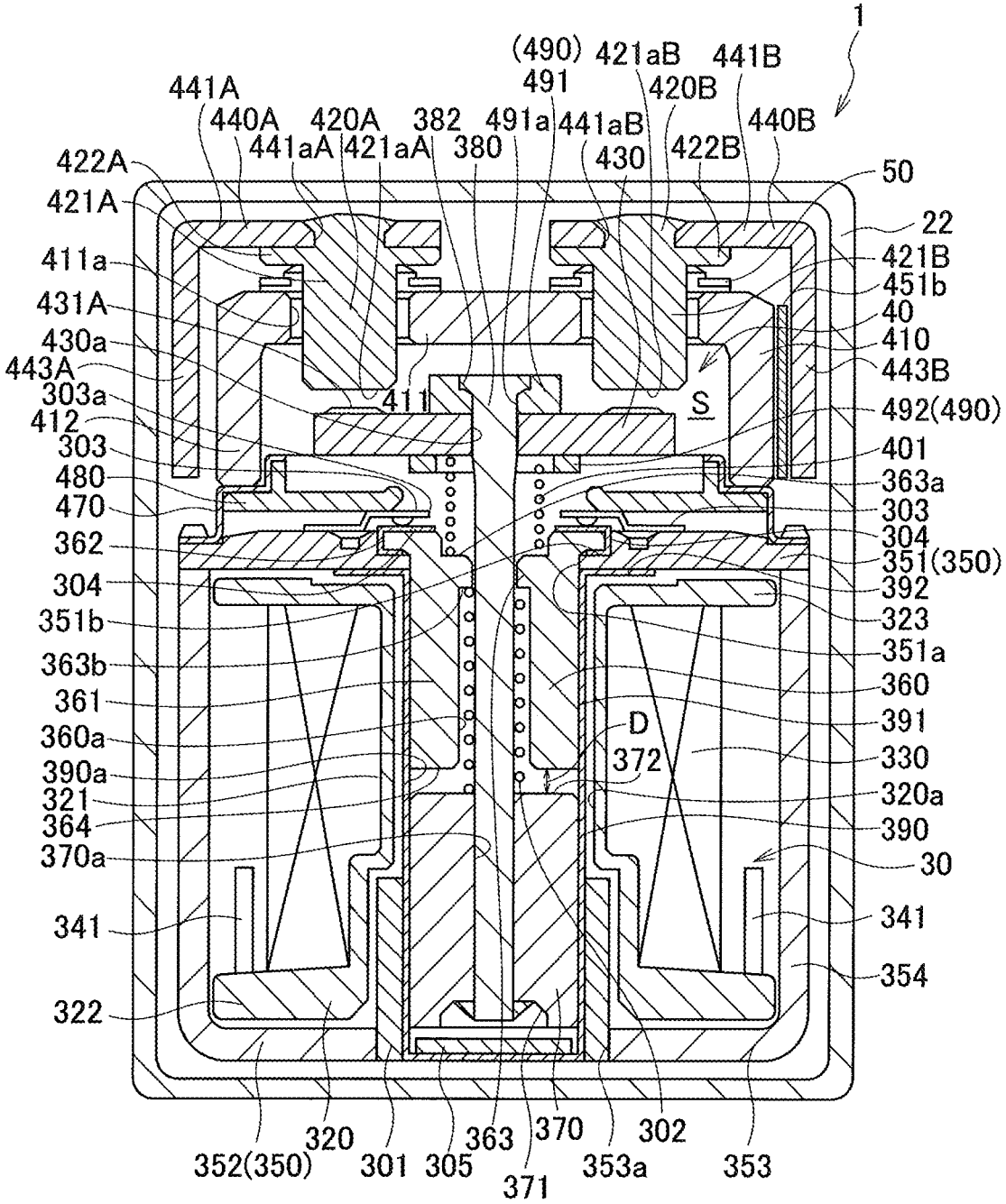
FIG. 4 is a cross-sectional view of the electromagnetic relay according to the first embodiment.

Note that, in the present embodiment, the definitions of the top, bottom, right, and left applied to FIG. 4 are used for the explanations of the drawings throughout the Specification. The direction perpendicular to the paper of FIG. 4 is referred to as a front-rear direction.

(1) CONFIGURATION

(1.1) Electromagnetic Relay

First, a configuration of the electromagnetic relay 1 according to the present embodiment will be described below.

Figure 1:
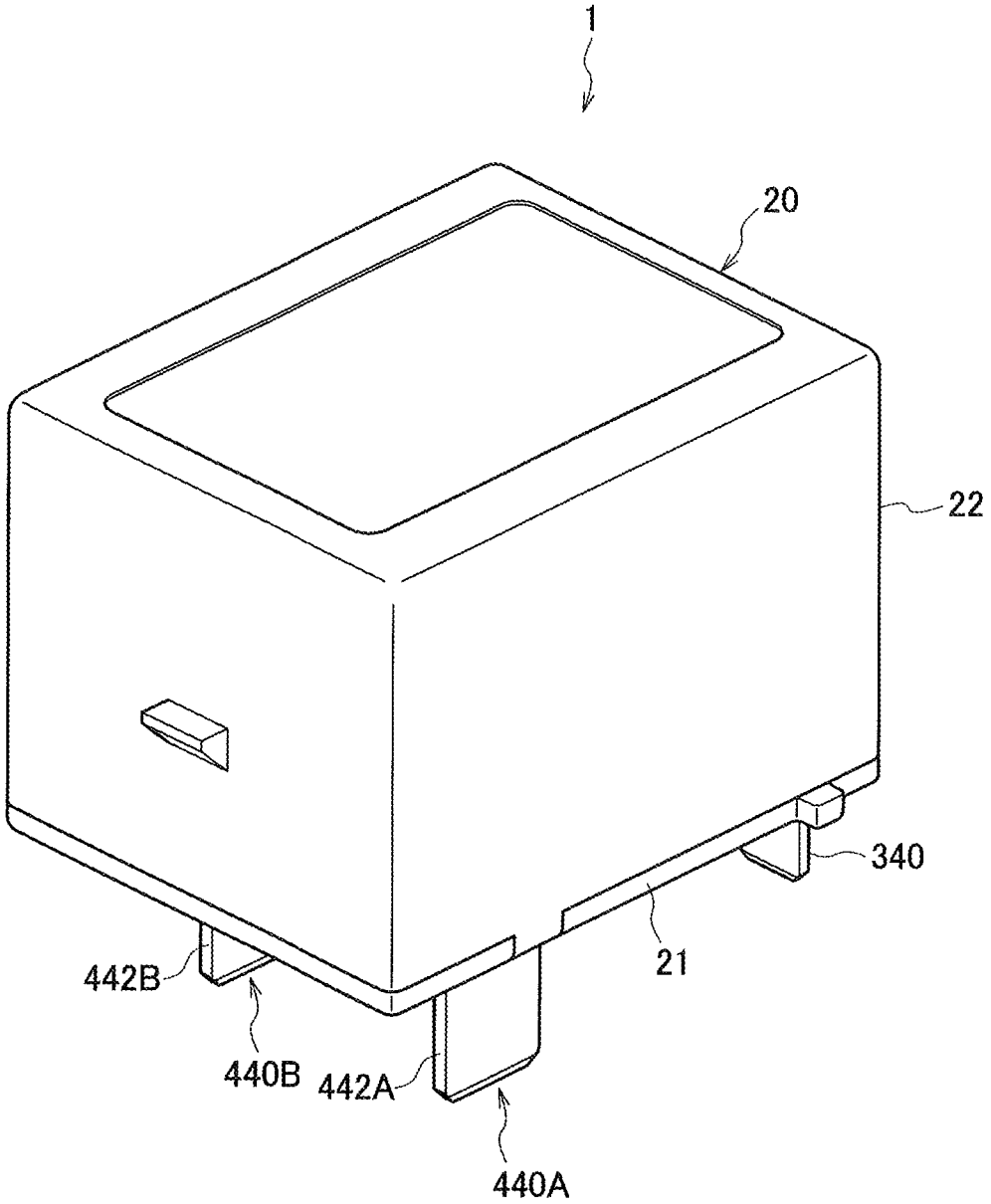
FIG. 1 is a perspective view of an electromagnetic relay according to a first embodiment.
Figure 2:
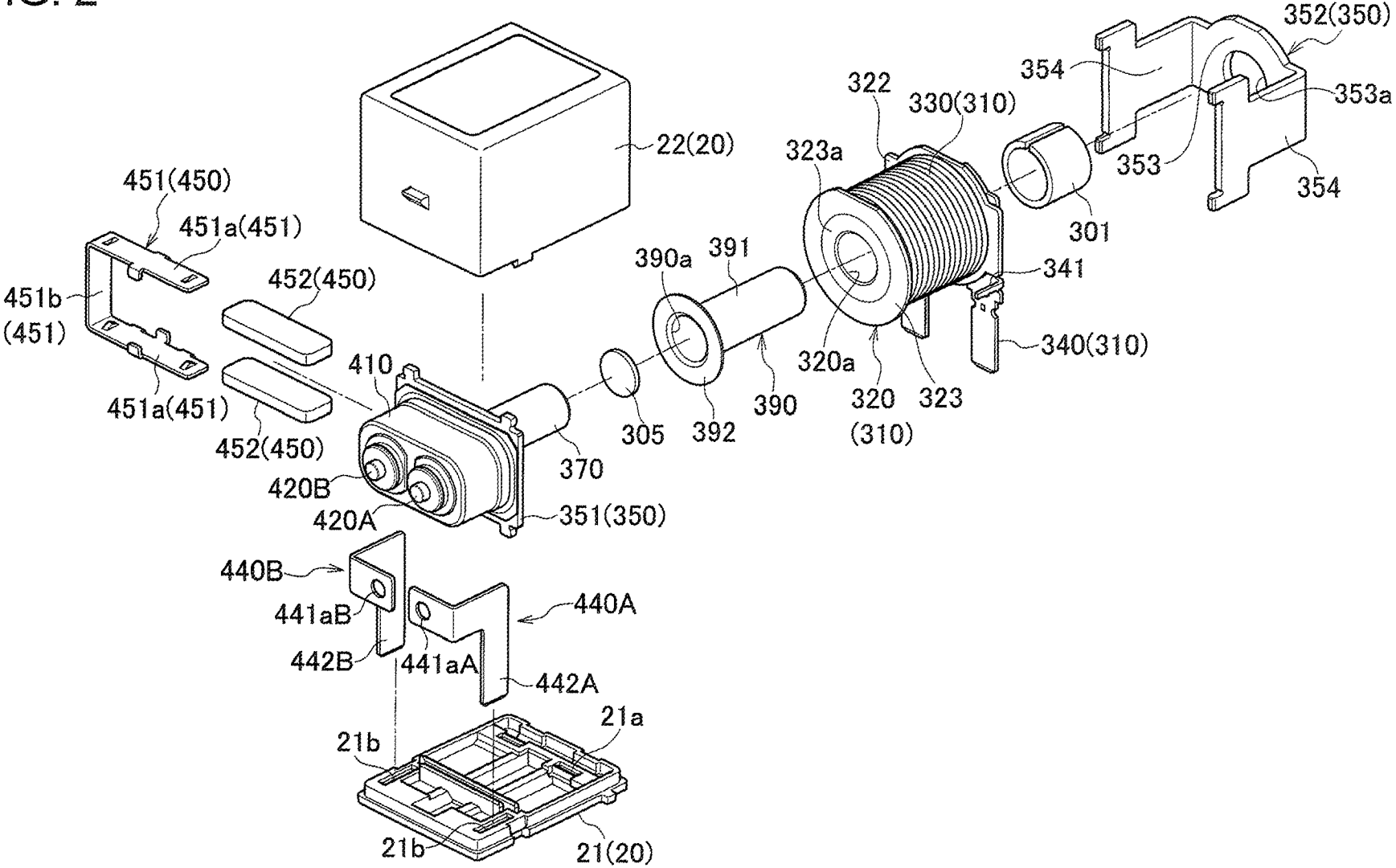
FIG. 2 is an exploded perspective view of the electromagnetic relay according to the first embodiment.
Figure 3:
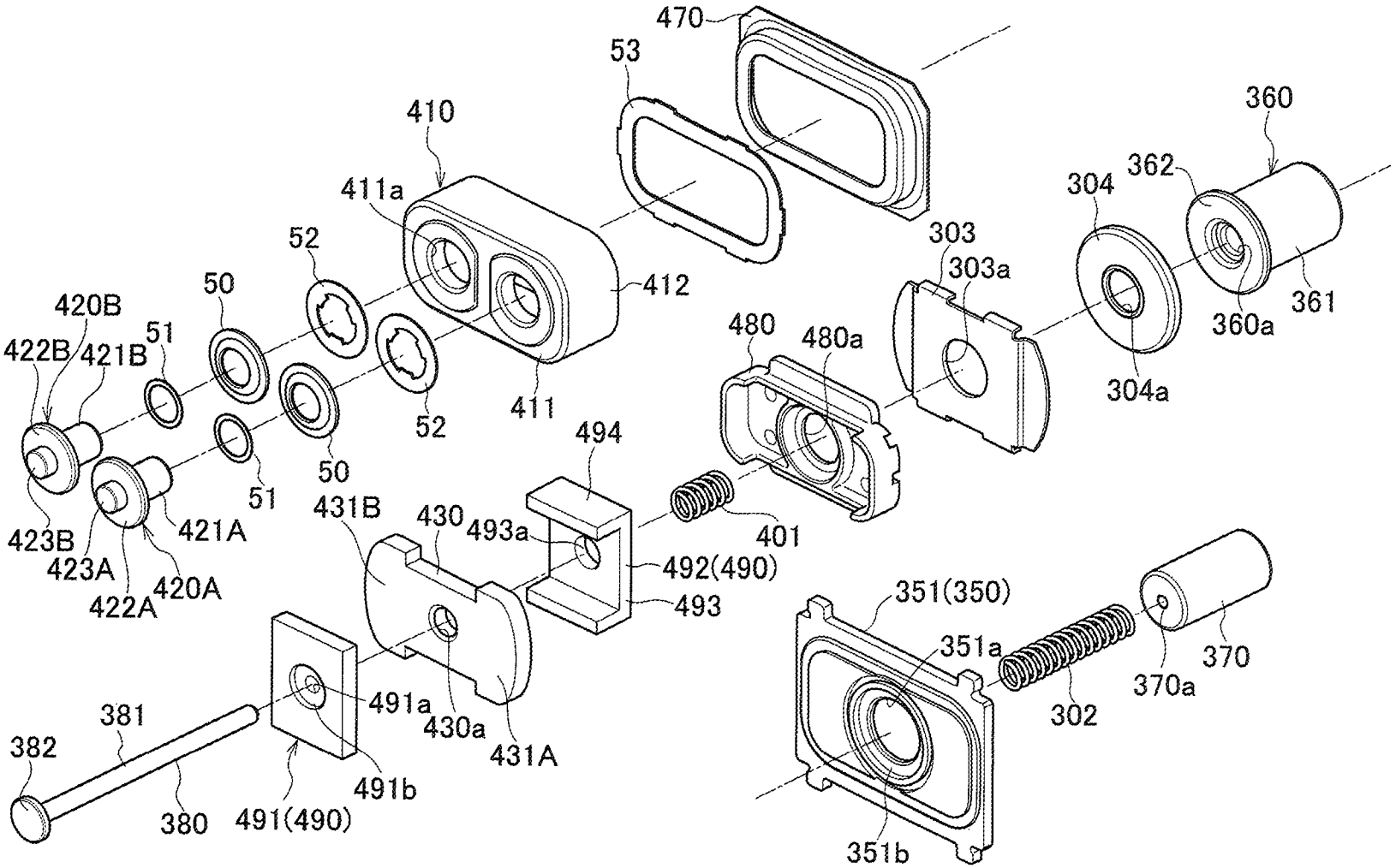
FIG. 3 is a partly-exploded perspective view of a contact device according to the first embodiment.

An electromagnetic relay 1 according to the present embodiment is of a normally open type in which contacts are OFF in an initial state. As shown in FIGS. 1 to 3, the electromagnetic relay 1 includes an electromagnetic device (a drive unit) 30 located on the lower side and a contact device 40 located on the upper side. In particular, the electromagnetic device 30 and the contact device 40 are housed in a case 20 formed of a resin material into a hollow box shape, so as to form the electromagnetic relay 1. Note that, an electromagnetic relay of a normally closed type in which contacts are ON in an initial state may be used instead.

As shown in FIGS. 1 and 2, the case 20 includes a substantially rectangular case base 21, and a case cover 22 arranged to cover the case base 21. The case cover 22 is formed into a hollow box shape with the bottom toward the case base 21 open. The installed members such as the electromagnetic device 30 and the contact device 40 are housed in the inside space of the case 20 in the state in which the case base 21 is covered with the case cover 22.

The ease base 21 is provided on the lower side with a pair of slits 21*a*, 21*a* to which a pair of coil terminals 340, 340 are inserted. The ease base 21 is provided on the upper side with a pair of slits 21*b*, 21*b* to which a first terminal portion 442A of a first busbar (a first conductive member) 440A and a second terminal portion 442B of a second busbar (a second conductive member) 440B are inserted.

One of the slits 21*a* has substantially the same cross section as one of the coil terminals 340 inserted into the one slit 21*a*. The other slit 21*a* has substantially the same cross section as the other coil terminal 340 inserted into the other slit 21*a*. According to the present embodiment, the coil terminals 340 are used that have substantially the same cross section as the slits 21*a* into which the coil terminals 340 are inserted. Thus, the respective slits 21*a* have substantially the same cross section.

One of the slits 21*b* has substantially the same cross section as the first terminal portion 442A inserted into the one slit 21*b*. The other slit 21*b* has substantially the same cross section as the second terminal portion 442B inserted into the other slit 21*b*. According to the present embodiment, the first terminal portion 442A and the second terminal portion 442B are used that have substantially the same, cross section as the slits 21*b* into which the coil terminals 340 are inserted. Thus, the respective slits 21*b* have substantially the same cross section.

(1.2) Electromagnetic Device

Next, a configuration of the electromagnetic device 30 will be described below.

The electromagnetic device 30 includes a coil unit 310. The coil unit 310 includes an exciting coil 330 which generates a magnetic flux when applied with a current, a cylindrical hollow coil bobbin 320 on which the exciting coil 330 is wound, and the pair of the coil terminals 340 fixed to the coil bobbin 320 and connected with both ends of the exciting coil 330.

The coil bobbin 320 is formed of resin which is an insulating material, and is provided with an insertion hole 320*a* penetrating in the vertical direction in the middle of the coil bobbin 320. The coil bobbin 320 includes a wound body 321 having a substantially cylindrical shape on which the exciting coil 330 is wound around the outer surface, a lower flange 322 having a substantially circular shape continuously formed on the bottom of the wound body 321 and protruding outward in the radial direction of the wound body 321, and an upper flange 323 having a substantially circular shape continuously formed on the top of the wound body 321 and protruding outward in the radial direction of the wound body 321.

The coil terminals 340 may be formed of an electrically conductive material, such as copper, into a plate-like shape. The coil terminals 340 are provided with junction terminals 341, 341. The lead at one end of the exciting coil 330 wound on the wound body 321 of the coil bobbin 320 is wound and soldered onto the junction terminal 341 of one of the coil terminals 340. The lead at the other end of the exciting coil 330 wound on the wound body 321 of the coil bobbin 320 is wound and soldered onto the junction terminal 341 of the other coil terminal 340.

The coil unit 310 of the present embodiment is formed such that the both ends of the exciting coil 330 wound on the wound body 321 of the coil bobbin 320 are electrically connected to the pair of the coil terminals 340 fixed to the coil bobbin 320. The electromagnetic device 30 is driven when the current is applied to the exciting coil 330 via the pair of the coil terminals 340. When the electromagnetic device 30 is driven by the application of the current to the exciting coil 330, the contacts of the contact device 40 described below are open/closed. The contacts of the contact device 40 include a first fixed contact 421*a*A formed on a first fixed terminal 420A, a second fixed contact 421*a*B formed on a second fixed terminal 420B, and a first movable contact 431A and a second movable contact 431B formed on a movable contactor 430. Thus, according to the present embodiment, the operation of the electromagnetic device 30 switches the electrical connection between the first fixed contact 421*a*A and the second fixed contact 421*a*B.

The electromagnetic device 30 also includes a yoke 350 arranged around the exciting coil 330. The yoke 350 may be formed of a magnetic material, for example. The yoke 350 of the present embodiment is arranged to surround the coil bobbin 320, and includes a rectangular yoke upper plate 351 arranged on the upper surface of the coil bobbin 320, and a rectangular yoke body 352 arranged along the lower surface and the side surface of the coil bobbin 320.

The yoke body 352 is arranged between the exciting coil 330 and the case 20. The yoke body 352 of the present embodiment includes a bottom wall 353 and a pair of side walls 354, 354 extending upward from right and left edges (circumferential edges) of the bottom wall 353, and is open in the front-rear direction. The bottom wall 353 and the pair of the side walls 354 may be integrally formed such that a single plate is bent. The bottom wall 353 of the yoke body 352 is provided with a circular insertion hole 353*a* into which a bushing 301 is attached. The bushing 301 may be formed of a magnetic material.

The yoke upper plate 351 is placed on the top side (on the upper side) of the pair of the side walls 354 of the yoke body 352 to cover the upper surface of the coil bobbin 320 and the exciting coil 330 wound on the coil bobbin 320.

The electromagnetic device 30 includes a fixed iron core (a fixed element: a fixed member) 360 which is placed in the cylindrical inner portion (in the insertion hole 320*a*) of the coil bobbin 320 and magnetized by the exciting coil 330 applied with the current (allows the magnetic flux to flow therethrough). The electromagnetic device 30 also includes a movable iron core (a movable element: a movable member) 370 which is opposed to the fixed iron core 360 in the vertical direction (in the axial direction) and placed in the cylindrical inner portion (in the insertion hole 320*a*) of the coil bobbin 320.

The fixed iron core 360 of the present embodiment includes a cylinder portion 361 inserted into the cylindrical inner portion (in the insertion hole 320*a*) of the coil bobbin 320, and a flange 362 protruding outward in the radial direction from the upper end of the cylinder portion 361. The fixed iron core 360 is provided with an insertion hole 360*a* into which a shaft (a drive shaft) 380 and a return spring 302 are inserted.

In the present embodiment, the fixed iron core 360 is provided with a projection 363 projecting along the inner circumference of the insertion hole 360*a* (on the inner side in the radial direction) below the flange 362. Thus, the diameter of the opening of the insertion hole 360*a* is larger at the portion on the upper side (on the upper surface 363*a* side) of the projection 363 than at the portion corresponding to the projection 363. The diameter of the opening of the insertion hole 360*a* is larger at the portion on the lower side (on the lower surface 363*b* side) of the projection 363 than at the portion corresponding to the projection 363. In addition, the diameter of the opening of the insertion hole 360*a* is slightly larger on the upper side (on the upper surface 363*a* side) of the projection 363 than on the lower side (on the lower surface 363*b* side) of the projection 363.

The movable iron core 370 is provided with an insertion hole 370*a* in the middle to which the shaft (the drive shaft) 380 is inserted. The insertion hole 370*a* has a substantially constant diameter (a diameter substantially the same as the diameter of a shaft body 381), and communicates with a recess 371 provided in the middle of the movable iron core 370 on the bottom side.

The shall 380 may be formed of a nonmagnetic material, for example. The shaft 380 of the present embodiment includes the shaft body 381 having a round rod shape elongated in the moving direction of the movable iron core 370 (in the vertical direction: the drive-shaft direction), and a flange 382 having a substantially disk-like shape and extending outward in the radial direction from the upper end of the shaft body 381.

The bottom end of the shaft body 381 is inserted from above into the insertion hole 370*a* of the movable iron core 370 so that the shaft 380 is connected to the movable iron core 370.

The electromagnetic device 30 of the present embodiment includes a plunger cap (cylindrical body) 390 having a bottomed cylindrical shape open on the upper side. The plunger cap 390 may also be formed of a nonmagnetic material, for example. The plunger cap 390 is placed between the fixed iron core 360 and the coil bobbin 320 and between the movable iron core 370 and the coil bobbin 320.

The plunger cap 390 includes a body 391 having a bottomed cylindrical shape open on the upper side, and a flange 392 protruding outward in the radial direction from the upper end of the body 391. The body 391 of the plunger cap 390 is inserted into the insertion hole 320*a* provided in the middle of the coil bobbin 320. A circular setting surface 323*a* is provided on the upper side of the coil bobbin 320 (on the upper flange 323) on which the flange 392 of the plunger cap 390 is placed.

The cylinder portion 361 of the fixed iron core 360 and the movable iron core 370 are housed in a housing space 390*a* of the plunger cap 390 placed in the cylindrical inner portion (in the insertion hole 320*a*) of the coil bobbin 320. The fixed iron core 360 of the present embodiment is located on the opening side of the plunger cap 390, and the movable iron core 370 is located below the fixed iron core 360 inside the plunger cap 390.

The cylinder portion 361 of the fixed iron core 360 and the movable iron core 370 are each formed into a cylindrical shape having an outer diameter which is substantially the same as the inner diameter of the plunger cap 390. The movable iron core 370 slides along the inside of the housing space 390*a* of the plunger cap 390 in the vertical direction (in the reciprocating direction: the drive-shaft direction).

In the present embodiment, the flange 392 located on the opening side of the plunger cap 390 is fixed to the periphery of an insertion hole 351*a* on the lower surface of the yoke upper plate 351. The lower end of the plunger cap 390 is inserted into the bushing 301 placed in the insertion hole 353*a* of the bottom wall 353.

The movable iron core 370 placed on the bottom of the plunger cap 390 is magnetically connected to the circumferential surface of the bushing 301. In other words, the bushing 301 composes a magnetic circuit together with the yoke 350 (the yoke upper plate 351 and the yoke body 352), the fixed iron core 360, and the movable iron core 370.

The yoke upper plate 351 is provided with the insertion hole 351*a* in the middle into which the fixed iron core 360 is inserted. The cylinder portion 361 of the fixed iron core 360 is inserted into the insertion hole 351*a* from the upper side of the yoke upper plate 351. The yoke upper plate 351 is provided, substantially in the middle on the upper surface, with a recess 351*b* having substantially the same diameter as the flange 362 of the fixed iron core 360 to prevent the flange 362 fitted to the recess 351*b* from falling off.

A holding plate 303 made of metal is placed on the yoke upper plate 351 with right and left edges fixed to the upper surface of the yoke upper plate 351. The holding plate 303 is provided with a protrusion in the middle protruding above the upper surface of the yoke upper plate 351 so as to define a space for housing the flange 362 of the fixed iron core 360.

In the present embodiment, an iron core rubber 304 formed of a material having elasticity (such as synthetic rubber) is placed between the fixed iron core 360 and the holding plate 303, so as to prevent oscillation of the fixed iron core 360 from being transferred directly to the holding plate 303. The iron core rubber 304 is formed into a disk-like shape provided with an insertion hole 304*a* in the middle into which the shaft 380 is inserted. The iron core rubber 304 of the present embodiment is fitted to the fixed iron core 360 to surround the flange 362.

The holding plate 303 is provided with an insertion hole 303*a* into which the shaft 380 is inserted, so that the upper end of the shaft 380 (on the flange 382 side) extends to the contact device 40 through the insertion hole 360*a* of the fixed iron core 360 and the insertion hole 303*a* of the holding plate 303.

When the current is applied to the exciting coil 330, the attractive force acts on the movable iron core 370 so that the movable iron core 370 moves upward to the fixed iron core 360. The shaft 380 connected and fixed to the movable iron core 370 moves upward together.

The range of movement of the movable iron core 370 according to the present embodiment is between the initial position at which the movable iron core 370 is separated from and located below the fixed iron core 360 with the gap D1 provided therebetween (the position the most distant from the fixed iron core 360) and the contact position at which the movable iron core 370 is brought into contact with the fixed iron core 360 (the position the closest to the fixed iron core 360).

As described above, the return spring 302 is placed between the fixed iron core 360 and the movable iron core 370 to bias the movable iron core 370 by the elastic force in the direction in which the movable iron core 370 returns to the initial position (in the direction away from the fixed iron core 360). In the present embodiment, the return spring 302 is a coil spring wound on the shaft 380 and placed inside the insertion hole 360*a* of the fixed iron core 360. The upper end of the return spring 302 is in contact with the lower surface 363*b* of the projection 363 of the fixed iron core 360, and the lower end of the return spring 302 is in contact with the upper surface 372 of the movable iron core 370. The lower surface 363*b* of the projection 363 and the upper surface 372 of the movable iron core 270 thus serve as spring receivers.

This configuration leads the opposed surface (the lower surface) 364 of the fixed iron core 360 opposed to the movable iron core 370 and the opposed surface (the upper surface) 372 of the movable iron core 370 opposed to the fixed iron core 360, which serve a pair of magnetic poles, to heteropolarity when the current is applied to the exciting coil 330, so that the movable iron core 370 moves toward the fixed iron core 360 to reach the contact position by the attractive force. Thus, in the present embodiment, the pair of the opposed surface (the lower surface) 364 of the fixed iron core 360 opposed to the movable iron core 370 and the opposed surface (the upper surface) 172 of the movable iron core 370 opposed to the fixed iron core 360 function as magnetic pole faces when the current is applied to the exciting coil 330.

When the current applied to the exciting coil 330 is stopped, the movable iron core 370 returns to the initial position due to the biasing force of the return spring 302.

The movable iron core 370 according to the present embodiment thus reciprocates to separate from the fixed iron core 360 by the gap D1 when the current applied to the exciting coil 330 is stopped and move toward the fixed iron core 360 by the attractive force when the current is applied to the exciting coil 330.

A damper rubber 305 formed of a material having elasticity and having substantially the same diameter as the outer diameter of the movable iron core 370, is placed on the bottom in the housing space 390*a* of the plunger cap 390.

(1.3) Contact Device

Next, a configuration of the contact device 40 will be described below.

As described above, the contact device 40 is located above the electromagnetic device 30, and opens and closes the contacts depending on the operation of switching the on-off states of the current applied to the exciting coil 330.

The contact device 40 includes a box-shaped base (housing) 410 formed of a heat-resistant material, such as a ceramic material, and open on the lower side. The base 410 includes a top wall 411 and a circumferential wall 412 having a substantially square columnar shape extending downward from the peripheral edge of the top wall 411.

The top wall 411 of the base 410 is provided with two insertion holes 411*a*, 411*a* aligned in the right-left direction. The first fixed terminal 420A is inserted into one of the insertion holes 411*a* (on the left side in FIG. 4), and the second fixed terminal 420B is inserted into the other insertion hole 411*a* (on the right side in FIG. 4). The present embodiment is illustrated with the ease in which the paired fixed terminals electrically connected to each other are defined separately as the first fixed terminal 420A and the second fixed terminal 420B so as to be distinguished from each other for illustration purposes. However, the one fixed terminal (on the left side in FIG. 4) is not necessarily defined as the first fixed terminal 420A, or the other fixed terminal (on the right side in FIG. 4) is not necessarily defined as the second fixed terminal 420B. The one fixed terminal (on the left side in FIG. 4) may be defined as the second fixed terminal 420B, and the other fixed terminal (on the right side in FIG. 4) may be defined as the first fixed terminal 420A.

The first fixed terminal 420A is formed of an electrically conductive material such as a copper material, and elongated in the vertical direction as shown in FIG. 4. The first fixed terminal 420A of the present embodiment includes a first fixed terminal body 421A having a substantially columnar shape (elongated in the vertical direction) inserted from above into the insertion hole 411*a*. The first fixed terminal 420A further includes a first flange 422A having a substantially disk-like shape protruding outward in the radial direction from the upper end of the first fixed terminal body 421A and fixed to the upper surface (the upper surface on the periphery of the insertion hole 411*a*) of the top wall 411. The first fixed terminal body 421A is provided with the first fixed contact 421*a*A on the bottom surface (at one end in the longitudinal direction) of the first fixed terminal body 421A.

The second fixed terminal 420B is also formed of an electrically conductive material such as a copper material, and elongated in the vertical direction as shown in FIG. 4. The second fixed terminal 420B includes a second fixed terminal body 421B having a substantially columnar shape (elongated in the vertical direction) inserted from above into the insertion hole 411*a*. The second fixed terminal 420B further includes a second flange 422B having a substantially disk-like shape protruding outward in the radial direction from the upper end of the second fixed terminal body 421B and fixed to the upper surface (the upper surface on the periphery of the insertion hole 411*a*) of the top wall 411. The second fixed terminal body 421B is provided with the second fixed contact 421*a*B on the bottom surface (at one end in the longitudinal direction) of the second fixed terminal body 421B.

In the present embodiment, the first fixed terminal 420A is provided with the first fixed contact 421*a*A at the lower end (at one end in the longitudinal direction), and the second fixed terminal 420B is provided with the second fixed contact 421*a*B at the lower end (at one end in the longitudinal direction).

Although the present embodiment is illustrated with the case in which the bottom surface of the first fixed terminal body 421A serves as the first fixed contact 421*a*A, the first fixed terminal body 421A may be provided with the first fixed contact 421*a*A on the bottom surface formed separately from the first fixed terminal body 421A. Similarly, the second fixed terminal body 421B may be provided with the second fixed contact 421*a*B on the bottom surface formed separately from the second fixed terminal body 421B.

The first fixed terminal 420A and the second fixed terminal 420B of the present embodiment are each fixed to the top wall 411 via a washer 50.

In particular, when the first fixed terminal 420A is fixed to the top wall 411, the first fixed terminal body 421A of the first fixed terminal 420A is inserted from above into the insertion hole of the washer 50 and one of the insertion holes 411*a* of the top wall 411 in a state in which the washer 50 is placed on the upper surface on the periphery of the one insertion hole 411*a* The upper surface of the washer 50 and the lower surface of the first flange 422A are then tightly attached to each other by a silver brazing 51, and the lower surface of the washer 50 and the upper surface of the top wall 411 (the upper surface on the periphery of the one insertion hole 411*a*) are tightly attached to each other by a silver brazing 52, so as to fix the first fixed terminal 420A to the top wall 411. Accordingly, the first fixed terminal 420A is fixed to the top wall 411 with the insertion hole 411*a* closed tightly. The first fixed terminal 420A is fixed to the top wall 411 such that the longitudinal direction conforms to the vertical direction. The longitudinal direction of the first fixed terminal 420A does not necessarily conform to the vertical direction.

Similarly, when the second fixed terminal 420B is fixed to the top wall 411, the second fixed terminal body 421B of the second fixed terminal 420B is inserted from above into the insertion hole of the washer 50 and the other insertion hole 411*a* of the top wall 411 in a state in which the washer 50 is placed on the upper surface on the periphery of the other insertion hole 411*a*. The upper surface of the washer 50 and the lower surface of the second flange 422B are then tightly attached to each other by the silver brazing 51, and the lower surface of the washer 50 and the upper surface of the top wall 411 (the upper surface on the periphery of the other insertion hole 411*a*) are tightly attached to each other by the silver brazing 52, so as to fix the second fixed terminal 420B to the top wall 411. Accordingly, the second fixed terminal 420B is fixed to the top wall 411 with the insertion hole 411*a* closed tightly. The second fixed terminal 420B is fixed to the top wall 411 such that the longitudinal direction conforms to the vertical direction. The longitudinal direction of the second fixed terminal 420B does not necessarily conform to the vertical direction.

According to the present embodiment, the first fixed terminal 420A and the second fixed terminal 420B are fixed to the top wall 411. The top wall 411 partitions the upper side and the lower side of the first fixed terminal 420A fixed to the top wall 411. The top wall 411 also partitions the upper side and the lower side of the second fixed terminal 420B fixed to the top wall 411. The top wall 411 of the present embodiment serves as a partition member for partitioning one end and the other end of the first fixed terminal 420A in the longitudinal direction, and serves as a partition member for partitioning one end and the other end of the second fixed terminal 420B in the longitudinal direction.

Although the top wall 411 of the present embodiment, which is a part of the base 410 in which the top wall 411 and the circumferential wall 412 are integrated, serves as a partition member, several members integrated together may serve as a partition member. In addition, a partition member for partitioning the upper side and the lower side of the first fixed terminal 420A may be separated from a partition member for partitioning the upper side and the lower side of the second fixed terminal 420B.

The first busbar (the first conductive member) 440A to be connected to an external load or the like is fixed to the first fixed terminal 420A, and the second busbar (the second conductive member) 440B to be connected to an external load or the like is fixed to the second fixed terminal 420B.

The first busbar 440A is a bent member formed of an electrically conductive material. The first busbar 440A includes a first fixed portion 441A fixed to the first fixed terminal 420A. The first fixed portion 441A is provided with a first insertion hole 441*a*A. A first projection (caulked portion) 423A projecting upward in the middle of the first flange 422A is inserted into the first insertion hole 441*a*A and caulked, so that the first busbar 440A is fixed to the first fixed terminal 420A.

The first busbar (the first conductive member) 440A of the present embodiment includes the first fixed portion 441A fixed to the upper end (the other end) of the first fixed terminal 420A in the longitudinal direction.

Similarly, the second busbar 440B is a bent member formed of an electrically conductive material. The second busbar 440B includes a second fixed portion 441B fixed to the second fixed terminal 420B. The second fixed portion 441B is provided with a second insertion hole 441*a*B. A second projection (caulked portion) 423B projecting upward in the middle of the second flange 422B is inserted into the second insertion hole 441*a*B and caulked, so that the second busbar 440B is fixed to the second fixed terminal 420B.

The second busbar (the second conductive member) 44B of the present embodiment includes the second fixed portion 441B fixed to the upper end (the other end) of the second fixed terminal 420B in the longitudinal direction.

The substantially plate-like movable contactor 430 housed in the base 410 is elongated across the first fixed contact 421*a*A and the second fixed contact 421*a*B, and includes the first movable contact 431A and the second movable contact 431B located on the upper surface of the movable contactor 430 and respectively facing the first fixed contact 421*a*A and the second fixed contact 421*a*B. Although the present embodiment is illustrated with the case in which the first movable contact 431A and the second movable contact 431B are provided separately from the movable contactor 430, the upper surface 430*b* of the movable contactor 430 may serve as the first movable contact 431A and the second movable contact 431B.

The movable contactor 430 is attached to the shaft (the drive shaft) 380 such that the first movable contact 431A and the second movable contact 431B are opposed to and separated from the first fixed contact 421*a*A and the second fixed contact 421*a*B with a predetermined gap provided therebetween when the current is not applied to the exciting coil 330. The movable contactor 430 is provided with an insertion hole 430*a* in the middle into which the shaft 380 connected to the movable iron core 370 is inserted. The shaft 380 is inserted into the insertion hole 430*a* so that the movable contactor 430 is attached to the shaft 380.

The movable contactor 430 moves upward together with the movable iron core 370 and the shaft 380 when the current is applied to the exciting coil 330, so that the first movable contact 431A and the second movable contact 431B come into contact with the first fixed contact 421*a*A and the second fixed contact 421*a*B respectively.

In the present embodiment, the movable iron core 370 and the movable contactor 430 are arranged such that one of the movable contacts (the first movable contact 431A) and the first fixed contact 421*a*A are separated from each other and the other movable contact (the second movable contact 431B) and the second fixed contact 421*a*B are separated from each other when the movable iron core 370 is located in the initial position (open position). The movable iron core 370 and the movable contactor 430 are arranged such that the first movable contact 431A and the first fixed contact 421*a*A come into contact with each other and the second movable contact 431B and the second fixed contact 421*a*B come into contact with each other when the movable iron core 370 is located in the contact position (close position).

Accordingly, the first fixed terminal 420A and the second fixed terminal 420B are electrically isolated from each other when the exciting coil 330 is in the non-conducting state and the connection between the contacts of the contact device 40 (the contacts configured to the first fixed contact 421*a*A of the first fixed terminal 420A, the second fixed contact 421*a*B of the second fixed terminal 420B, and the first movable contact 431A and the second movable contact 431B of the movable contactor 430) is thus turned off. The first fixed terminal 420A and the second fixed terminal 420B are electrically connected to each other when the exciting coil 330 is in the conducting state and the connection between the contacts of the contact device 40 is thus turned on.

The movable contactor 430 of the present embodiment is driven by the electromagnetic device (the drive unit) 30. The movable contactor 430 is brought into contact with and separated from the first fixed terminal 420A and the second fixed terminal 420B so as to switch the electrical connection between the first fixed contact 421*a*A and the second fixed contact 421*a*B.

The movable contactor 430 is located below the first fixed contact 421*a*A and the second fixed contact 421*a*B. The upper surface 430*b* of the movable contactor 430 faces the first fixed contact 421*a*A formed at the lower end of the first fixed terminal 420A and the second fixed contact 421*a*B formed at the lower end of the second fixed terminal 420B. The first fixed terminal 420A and the second fixed terminal 420B of the present embodiment are aligned on the top wall (the partition member) 411 in a state in which the respective fixed contacts (the first fixed contact 421*a*A and the second fixed contact 421*a*B) are opposed to the movable contactor 430.

An insulating plate 480 formed of an insulating material is located between the movable contactor 430 and the holding plate 303, and covers the holding plate 303. The insulating plate 480 is provided with an insertion hole 480*a* in the middle into which the shaft 380 is inserted.

When the current flows in the state in which the first movable contact 431A of the movable contactor 430 is in contact with the first fixed contact 421*a*A and the second movable contact 431B of the movable contactor 430 is in contact with the second fixed contact 421*a*B, an electromagnetic repulsion force is caused between the first fixed contact 421*a*A and the movable contactor 430 and between the second fixed contact 421*a*B and the movable contactor 430 due to the flow of the current. The electromagnetic repulsion force caused between the first fixed contact 421*a*A and the movable contactor 430 and between the second fixed contact 421*a*B and the movable contactor 430 may suddenly increase Joule heat because the contact pressure decreases and the contact resistance increases, or may generate heat caused by an electric are due to the separation of the contacts. As a result, the first fixed contact 421*a*A and the first movable contact 431A may be welded together, or the second fixed contact 421*a*B and the second movable contact 431B may be welded together.

The present embodiment deals with this problem such that a yoke 490 is provided around the movable contactor 430. In particular, the yoke 490 includes an upper yoke (a first yoke) 491 located on the upper side of the movable contactor 430, and a lower yoke (a second yoke) 492 provided along the bottom and side surfaces of the movable contactor 430. The upper yoke 491 and the lower yoke 492 surround the upper and lower surfaces and the side surfaces of the movable contactor 430, so as to provide a magnetic circuit between the upper yoke 491 and the lower yoke 492.

When the current flows in the state in which the first movable contact 431A and the second movable contact 431B of the movable contactor 430 are in contact with the first fixed contact 421*a*A and the second fixed contact 421*a*B respectively, the upper yoke 491 and the lower yoke 492 generate a magnetic force attracting each other derived from the current. The magnetic force attracting the upper yoke 491 and the lower yoke 492 to each other pushes the movable contactor 430 toward the first fixed contact 421*a*A and the second fixed contact 421*a*B, so as to prevent the movable contactor 430 from separating from the first fixed contact 421*a*A and the second fixed contact 421*a*B. The prevention of the movement of the movable contactor 430 away from the first fixed contact 421*a*A and the second fixed contact 421*a*B allows the movable contactor 430 to come into contact with the first fixed contact 421*a*A and the second fixed contact 421*a*B without causing repulsion, so as to prevent an electrical arc. Accordingly, contact welding caused by an electrical arc can be prevented.

In the present embodiment, the upper yoke 491 is formed into a substantially rectangular plate-like shape, and the lower yoke 492 is formed into a substantially U-shape including a bottom wall 493 and side walls 494 extending upward from both sides of the bottom wall 493.

A pressure spring 401 of the present embodiment ensures a contact pressure between the first movable contact 431A and the first fixed contact 421*a*A and between the second movable contact 431B and the second fixed contact 421*a*B.

The pressure spring 401 is a coil spring of which the axial direction is parallel to the vertical direction.

In particular, the pressure spring 401 is arranged such that the upper end is inserted into an insertion hole 493*a* provided in the bottom wall 493 of the lower yoke (the second yoke) 492, and is in contact with the bottom surface 430*c* of the movable contactor 430. The lower end of the pressure spring 401 is inserted into the recess surrounded by the flange 362 provided above the projection 363 of the fixed iron core 360, and is in contact with the upper surface 363*a* of the projection 363. The bottom surface 430*c* of the movable contactor 430 and the upper surface 363*a* of the projection 363 each serve as a spring receiver for receiving the pressure spring 401. The movable contactor 430 is biased upward by the pressure spring 401.

The upper end of the pressure spring 401 is in contact with the bottom surface 430*c* of the movable contactor 430. The pressure spring 401 is placed to bias the movable contactor 430 upward in the drive-shaft direction without contact with the lower yoke 492 (the yoke 490) (without the yoke interposed therebetween). Accordingly, a reduction in size of the electromagnetic relay 1 (the contact device 40 and the electromagnetic device 30) in the height direction the vertical direction: the drive-shaft direction) can be achieved.

The upper yoke 491 and the lower yoke 492 are provided with an insertion hole 491*a* and an insertion hole 493*a*, respectively, into which the shaft 380 is inserted.

The movable contactor 430 in the electromagnetic relay 1 having the configuration as described above may be attached to one end of the shaft 380 as follows.

The movable iron core 370, the return spring 302, the yoke upper plate 351, the fixed iron core 360, the iron core rubber 304, the holding plate 303, the insulating plate 480, the pressure spring 401, the lower yoke 492, the movable contactor 430, and the upper yoke 491 are arranged sequentially from below. The return spring 302 is preferably inserted into the insertion hole 360*a* of the fixed iron core 360.

The body 381 of the shaft 380 is inserted from above into the respective insertion holes 491*a*, 430*a*, 493*a*, 480*a*, 303*a*, 304*a*, 360*a*, and 351*a*, the pressure spring 401, and the return spring 302, and further inserted into the insertion hole 370*a* of the movable iron core 370 and connected together. The movable contactor 430 is thus fixed to one end of the shaft 380.

In the present embodiment, the shaft 380 is connected to the movable iron core 370 by rivet connection such that the tip of the shaft 380 projecting from the recess 371 is squashed, as shown in FIG. 4. The shaft 380 may be connected to the movable iron core 370 by other methods. For example, the shaft 380 may be provided with a thread on the other end and threadedly engaged with the movable iron core to connect the shaft 380 to the movable iron core 370, or the shaft 380 may be press-fitted to the insertion hole 370*a* of the movable iron core 370 to connect the shaft 380 to the movable iron core 370.

The upper yoke 491 of the present embodiment is provided with a circular setting surface 491*b* on the upper side. The flange 382 of the shaft 380 is fitted to the setting surface 491*b*, so as to prevent the shaft 380 from coming off while preventing the shaft 380 from projecting upward. The shaft 380 may be fixed to the upper yoke 491 by laser welding.

In the present embodiment, gas is enclosed in the base 410 in order to prevent occurrence of an electric arc between the first movable contact 431A and the first fixed contact 421*a*A or between the second movable contact 431B and the second fixed contact 421*a*B when the first movable contact 431A is separated from the first fixed contact 421*a*A or the second movable contact 431B is separated from the second fixed contact 421*a*B. The gas used may be mixed gas mainly including hydrogen gas superior in heat conductivity in the temperature range in which an electric arc occurs. In the present embodiment, an upper flange 470 covering a gap between the base 410 and the yoke upper plate 351 is provided so as to enclose the gas therein.

More particularly, the base 410 includes the top wall 411 provided with the pair of the insertion holes 411*a* aligned in the right-left direction (in the width direction) and the circumferential wall 412 having a square column shape extending downward from the peripheral edge of the top wall 411, and is formed into a hollow box shape open on the lower side (on the movable contactor 430 side), as described above. The base 410 is fixed to the yoke upper plate 351 via the upper flange 470 in a state in which the movable contactor 430 is housed inside the circumferential wall 412 from the opening on the lower side.

The peripheral edge of the opening on the lower side of the base 410 is airtightly connected to the upper surface of the upper flange 470 by the silver brazing 52. In addition, the lower surface of the upper flange 470 is airtightly connected to the upper surface of the yoke upper plate 351 by arc welding or the like. Further, the lower surface of the yoke upper plate 351 is airtightly connected to the flange 392 of the plunger cap 390 by arc welding or the like. Accordingly, the seal space S for enclosing the gas can be ensured in the base 410.

A capsule yoke block 450 is also used in addition to the gas to prevent the occurrence of an electric arc. The capsule yoke block 450 includes a capsule yoke 451 having a substantially U-shape and made of a magnetic material such as iron, and a pair of permanent magnets 452, 452. The capsule yoke 451 is formed such that a pair of side pieces 451*a*, 451*a* opposed to each other is integrated with a connection piece 451*b* connecting end portions of the side pieces 451*a*.

The permanent magnets 452 are opposed and fixed to the side pieces 451*a* of the capsule yoke 451, so as to provide a magnetic field in the base 410 in the direction substantially perpendicular to the direction (the vertical direction) in which the movable contacts (the first movable contact 431A and the second movable contact 431B) come into contact with and are separated from the fixed contacts (the first fixed contact 421*a*A and the second fixed contact 421*a*B). The electric arc is thus extended by the magnetic field in the direction perpendicular to the moving direction of the movable contactor 430, and cooled by the gas enclosed in the base 410, so that the arc voltage increases immediately, and the electric arc is then blocked when the arc voltage exceeds the voltage between the contacts. The electromagnetic relay 1 according to the present embodiment thus deals with the electric arc by the magnetic blow-out of the capsule yoke block 450 and by the cooling effect of the gas enclosed in the base 410. Accordingly, the electric arc can be blocked within a short period of time, so as to minimize deterioration of the movable contacts (the first movable contact 431A and the second movable contact 431B) or the fixed contacts (the first fixed contact 421*a*A and the second fixed contact 421*a*B).

(2) OPERATION

Next, the operation of the electromagnetic relay 1 (the contact device 40 and the electromagnetic device 30) is described below.

When the current applied to the exciting coil 330 is stopped, the movable iron core 370 moves in the direction away from the fixed iron core 360 due to the elastic force of the return spring 302 greater than the elastic force of the pressure spring 401, so that the movable contacts (the first movable contact 431A and the second movable contact 431B) are separated from the fixed contacts (the first fixed contact 421*a*A and the second fixed contact 421*a*B), as shown in FIG. 4.

When the exciting coil 330 is switched from the off state to the conducting state, the movable iron core 370 moves against the elastic force of the return spring 302 and comes closer to the fixed iron core 360 due to the electromagnetic force. In association with the upward movement of the movable iron core 370 (toward the fixed iron core 360), the shaft 380 and the other members including the upper yoke 491, the movable contactor 430, and the lower yoke 492 attached to the shaft 380 move upward (toward the fixed contacts). The movable contacts (the first movable contact 431A and the second movable contact 431B) of the movable contactor 430 are thus brought into contact with and electrically connected to the fixed contacts (the first fixed contact 421*a*A and the second fixed contact 421*a*B) of the fixed terminals (the first fixed terminal 420A and the second fixed terminal 420B), so that the electromagnetic relay 1 (the contact device 40) is turned on.

(3) FIRST BUSBAR AND SECOND BUSBAR

Next, a configuration of the first busbar 440A and the second busbar 440B according to the present embodiment will be described below.

Figure 5:
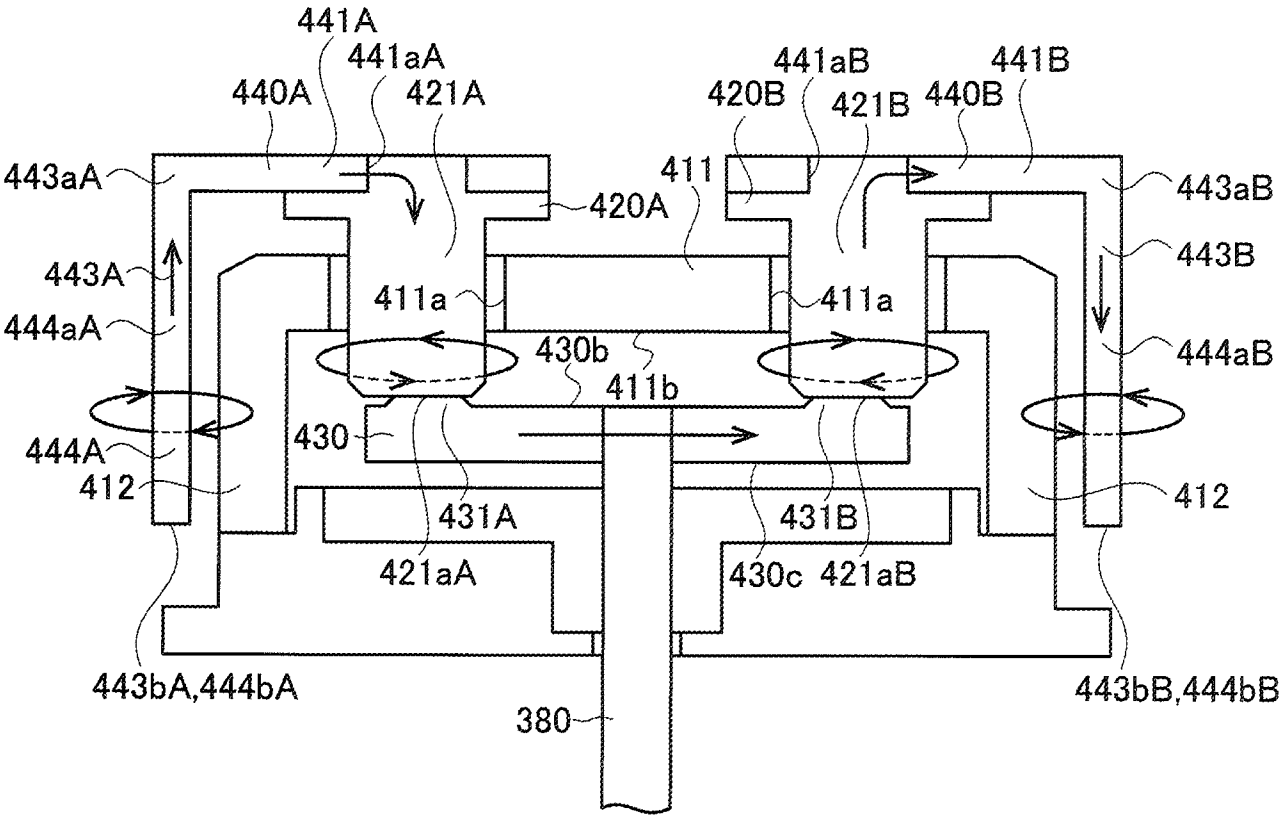
FIG. 5 is a schematic diagram showing a contact device according to the first embodiment.

When the electromagnetic relay 1 (the contact device 40 and the electromagnetic device 30) is turned on, a current flows through the first fixed terminal 420A and the second fixed terminal 420B via the movable contactor 430, as shown in FIG. 5.

FIG. 5 is illustrated with the case in which the current flows sequentially through the first busbar 440A, the first fixed terminal 420A, the movable contactor 430, the second fixed terminal 420B, and the second busbar 440B when the electromagnetic relay 1 (the contact device 10) is turned on. However, the current flow is not limited to this illustration, and the current may flow in the direction opposite to that shown in FIG. 5. Namely, the current may flow sequentially through the second busbar 440B, the second fixed terminal 420B, the movable contactor 430, the first fixed terminal 420A, and the first busbar 440A.

In the present embodiment, the first fixed terminal 420A and the second fixed terminal 420B are fixed to the top wall 411 in the state in which the longitudinal direction substantially conforms to the vertical direction. Thus, the current flows through the first fixed terminal 420A mainly downward in the vertical direction, and the current flows through the second fixed terminal 420B mainly upward in the vertical direction.

The current flowing through the first fixed terminal 420A generates a magnetic field around the first fixed terminal 420A. In this ease, magnetic flux from the rear side to the front side in the front-rear direction in FIG. 5 is generated on the right side of the first fixed terminal 420A (on the inner side of the first fixed terminal 420A toward the second fixed terminal 420B). In addition, magnetic flux from the front side to the rear side in the front-rear direction in FIG. 5 is generated on the left side of the first fixed terminal 420A (on the outer side of the first fixed terminal 420A away from the second fixed terminal 420B).

Similarly, the current flowing through the second fixed terminal 420B generates a magnetic field around the second fixed terminal 420B. In this case, magnetic flux from the rear side to the front side in the front-rear direction in FIG. 5 is generated on the left side of the second fixed terminal 420B (on the inner side of the second fixed terminal 420B toward the first fixed terminal 420A). In addition, magnetic flux from the front side to the rear side in the front-rear direction in FIG. 5 is generated on the right side of the second fixed terminal 420B (on the outer side of the second fixed terminal 420B away from the first fixed terminal 420A).

The current flows from the first fixed terminal 420A to the second fixed terminal 420B via the movable contactor 430. In the present embodiment, the movable contactor 430 has a substantially flat plate-like shape, and the movable contacts (the first movable contact 431A and the second movable contact 431B) provided on both ends of the upper surface 430*b* in the right-left direction are brought into contact with the bottom of the first fixed terminal 420A (the first fixed contact 421*a*A) and the bottom of the second fixed terminal 420B (the second fixed contact 421*a*B). Thus, the current flows through the movable contactor 430 mainly toward the right in the right-left direction in FIG. 5.

The magnetic flux (from the rear side to the front side in FIG. 5) is generated by the current flowing through the first fixed terminal 420A and the second fixed terminal 420B in the region of the movable contactor 430 in which the current flows toward the right in the right-left direction (corresponding to the region between the first fixed terminal 420A and the second fixed terminal 420B).

When the magnetic flux from the rear side to the front side in FIG. 5 is generated in the movable contactor 430 in which the current flows mainly toward the right in the right-left direction, the downward force (the force in the direction away from the first fixed terminal 420A and the second fixed terminal 420B: the electromagnetic repulsion force) acts on the movable contactor 430.

Thus, the electromagnetic repulsion force is caused between the first fixed contact 421*a*A and the movable contactor 430 and between the second fixed contact 421*a*B and the movable contactor 430 due to the current flowing through the first fixed terminal 420A and the second fixed terminal 420B via the movable contactor 430.

In order to improve the reliability of connection between the contacts, it is preferable to reduce the electromagnetic repulsion force between the first fixed terminal 420A and the movable contactor 430 and between the second fixed terminal 420B and the movable contactor 430.

The present embodiment can reduce the electromagnetic repulsion force acting on the respective contacts (between the first fixed terminal 420A and the movable contactor 430 and between the second fixed terminal 420B and the movable contactor 430).

In particular, the first busbar (the first conductive member) 440A includes a first extension portion 443A connected to the first fixed portion 441A.

The first extension portion 443A of the present embodiment is connected to the left end of the first fixed portion 441A extending from the first fixed terminal 420A toward the left in the right-left direction, and extends downward from the left end of the first fixed portion 441A, as shown in FIG. 4. The first terminal portion 442A is connected to a lower end 443*b*A of the first extension portion 443A and extends toward the case base 21 (in the front-rear direction). When the first terminal portion 442A is inserted into one of the slits 21*b*, the tip of the first terminal portion 442A is exposed to the outside of the case 20. The part of the first terminal portion 442A exposed to the outside of the case 20 is to be connected to an external load or the like.

The first extension portion 443A of the present embodiment includes a first opposed portion 444A opposed to at least one of the first fixed terminal 420A and the movable contactor 430 below the top wall (the partition member) 411 (toward one end) in the longitudinal direction of the first fixed terminal 420A.

The first opposed portion 444A extends in the longitudinal direction of the first fixed terminal 420A. The first opposed portion 444A extends in the vertical direction in the side view in the state in which the longitudinal direction of the first fixed terminal 420A conforms to the vertical direction. The direction in which the current mainly flows through the first opposed portion 444A is the upward direction in the vertical direction (opposite to the direction in which the current mainly flows through the first fixed terminal 420A).

The first extension portion 443A of the present embodiment extends substantially in the vertical direction from an upper end 443*a*A connected to the left end of the first fixed portion 441A to a lower end 443*b*A. The first extension portion 443A extends such that the lower end 443*b*A is located below the bottom wall 493 of the lower yoke 492, namely, located below the bottom surface 430*c* of the movable contactor 430, when the movable iron core 370 is in the initial position.

The first extension portion 443A of the present embodiment is arranged adjacent to and along the outer surface of the circumferential wall 412 extending in the vertical direction.

In the present embodiment, the part of the first extension portion 443A located below the lower surface 411*b* of the top wall 411 entirely serves as the first opposed portion 444A. The first opposed portion 444A extends in parallel with the longitudinal direction of the first fixed terminal 420A.

The first fixed contact 421*a*A of the present embodiment is thus located between one end and the other end of the first opposed portion 444A described above in the longitudinal direction of the first fixed terminal 420A. The first fixed contact 421*a*A is located between the upper end 444*a*A and the lower end 444*b*A of the first opposed portion 444A in the side view in the state in which the longitudinal direction of the first fixed terminal 420A conforms to the vertical direction.

The second busbar (the second conductive member) 440B of the present embodiment includes a second extension portion 443B connected to the second fixed portion 441B.

The second extension portion 443B of the present embodiment is connected to the right end of the second fixed portion 441B extending from the second fixed terminal 420B toward the right in the right-left direction, and extends downward from the right end of the second fixed portion 441B, as shown in FIG. 4. The second terminal portion 442B is connected to a lower end 443*b*B of the second extension portion 443B and extends toward the case base 21 (in the front-rear direction). When the second terminal portion 442B is inserted into the other slit 21*b*, the tip of the second terminal portion 442B is exposed to the outside of the case 20. The part of the second terminal portion 442B exposed to the outside of the case 20 is to be connected to an external load or the like.

The second extension portion 443B of the present embodiment includes a second opposed portion 444B opposed to at least one of the second fixed terminal 420B and the movable contactor 430 below the top wall (the partition member) 411 (toward one end) in the longitudinal direction of the second fixed terminal 420B. The second opposed portion 444B extends in the longitudinal direction of the second fixed terminal 420B. The second opposed portion 444B extends in the vertical direction in the side view in the state in which the longitudinal direction of the second fixed terminal 420B conforms to the vertical direction. The direction in which the current mainly flows through the second opposed portion 444B is the downward direction in the vertical direction (opposite to the direction in which the current mainly flows through the second fixed terminal 420B).

The second extension portion 443B of the present embodiment extends substantially in the vertical direction from an upper end 443*a*B connected to the right end of the second fixed portion 441B to a lower end 443*b*B. The second extension portion 443B extends such that the lower end 443*b*B is located below the bottom wall 493 of the lower yoke 492, namely, located below the bottom surface 430*c* of the movable contactor 430, when the movable iron core 370 is in the initial position.

The second extension portion 443B of the present embodiment is arranged adjacent to and along the outer surface of the circumferential wall 412 extending in the vertical direction.

In the present embodiment, the part of the second extension portion 443B located below the lower surface 411*b* of the top wall 411 entirely serves as the second opposed portion 444B. The second opposed portion 444B extends in parallel with the longitudinal direction of the second fixed terminal 420B.

The second fixed contact 421*a*B of the present embodiment is thus located between one end and the other end of the second opposed portion 444B described above in the longitudinal direction of the second fixed terminal 420B. The second fixed contact 421*a*B is located between the upper end 444*a*B and the lower end 444*b*B of the second opposed portion 444B in the side view in the state in which the longitudinal direction of the second fixed terminal 420B conforms to the vertical direction.

FIG. 4 is illustrated with the case in which the second extension portion 443B is located on the outside of the capsule yoke block 450 (the capsule yoke 451 and the pair of the permanent magnets 452) arranged on the periphery of the circumferential wall 412. However, the arrangement of the first extension portion 443A or the second extension portion 443B is not limited to the illustration. The first extension portion 443A or the second extension portion 443B may be arranged between the circumferential wall 412 and the capsule yoke block 450. This arrangement allows the first extension portion 443A (the first opposed portion 444A) or the second extension portion 443B (the second opposed portion 444B) to come closer to the movable contactor 430.

As described above, the two conductive members (the first busbar 440A and the second busbar 440B) are arranged such that the respective fixed portions (the first fixed portion 441A and the second fixed portion 441B) extend outward in the direction in which the first fixed terminal 420A and the second fixed terminal 420B are aligned.

The first fixed portion 441A fixed to the first fixed terminal 420A extends away from the second fixed terminal 420B (toward the left in FIG. 4) in the direction in which the first fixed terminal 420A and the second fixed terminal 420B are aligned. The second fixed portion 441B fixed to the second fixed terminal 420B extends away from the first fixed terminal 420A (toward the right in FIG. 4) in the direction in which the first fixed terminal 420A and the second fixed terminal 420B are aligned.

The current thus flows through the first opposed portion 444A mainly upward in the vertical direction, and the current flows through the second opposed portion 444B mainly downward in the vertical direction when the electromagnetic relay 1 (the contact device 40 and the electromagnetic device 30) is turned on.

The magnetic field is generated around the first opposed portion 444A due to the current flowing through the first opposed portion 444A. The magnetic flux flows from the front side to the rear side in FIG. 5 on the right side of the first opposed portion 444A (toward the two fixed terminals). The magnetic flux flows from the rear side to the front side in FIG. 5 on the left side of the first opposed portion 444A (on the opposite side of the two fixed terminals in the aligned direction).

The magnetic field is generated around the second opposed portion 444B due to the current flowing through the second opposed portion 444B. The magnetic flux flows from the front side to the rear side in FIG. 5 on the left side of the second opposed portion 444B (toward the two fixed terminals). The magnetic flux flows from the rear side to the front side in FIG. 5 on the right side of the second opposed portion 444B (on the opposite side of the two fixed terminals in the aligned direction).

The magnetic flux from the rear side to the front side in FIG. 5 is thus generated in the region of the movable contactor 430 in which the current flows toward the right in the right-left direction (corresponding to the region between the first fixed terminal 420A and the second fixed terminal 420B).

When the electromagnetic relay 1 (the contact device 40 and the electromagnetic device 30) is turned on, the magnetic field generated around the first opposed portion 444A and the second opposed portion 444B (the magnetic flux from the front side to the rear side in FIG. 5) acts on the movable contactor 430. The magnetic field which causes the electromagnetic repulsion force (the magnetic flux from the rear side to the front side in FIG. 5) acting on the movable contactor 430 is thus reduced. The reduction of the magnetic field reduces the electromagnetic repulsion force acting on the respective contacts (between the first fixed contact 421*a*A and the movable contactor 430 and between the second fixed contact 421*a*B and the movable contactor 430).

The reduction of the electromagnetic repulsion force acting on the respective contacts (between the first fixed contact 421*a*A and the movable contactor 430 and between the second fixed contact 421*a*B and the movable contactor 430) can improve the reliability of connection between the contacts accordingly.

(4) MODIFIED EXAMPLE OF FIRST BUSBAR AND SECOND BUSBAR

Next, a modified example of the first busbar 440A and the second busbar 440B will be described below.

FIGS. 4 and 5 are illustrated with the case in which the first extension portion 443A extends in the vertical direction from the upper end 443*a*A connected to the left end of the first fixed portion 441A to the lower end 443*b*A, and the second extension portion 443B extends in the vertical direction from the upper end 443*a*B connected to the right end of the second fixed portion 441B to the lower end 443*b*B.

However, the first extension portion 443A and the second extension portion 443B are not limited to this illustration, and may have any configuration which can reduce the magnetic field (the magnetic field causing the electromagnetic repulsion force) acting on the movable contactor 430.

Figure 6:
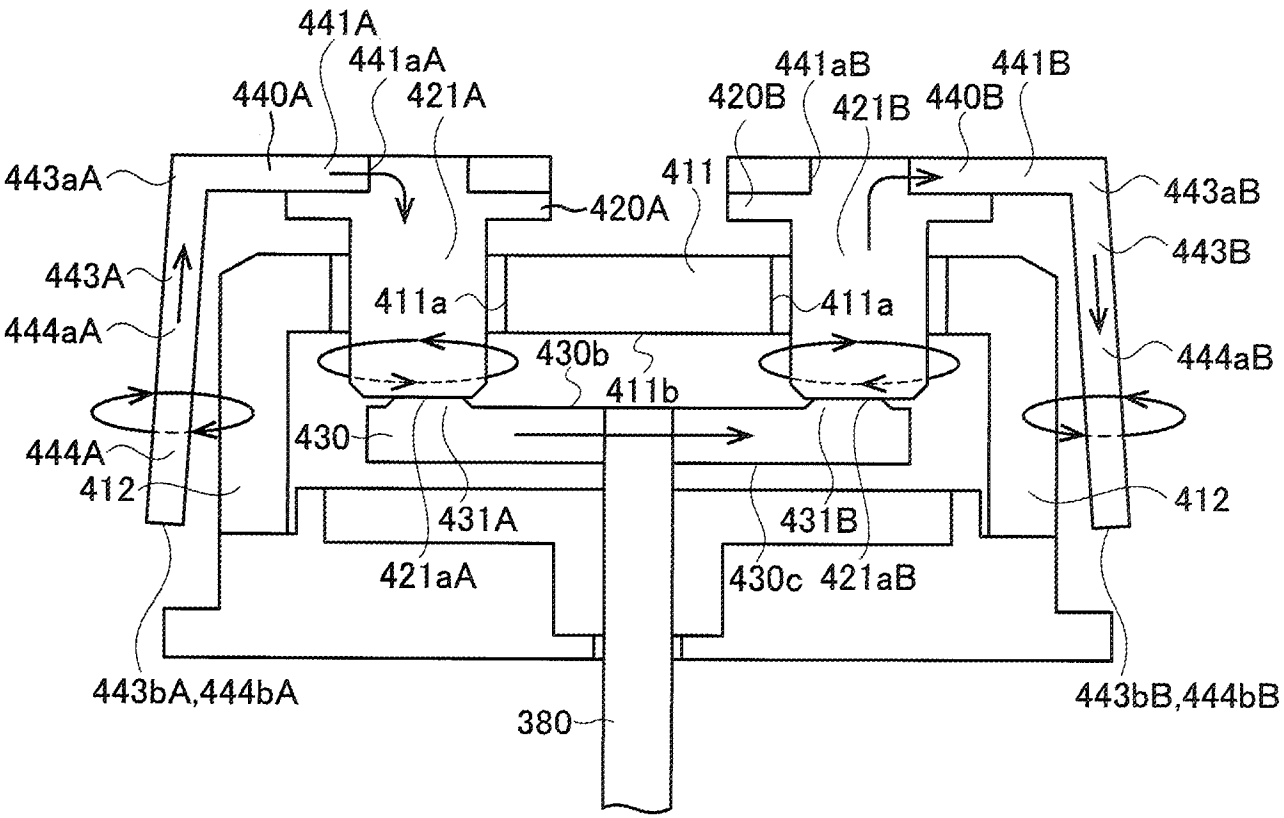
FIG. 6 is a schematic diagram showing a first modified example of the contact device according to the first embodiment.

For example, as shown in FIG. 6, the first extension portion 443A and the second extension portion 443B may incline to the vertical direction. Namely, the first extension portion 443A and the second extension portion 443B may be opposed to the first fixed terminal 420A and the second fixed terminal 420B, respectively, while inclining to the longitudinal direction of the first fixed terminal 420A and the second fixed terminal 420B.

As shown in FIG. 6, the first extension portion 443A extends downward and outward from the left end of the first fixed portion 441A extending on the left side of the first fixed terminal 420A in the right-left direction. The first extension portion 443A extends such that the lower end 443*b*A is located below the bottom surface 430*c* of the movable contactor 430. Namely, the first fixed contact 421*a*A is located between the upper end 444*a*A and the lower end 444*b*A of the first opposed portion 444A in the side view in the state in which the longitudinal direction of the first fixed terminal 420A conforms to the vertical direction.

The second extension portion 443B extends downward and outward from the right end of the second fixed portion 441B extending on the right side of the second fixed terminal 420B in the right-left direction. The second extension portion 443B extends such that the lower end 443*b*B is located below the bottom surface 430*c* of the movable contactor 430. Namely, the second fixed contact 421*a*B is located between the upper end 444*a*B and the lower end 444*b*B of the second opposed portion 444B in the side view in the state in which the longitudinal direction of the second fixed terminal 420B conforms to the vertical direction.

The angle of inclination of the first opposed portion 444A and the second opposed portion 444B to the longitudinal direction is preferably 45 degrees or less. The main direction of the current flowing through the first opposed portion 444A and the current flowing through the second opposed portion 444B thus approximates to the vertical direction. Accordingly, the magnetic field acting on the movable contactor 430 (the magnetic field causing the electromagnetic repulsion force) can be reduced more efficiently than a case in which the angle of inclination is greater than 45 degrees.

Figure 7:
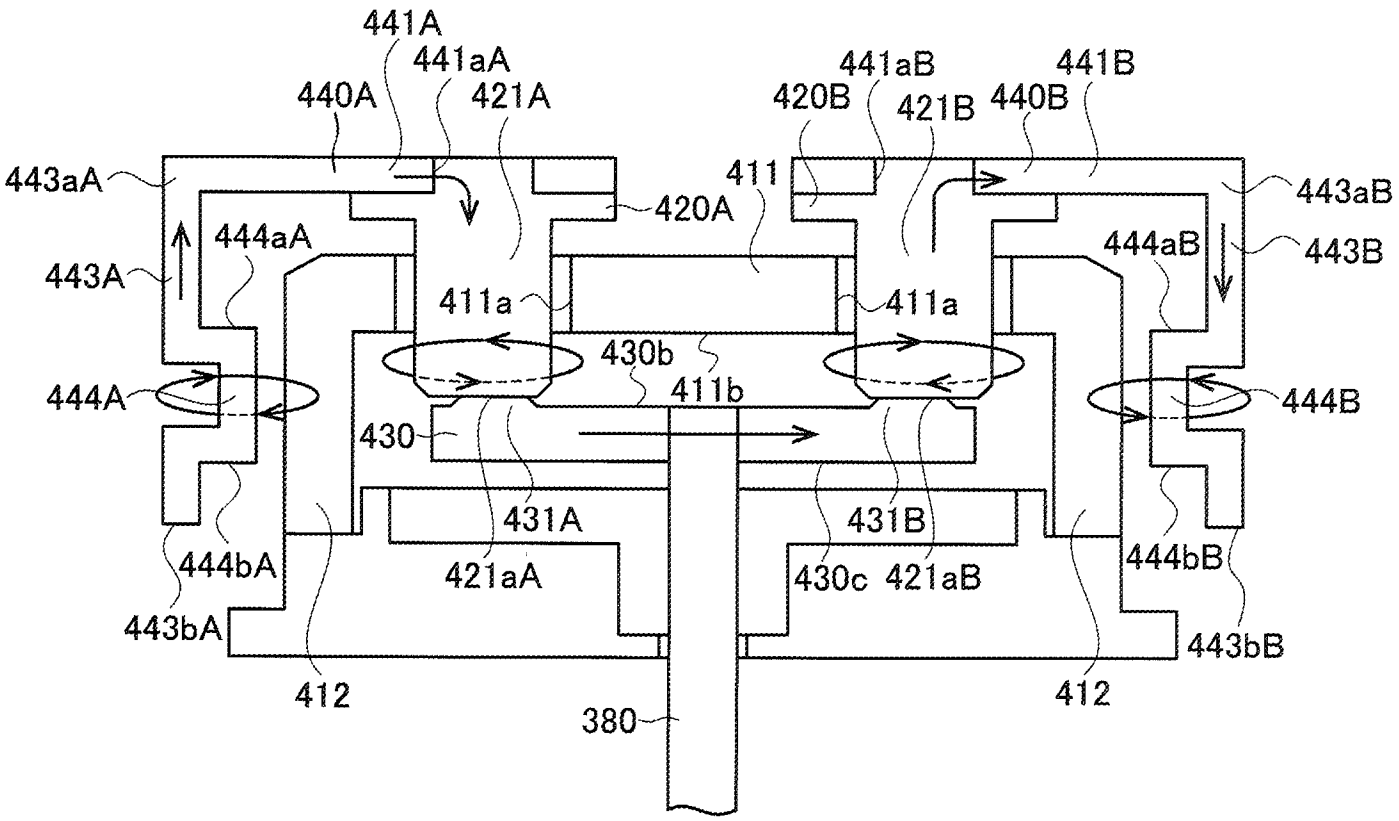
FIG. 7 is a schematic diagram showing a second modified example of the contact device according to the first embodiment.

Alternatively, as shown in FIG. 7, the first extension portion 443A and the second extension portion 443B may partly be bent inward, and the first opposed portion 444A and the second opposed portion 444B may be formed at the bent portions.

As shown in FIG. 7, the part of the first extension portion 443A corresponding to the first fixed contact 421*a*A is bent toward the first fixed contact 421*a*A, and the first opposed portion 444A is formed at the bent portion. The first fixed contact 421*a*A is also located between the upper end 444*a*A and the lower end 444*b*A of the first opposed portion 444A in the side view in the state in which the longitudinal direction of the first fixed terminal 420A conforms to the vertical direction.

The part of the second extension portion 443B corresponding to the second fixed contact 421*a*B is bent toward the second fixed contact 421*a*B, and the second opposed portion. 444B is formed at the bent portion. The second fixed contact 421*a*B is also located between the upper end 444*a*B and the lower end 444*b*B of the second opposed portion 444B in the side view in the state in which the longitudinal direction of the second fixed terminal 420B conforms to the vertical direction.

The opposed portions (the first opposed portion 444A and the second opposed portion 444B) are preferably provided such that the direction in which the current mainly flows therethrough conforms to the vertical direction. In other words, the opposed portions (the first opposed portion 444A and the second opposed portion 444B) each preferably has a length in the vertical direction (a distance from the upper end to the lower end in the vertical direction) greater than the width of the extension portions (the first extension portion 443A and the second extension portion 443B).

FIGS. 4 to 7 are illustrated with the case in which the respective opposed portions (the first opposed portion 444A and the second opposed portion 444B) are opposed to the respective fixed contacts (the first fixed contact 421*a*A and the second fixed contact 421*a*B). However, the magnetic field acting on the movable contactor 430 can also be reduced in the case in which the respective opposed portions are not opposed to the respective fixed contacts.

For example, the opposed portions (the first opposed portion 444A and the second opposed portion 444B) may be formed such that the lower ends (the lower end 444*b*A and the lower end 444*b*B) are located above the fixed contacts (the first fixed contact 421*a*A and the second fixed contact 421*a*B).

The lower ends (the lower end 444*b*A and the lower end 444*b*B) of the opposed portions (the first opposed portion 444A and the second opposed portion 444B) are preferably located below the middle portion between the lower surface 411*b* of the top wall 411 and the fixed contacts (the first fixed contact 421*a*A and the second fixed contact 421*a*B).

(5) MODIFIED EXAMPLE OF ARRANGEMENT OF FIRST BUSBAR AND SECOND BUSBAR

Next, a modified example of the first busbar 440A and the second busbar 440B will be described below.

Figure 8A:
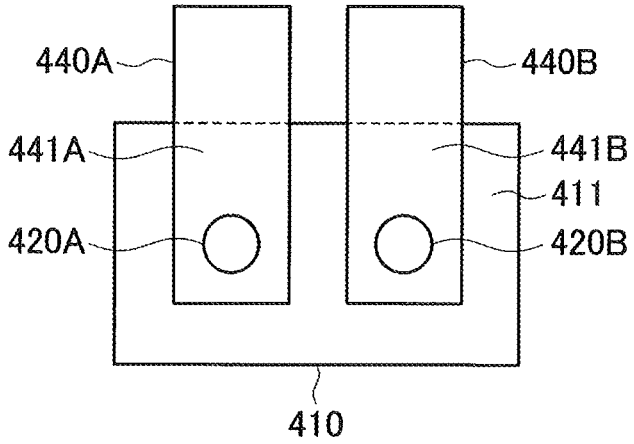
FIG. 8A is a schematic plan view of a first modified example of an arrangement of a first conductive member and a second conductive member according to the first embodiment.

The arrangement of the two conductive members (the first busbar 440A and the second busbar 440B) is not limited to the illustration described above, for example, may be arranged as shown in FIG. 8A.

In FIG. 8A, the two conductive members (the first busbar 440A and the second busbar 440B) are arranged such that the first fixed portion 441A and the second fixed portion 441B both extend in the same direction.

In particular, the first fixed portion 441A fixed to the first fixed terminal 420A extends in the direction perpendicular to the direction in which the first fixed terminal 420A and the second fixed, terminal 420B are aligned. The second fixed portion 441B fixed to the second fixed terminal 420B also extends in the direction perpendicular to the direction in which the first fixed terminal 420A and the second fixed terminal 420B are aligned. The two conductive members the first busbar 440A and the second busbar 440B) are arranged such that the extending direction of the first fixed portion 441A and the extending direction of the second fixed portion 441B conform to each other.

Figure 8B:
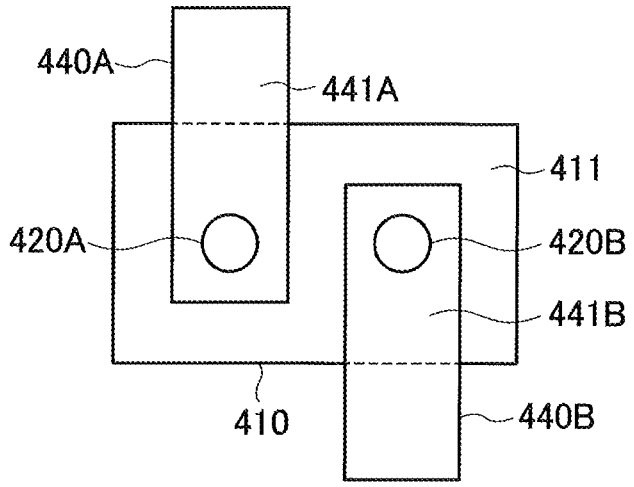
FIG. 8B is a schematic plan view of a second modified example of the arrangement of the first conductive member and the second conductive member according to the first embodiment.

Alternatively, as shown in FIG. 8B, the two conductive members (the first busbar 440A and the second busbar 440B) may be arranged such that the first fixed portion 441A and the second fixed portion 441B extend in opposite directions.

In particular, the first fixed portion 441A fixed to the first fixed terminal 420A extends in the direction perpendicular to the direction in which the first fixed terminal 420A and the second fixed terminal 420B are aligned. The second fixed portion 441B fixed to the second fixed terminal 420B also extends in the direction perpendicular to the direction in which the first fixed terminal 420A and the second fixed terminal 420B are aligned. The two conductive members (the first busbar 440A and the second busbar 440B) are arranged such that the extending direction of the first fixed portion 441A and the extending direction of the second fixed portion 441B are opposite to each other.

Figure 8C:
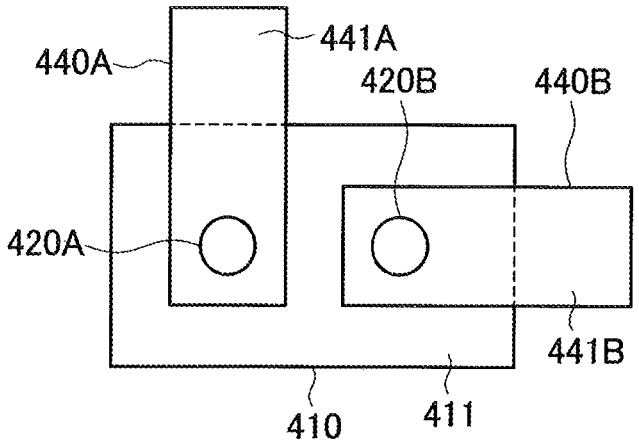
FIG. 8C is a schematic plan view of a third modified example of the arrangement of the first conductive member and the second conductive member according to the first embodiment.

Alternatively; as shown in FIG. 8C, the two conductive members (the first busbar 440A and the second busbar 440B) may be arranged such that the first fixed portion 441A and the second fixed portion 441B extend in different directions perpendicular to each other.

In particular, the second fixed portion 441B fixed to the second fixed terminal 420B (one of the fixed portions) extends in the direction in which the first fixed terminal 420A and the second fixed terminal 420B are aligned and in the direction away from the first fixed terminal 420A (toward the opposite side of the other fixed terminal to which the other fixed portion is fixed). The first fixed portion 441A fixed to the first fixed terminal (the other fixed portion) extends in the direction perpendicular to the direction in which the first fixed terminal 420A and the second fixed terminal 420B are aligned.

(6) ADVANTAGEOUS EFFECTS

As described above, the contact device 40 according to the present embodiment includes the first fixed terminal 420A provided with the first fixed contact 421*a*A at the lower end (at one end in the longitudinal direction), and the second fixed terminal 420B provided with the second fixed contact 421*a*B at the lower end (at one end in the longitudinal direction).

The contact device 40 also includes the movable contactor 430 which is brought into contact with and separated from the first fixed terminal 420A and the second fixed terminal 420B, so as to switch the electrical connection between the first fixed terminal 420A and the second fixed terminal 420B, and the electromagnetic device (the drive unit) 30 which drives the movable contactor 430.

The contact device 10 also includes the first busbar (the first conductive member) 440A including the first fixed portion 441A fixed to the upper end (the other end in the longitudinal direction) of the first fixed terminal 420A, and the second busbar (the second conductive member) 440B including the second fixed portion 441B fixed to the upper end (the other end in the longitudinal direction) of the second fixed terminal 420B.

The contact device 10 also includes the top wall (the partition member) 411 to which the first fixed terminal 420A and the second fixed terminal 420B are fixed, the top wall 411 partitioning the lower side (one end in the longitudinal direction) and the upper side (the other end in the longitudinal direction) of the first fixed terminal 420A and partitioning the lower side (one end in the longitudinal direction) and the upper side (the other end in the longitudinal direction) of the second fixed terminal 420B.

The first busbar (the first conductive member) 440A includes the first extension portion 443A connected to the first fixed portion 441A.

The first extension portion 443A includes the first opposed portion 444A opposed to at least one of the first fixed terminal 420A and the movable contactor 430 below the top wall (the partition member) 411 (toward one end) in the vertical direction (the longitudinal direction) of the first fixed terminal 420A.

The first opposed portion 444A extends in the longitudinal direction of the first fixed terminal 420A.

The magnetic field generated around the first opposed portion 444A thus acts on the movable contactor 430, so as to reduce the magnetic field which causes the electromagnetic repulsion force. Accordingly, the electromagnetic repulsion force acting on the respective contacts (between the first fixed contact 421*a*A and the movable contactor 430 and between the second fixed contact 421*a*B and the movable contactor 430) can be reduced.

The electromagnetic relay 1 according to the present embodiment is equipped with the contact device 10.

The present embodiment can provide the contact device 40 and the electromagnetic relay 1 including the contact device 40 in which the electromagnetic repulsion force acting on the respective contacts (between the first fixed contact 421*a*A and the movable contactor 430 and between the second fixed contact 421*a*B and the movable contactor 430) is reduced more efficiently.

The first fixed contact 421*a*A may be located between one end (the upper end 444*a*A) and the other end (the lower end 444*b*A) of the first opposed portion 444A in the longitudinal direction of the first fixed terminal 420A.

This configuration can increase the magnetic field acting on the movable contactor 430, so as to further reduce the electromagnetic repulsion force acting on the respective contacts (between the first fixed contact 421*a*A and the movable contactor 430 and between the second fixed contact 421*a*B and the movable contactor 430).

The first opposed portion 444A may extend in parallel with the longitudinal direction of the first fixed terminal 420A.

This configuration allows the magnetic field generated around the first opposed portion 444A to act on the movable contactor 430 more reliably, so that the electromagnetic repulsion force acting on the respective contacts (between the first fixed contact 421*a*A and the movable contactor 430 and between the second fixed contact 421*a*B and the movable contactor 430) can be reduced more reliably.

The second busbar (the second conductive member) 440B may include the second extension portion 443B connected to the second fixed portion 441B.

The second extension portion 443B may include the second opposed portion 444B opposed to at least one of the second fixed terminal 420B and the movable contactor 430 below the top wall (the partition member) 411 (toward one end) in the longitudinal direction of the second fixed terminal 420B. The second opposed portion 444B extends in the longitudinal direction of the second fixed terminal 420B.

The magnetic field generated around the second opposed portion 444B thus acts on the movable contactor 430, so as to reduce the magnetic field which causes the electromagnetic repulsion force. Accordingly, the electromagnetic repulsion force acting on the respective contacts (between the first fixed contact 421*a*A and the movable contactor 430 and between the second fixed contact 421*a*B and the movable contactor 430) can be reduced.

The second fixed contact 421*a*B may be located between one end (the upper end 444*a*B) and the other end (the lower end 444*b*B) of the second opposed portion 444B in the longitudinal direction of the second fixed terminal 420B.

This configuration can increase the magnetic field acting on the movable contactor 430, so as to further reduce the electromagnetic repulsion force acting on the respective contacts (between the first fixed contact 421*a*A and the movable contactor 430 and between the second fixed contact 421*a*B and the movable contactor 430).

The second opposed portion 444B may extend parallel with the longitudinal direction of the second fixed terminal 420B.

This configuration allows the magnetic field generated around the second opposed portion 444B to act on the movable contactor 430 more reliably, so that the electromagnetic repulsion force acting on the respective contacts (between the first fixed contact 421*a*A and the movable contactor 430 and between the second fixed contact 421*a*B and the movable contactor 430) can be reduced more reliably.

Second Embodiment

A contact device 40, an electromagnetic relay 1, and an electrical device M1 according to this embodiment will be described with reference to FIGS. 9 to 19.

(1) CONFIGURATION

(1.1) Electromagnetic Relay

The electromagnetic relay 1 according to this embodiment includes a contact device 40 and an electromagnetic device 30. The contact device 40 includes a pair of fixed terminals (first fixed terminal 420A and second fixed terminal 420B) and a movable contactor 430 (sec FIG. 10). Each of the fixed terminals (first fixed terminal 420A and second fixed terminal 420B) hold fixed contacts (first fixed contact 421*a*A and second fixed contact 421*a*B). The movable contactor 430 holds a pair of movable contacts (first movable contact 431A and second movable contact 431B).

Figure 10:
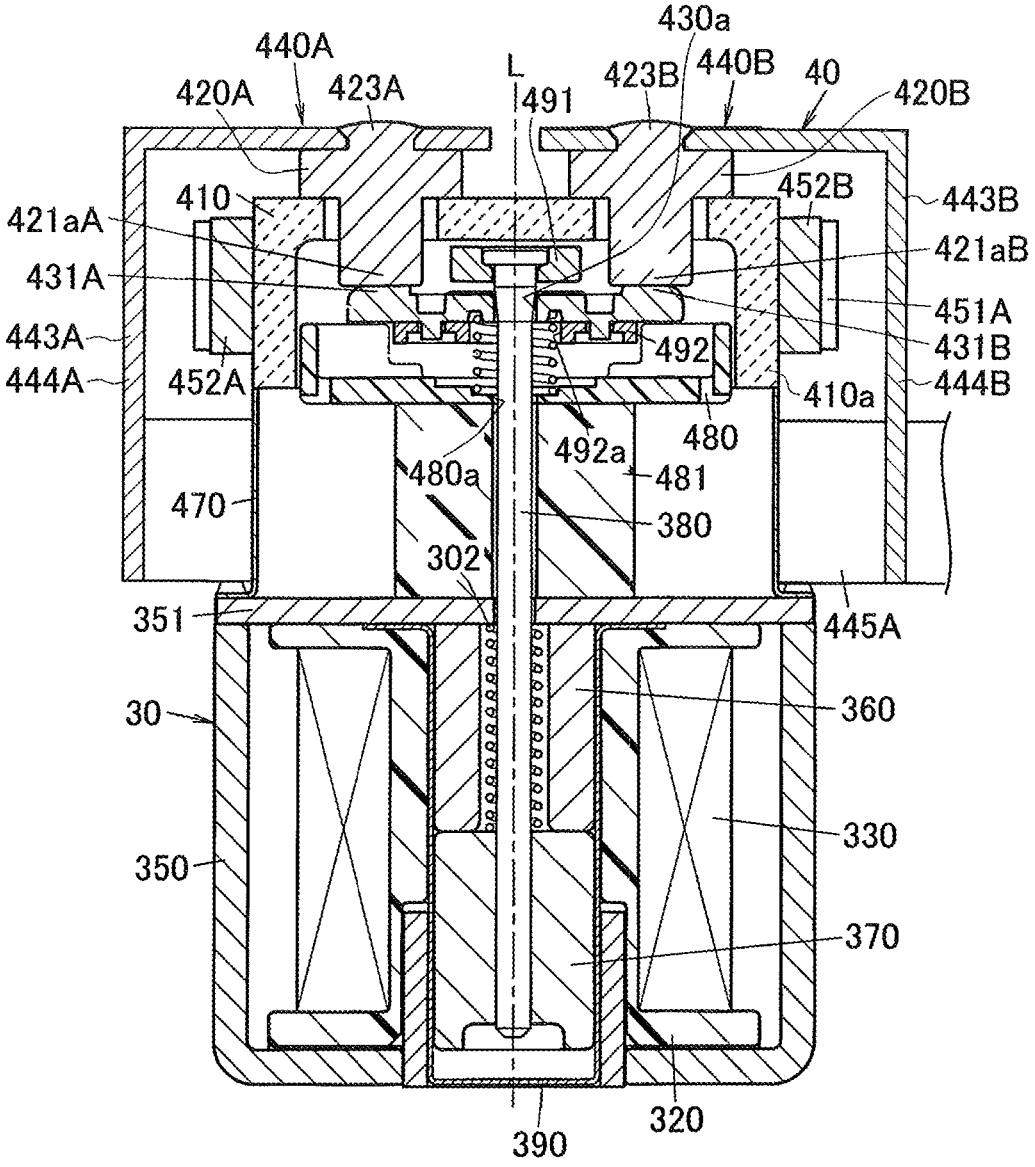
FIG. 10 is a cross-sectional view taken along the line X1-X1 in FIG. 9.

The electromagnetic device 30 includes a movable element 370 and an exciting coil 330 (see FIG. 10). The electromagnetic device 30 attracts the movable element 370 by a magnetic field generated by the exciting coil 330 when the current is applied to the exciting coil 330. This attraction of the movable element 370 moves the movable contactor 430 from an open position to a closed position. Note that the "open position" used in the present disclosure means a position of the movable contactor 430 when the movable contacts (first movable contact 431A and second movable contact 431B) are separated from the fixed contacts (first fixed contact 421*a*A and second fixed contact 421*a*B). On the other hand, the "closed position" used in the present disclosure means a position of the movable contactor 430 when the movable contacts (first movable contact 431A and second movable contact 431B) are brought into contact with the fixed contacts (first fixed contact 421*a*A and second fixed contact 421*a*B).

In this embodiment, the movable element 370 is disposed on a straight line L, and is configured to move linearly in a reciprocating fashion along the straight line L. The exciting coil 330 includes a conductive wire (electric wire) wound around the straight line L. That is, in this embodiment, the straight L corresponds to the central axis of the exciting coil 330.

Figure 9:
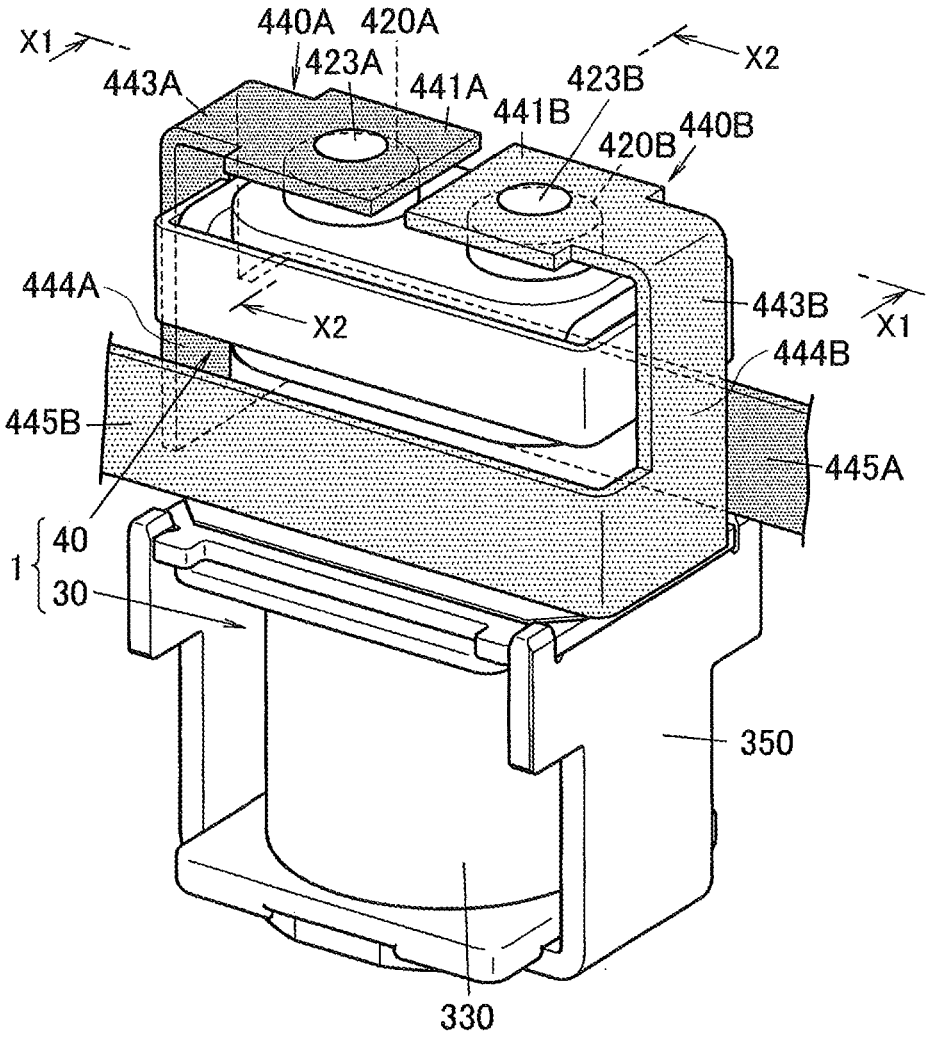
FIG. 9 is a perspective view of an electromagnetic relay according to a second embodiment.

In this embodiment, as shown in FIG. 9, description is given of, as an example, the case where the contact device 40 is included in the electromagnetic relay 1 together with the electromagnetic device 30. Note, however, that the contact device 40 is not limited to the electromagnetic relay 1, and may be used as, for example, a breaker (interrupter) or a switch. In this embodiment, description is given of the case where the electromagnetic relay 1 (electrical device 1) is mounted on an electric vehicle. In this case, the contact device 40 (first fixed terminal 420A and second fixed terminal 420B) is electrically connected to a supply path of DC power from a battery for traveling to a load (for example, an inverter).

(1.2) Contact Device

Next, a configuration of the contact device 40 described below.

As shown in FIGS. 9 and 10, the contact device 40 includes a pair of fixed terminals (first fixed terminal 420A and second fixed terminal 420B), a movable contactor 430, a housing (base) 410, a flange (upper flange) 470, and two conductive members (first busbar 440A and second busbar 440B). The contact device 40 further includes a first yoke 491, a second yoke 492, two capsule yokes 451A and 451B, two arc-extinguishing magnets (permanent magnets) 452A and 452B, an insulating plate 480, and a spacer 481. The first fixed terminal 420A holds the first fixed contact 421*a*A, while the second fixed terminal 420B holds the second fixed contact 421*a*B. The movable contactor 430 is a plate-like member made of a conductive metal material. The movable contactor 430 holds a pair of movable contacts (first movable contact 431A and second movable contact 431B) arranged so as to be opposed to the pair of fixed contacts (first fixed contact 421*a*A and second fixed contact 421*a*B).

In the following description, for the purpose of illustration, the direction in which the fixed contacts (first fixed contact 421*a*A and second fixed contact 421*a*B) and the movable contacts (first movable contact 431A and second movable contact 431B) are opposed to each other is defined as the vertical direction, and the fixed contact (first fixed contact 421*a*A and second fixed contact 421*a*B) side as viewed from the movable contact (first movable contact 431A and second movable contact 431B) is defined as the upper side. Furthermore, the direction in which the pair of fixed terminals 420A and 420B (the pair of fixed contacts 421*a*A and 421*a*B) are aligned is defined as the right-left direction, and the second fixed terminal 420B side as viewed from the first fixed terminal 420A is defined as the right. That is, hereinafter, the definitions of the top, bottom, right, and left applied to FIG. 10 are used for the explanations of the drawings. In the following description, a direction perpendicular to both of the vertical direction and the right-left direction (direction perpendicular to the paper of FIG. 10) is defined as the front-rear direction. However, these directions are not intended to limit the use of the contact device 40 and the electromagnetic relay 1.

In this embodiment, one fixed contact (first fixed contact 421*a*A) is held at the lower end (one end) of one fixed terminal (first fixed terminal 420A), and the other fixed contact (second fixed contact 421*a*B) is held at the lower end (one end) of the other fixed terminal (second fixed terminal 420B).

The pair of fixed terminals 420A and 4208 are arranged in the right-left direction (see FIG. 10). Each of the pair of fixed terminals 420A and 420B can be formed using, for example, a conductive metal material. The pair of fixed terminals 420A and 420B function as terminals for connecting an external circuit (battery and load) to the pair of fixed contacts 421*a*A and 421*a*B. Note that, although the fixed terminals 420A and 420B made of copper (Cu) are used as an example in this embodiment, the fixed terminals 420A and 420B are not limited to copper, and the fixed terminals 420A and 420B may be formed of any conductive material other than copper.

Each of the pair of fixed terminals 420A and 420B is formed in a cylindrical shape whose cross-section within a plane perpendicular to the vertical direction is circular. In this embodiment, each of the pair of fixed terminals 420A and 420B is configured such that the diameter of the upper end (other end) side of is larger than the diameter of the lower end (one end) side, and the front view is T-shaped. The pair of fixed terminals 420A and 420B is held by the housing 410 in a state where a part (the other end) protrudes from the top surface of the housing 410. To be more specific, each of the pair of fixed terminals 420A and 420B is fixed to the housing 410 in a state of penetrating through an opening formed in the upper wall of the housing 410.

The movable contactor 430 has a thickness in the vertical direction and is formed in a plate shape longer in the right-left direction than in the front-rear direction. The movable contactor 430 is disposed below the pair of fixed terminals 420A and 420B in a state where both end portions in the longitudinal direction right-left direction) are opposed to the pair of fixed contacts 421*a*A and 421*a*B (see FIG. 10). A pair of movable contacts 431A and 431B is provided in a portion of the movable contactor 430 opposed to the pair of fixed contacts 421*a*A and 421*a*B (see FIG. 10).

The movable contactor 430 is accommodated in the housing 410 and is moved in the vertical direction by the electromagnetic device 30 disposed below the housing 410. Thus, the movable contactor 430 moves between the closed position and the open position. FIG. 10 shows a state where the movable contactor 430 is located in the closed position. In this state, the pair of movable contacts 431A and 431B held by the movable contactor 430 are in contact with the fixed contacts 421*a*A and 421*a*B corresponding thereto, respectively. On the other hand, when the movable contactor 430 is located in the open position, the pair of movable contacts 431A and 431B held by the movable contactor 430 are separated from the corresponding fixed contacts 421*a*A and 421*a*B.

Therefore, when the movable contactor 430 is in the closed position, a short circuit occurs between the pair of fixed terminals 420A and 420B via the movable contactor 430. That is, when the movable contactor 430 is in the closed position, the movable contacts 431A and 431B come into contact with the fixed contacts 421*a*A and 421*a*B. Therefore, the first fixed terminal 420A is electrically connected to the second fixed terminal 420B through the first fixed contact 421*a*A, the first movable contact 431A, the movable contactor 430, the second movable contact 431B, and the second fixed contact 421*a*B. Thus, if the first fixed terminal 420A is electrically connected to one of the battery and the load, and the second fixed terminal 420B is electrically connected to the other, the contact device 40 forms a DC power supply path from the battery to the load when the movable contactor 430 is in the closed position.

Here, the movable contacts 431A and 431B may be held by the movable contactor 430. Therefore, the movable contacts 431A and 431B may be configured integrally with the movable contactor 430 such that a part of the movable contactor 430 is punched out or the like, or may be formed of a separate member from the movable contactor 430 and fixed to the movable contactor 430 by welding or the like, for example. Likewise, the fixed contacts 421*a*A and 421*a*B may be held by the fixed terminals 420A and 420B. Therefore, the fixed contacts 421*a*A and 421*a*B may be formed integrally with the fixed terminals 420A and 420B, or may be formed of a separate member from the fixed terminals 420A and 420B and fixed to the fixed terminals 420A and 420B by welding or the like, for example.

The movable contactor 430 has a through-hole 430*a* in its central portion. In this embodiment, the through-hole 430*a* is formed between the pair of movable contacts 431A and 431B in the movable contactor 430. The through-hole 430*a* penetrates the movable contactor 430 in the thickness direction (vertical direction). The through-hole 430*a* is a hole for inserting a shaft 380 to be described later.

The first yoke 491 is a ferromagnetic body, and is formed of, for example, a metal material such as iron. In this embodiment, the first yoke 491 is fixed to the tip (upper end) of the shaft 380. The shaft 380 penetrates the movable contactor 430 through the through-hole 430*a* in the movable contactor 430, and the tip (upper end) of the shaft 380 protrudes upward from the upper surface of the movable contactor 430. Therefore, the first yoke 491 is located above the movable contactor 430 (see FIG. 10).

Figure 14:
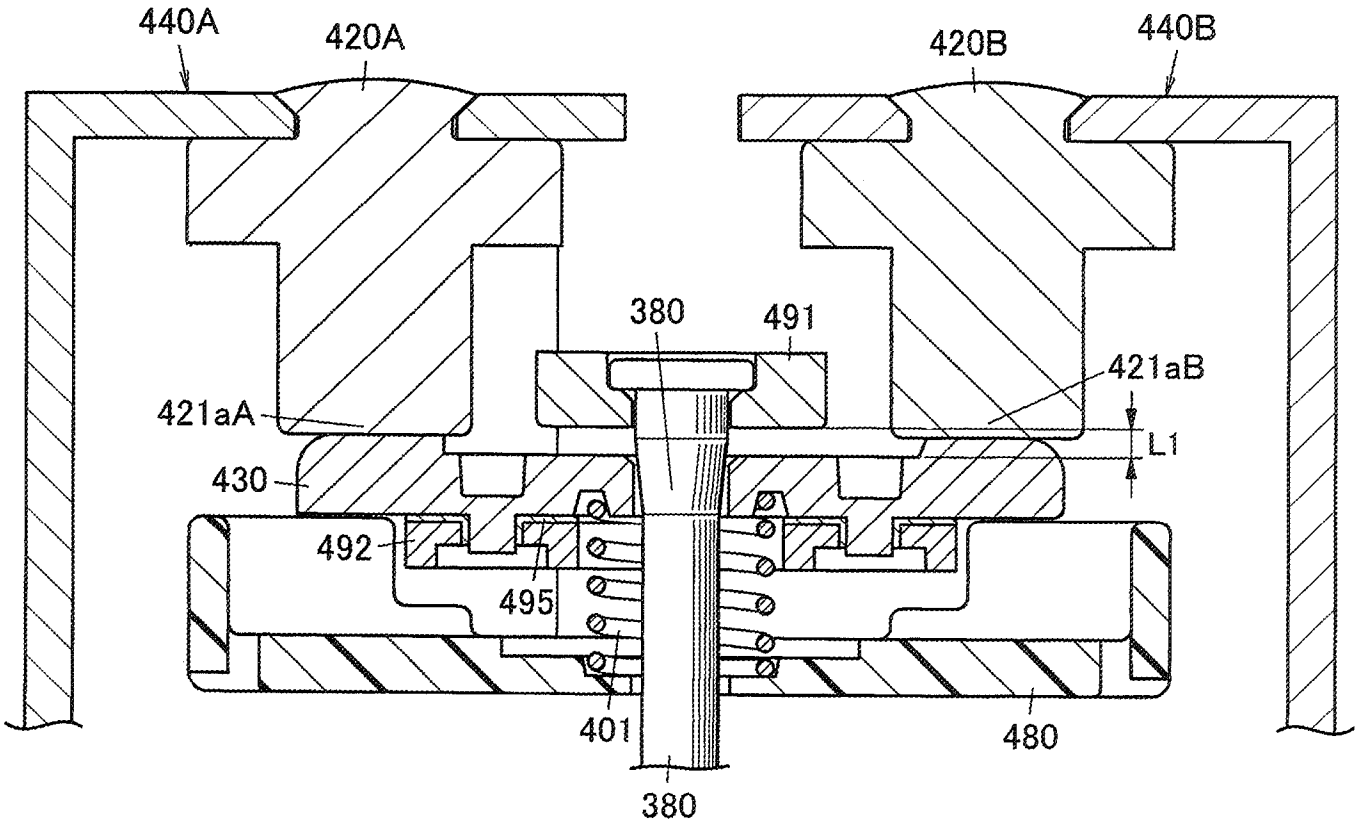
FIG. 14 is a diagram for explaining a positional relationship between the first yoke and the movable contactor according to the second embodiment.

In this embodiment, when the movable contactor 430 is located in the closed position, a predetermined gap L1 is generated between the movable contactor 430 and the first yoke 491 (see FIG. 14). That is, when the movable contactor 430 is in the closed position, the first yoke 491 is separated from the movable contactor 430 by the gap LI in the vertical direction. Thus, electrical insulation between the movable contactor 430 and the first yoke 491 is ensured.

The second yoke 492 is a ferromagnetic body, and is formed of, for example, a metal material such as iron. The second yoke 492 is fixed to the lower surface of the movable contactor 430 (see FIG. 10). Therefore, in this embodiment, the second yoke 492 moves in the vertical direction as the movable contactor 430 moves in the vertical direction. An insulating layer 495 having electrical insulation may be formed on the upper surface of the second yoke 492 (in particular, the portion in contact with the movable contactor 430) (see FIG. 14). In this way, electrical insulation between the movable contactor 430 and the second yoke 492 can be ensured. In FIGS. 10, 11, 13A, 13B, 40B, 41B, and the like, the illustration of the insulating layer 495 is omitted as appropriate.

In this embodiment, the second yoke 492 has a through-hole 492*a* in its central portion, and the through-hole 492*a* is formed at a position corresponding to the through-hole 430*a* in the movable contactor 430. The through-hole 492*a* penetrates the second yoke 492 in the thickness direction (vertical direction). The through-hole 492*a* is a hole for inserting the shaft 380 and a contact pressure spring 401 to be described later.

Figure 11:
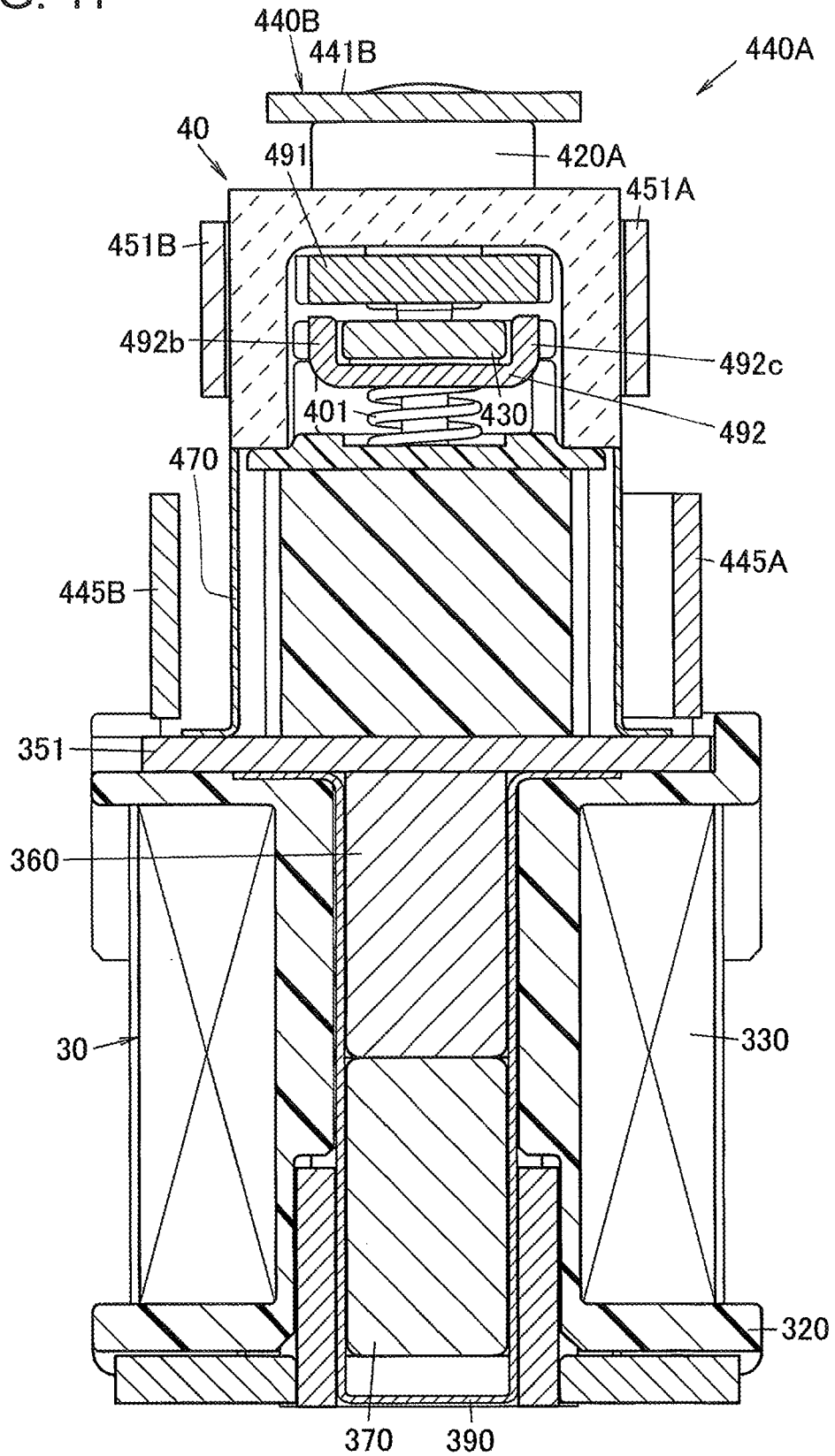
FIG. 11 is a cross-sectional view taken along the line X2-X2 in FIG. 9.

The second yoke 492 has a pair of protrusions 492*b* and 492*c* protruding upward at both end portions in the front-rear direction (see FIG. 11). In other words, the protrusions 492*b* and 492*c* protruding in the same direction as the direction in which the movable contactor 430 moves from the open position to the closed position (upward in this embodiment) are formed at the both end portions in the front-rear direction on the upper surface of the second yoke 492.

Figure 13B:
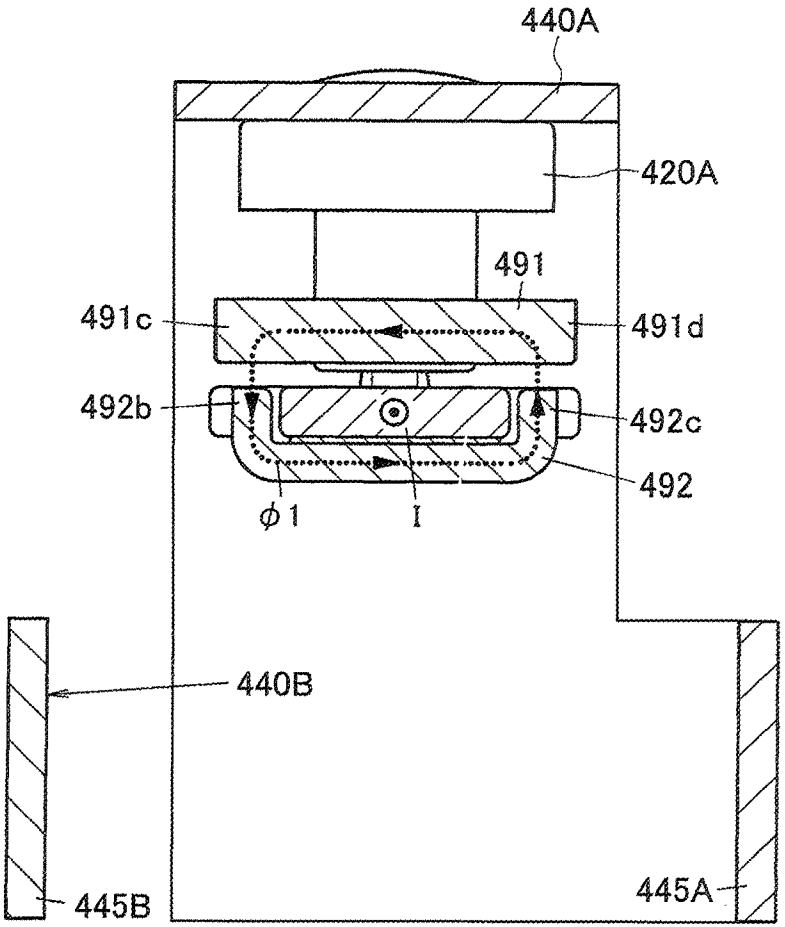
FIG. 13B is a diagram for explaining a first yoke and a second yoke attracting each other, which are included in the contact device according to the second embodiment.

With such a shape, as shown in FIG. 13B, the front end surface (upper end surface) of the front protrusion 492*b* of the pair of protrusions 492*b* and 492*c* abuts on the front end portion 491*c* of the first yoke 491, while the front end surface (upper end surface) of the rear protrusion 492*c* abuts on the rear end portion 491*d* of the first yoke 491. Therefore, when a current I flows through the movable contactor 430 in the direction illustrated in FIG. 13B, a magnetic flux φ1 passing through a magnetic path formed by the first yoke 491 and the second yoke 492 is generated. In this event, the front end portion 491*c* of the first yoke 491 and the front end surface of the protrusion 492*c* have the N-pole, while the rear end portion 491*d* of the first yoke 491 and the front end surface of the protrusion 492*b* have the S-pole. Thus, an attracting force acts between the first and second yokes 491 and 492.

The capsule yokes 451A and 451B are ferromagnetic bodies and are formed of, for example, a metal material such as iron. The capsule yokes 451A and 451B hold arc-extinguishing magnets 452A and 452B. In this embodiment, the capsule yokes 451A and 451B are disposed on both sides, in the front-rear direction, of the housing 410 so as to surround the housing 410 from both sides in the front-rear direction (see FIG. 15). In FIG. 5, the illustration of the busbars 440A and 440B is omitted.

The arc-extinguishing magnets 452A and 452B are disposed on both sides, in the right-left direction, of the housing 410, and are disposed such that different poles are opposed to each other in the right-left direction. The capsule yokes 451A and 451B surround the housing 410 together with the arc-extinguishing magnets 452A and 452B. In other words, the arc-extinguishing magnets 452A and 452B are sandwiched between both end faces in the right-left direction of the housing 410 and the capsule yokes 451A and 451B. One (left) arc-extinguishing magnet 452A has one surface (left end surface) in the right-left direction coupled with one end of the capsule yokes 451A and 451B, and has the other surface (right end surface) in the right-left direction coupled with the housing 410. The other (right) arc-extinguishing magnet 452B has one surface (right end surface) in the right-left direction coupled with the other end of the capsule yokes 451A and 451B, and has the other surface (left end surface) in the right-left direction coupled with the housing 410. Note that, although the arc-extinguishing magnets 452A and 452B are illustrated as being disposed so that the different poles are opposed to each other in the right-left direction in this embodiment, the same poles may be disposed so as to be opposed to each other.

In this embodiment, when the position of the movable contactor 430 is the closed position, contact points with the pair of movable contacts 431A and 431B at the pair of fixed contacts 421*a*A and 421*a*B are located between the arc-extinguishing magnets 452A and 452B (see FIG. 10). That is, the contact points with the pair of movable contacts 431A and 431B at the pair of fixed contacts 421*a*A and 421*a*B are included in the magnetic field generated between the arc-extinguishing magnets 452A and 452B.

With the configuration described above, as shown in FIG. 15, the capsule yoke 451A forms a part of a magnetic circuit through which a magnetic flux φ2 generated by the pair of arc-extinguishing magnets 452A and 452B passes. Likewise, the capsule yoke 451B forms a part of a magnetic circuit through which the magnetic flux φ2 generated by the pair of arc-extinguishing magnets 452A and 452B passes. These magnetic fluxes φ2 act on the contact points with the pair of movable contacts 431A and 431B at the pair of fixed contacts 421*a*A and 421*a*B when the movable contactor 430 is located in the closed position.

Figure 15:
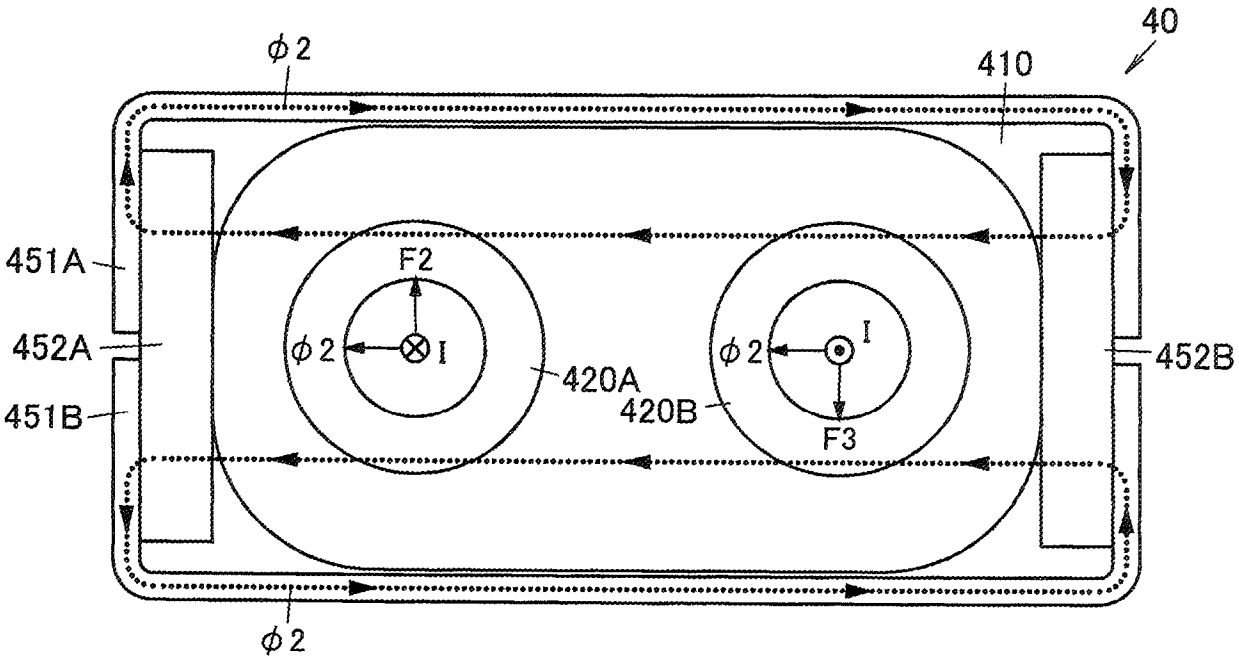
FIG. 15 is a diagram for explaining pulling of an arc generated in the contact device according to the second embodiment.

In the example of FIG. 15, it is assumed that, in the internal space of the housing 410, a leftward magnetic flux φ2 is generated, a downward current I flows to the first fixed terminal 420A, and an upward current I flows to the second fixed terminal 420B. In this state, when the movable contactor 430 moves from the closed position to the open position, a downward discharge current (arc) is generated from the first fixed contact 421*a*A to the first movable contact 431A between the first fixed contact 421*a*A and the first movable contact 431A. Therefore, a backward Lorentz force F2 acts on the arc due to the magnetic flux φ2 (see FIG. 15). That is, the arc generated between the first fixed contact 421*a*A and the first movable contact 431A is pulled rearward to be extinguished. On the other hand, an upward discharge current (arc) is generated from the second movable contact 431B to the second fixed contact 421*a*B between the second fixed contact 421*a*B and the second movable contact 431B. Therefore, a forward Lorentz force F3 acts on the arc due to the magnetic flux φ2 (see FIG. 15). That is, the arc generated between the second fixed contact 421*a*B and the second movable contact 431B is pulled forward to be extinguished.

The housing 410 can be formed using, for example, ceramic such as aluminum oxide (alumina). The housing 410 is formed in a hollow rectangular parallelepiped shape (see FIG. 10) longer in the right-left direction than in the front-rear direction, and the lower surface of the housing 410 is open. The pair of fixed contacts 421*a*A and 421*a*B, the movable contactor 430, and the first and second yokes 491 and 492 are accommodated in the housing 410. On the top surface of the housing 410, a pair of opening holes are formed for inserting the pair of fixed terminals 420A and 420B. The pair of opening holes is formed in a circular shape, and penetrates the upper wall of the housing 410 in the thickness direction (vertical direction). The first fixed terminal 420A is inserted into one opening hole, while the second fixed terminal 420B is inserted into the other opening hole. The pair of fixed terminals 420A and 420B and the housing 410 are connected by brazing. In this way, the upper wall of the housing 410 serves as a partition member in this embodiment.

The housing 410 may be formed in a box shape for accommodating the pair of fixed contacts 421*a*A and 421*a*B and the movable contactor 430, and is not limited to the hollow rectangular parallelepiped shape as in this embodiment, but may be a hollow oval cylinder or a hollow polygonal column. That is, the box shape here means any shape in general that has a space for accommodating the pair of fixed contacts 421*a*A and 421*a*B and the movable contactor 430 inside, and is not limited to the rectangular parallelepiped shape.

The housing 410 is not limited to ceramic, but may be made of, for example, an insulating material such as glass or resin, or may be made of metal.

The housing 410 is preferably a non-magnetic material that does not become magnetic due to magnetism. When the housing 410 is formed of a non-magnetic material, the housing 410 includes a non-magnetic portion 410*a* formed of a non-magnetic material from one end to the other end in the thickness direction of the housing 410. The non-magnetic portion 410*a* may be formed in at least a part of a portion overlapping with a region where the electric path pieces 445A and 445B to be described later of the housing 410 and the movable contactor 430 located in the closed position are opposed to each other. For example, in the state shown in FIG. 11, with the electric path piece 445A, as viewed obliquely from below; overlapping with the movable contactor 430, a portion of the housing 410 overlapping with the electric path piece 445A and the movable contactor 430 may serve as the non-magnetic portion 410*a*.

The non-magnetic portion 410*a* may be formed in at least a part of a portion overlapping with a region where extension portions 443A and 443B to be described later of the housing 410 and the movable contactor 430 located in the closed position are opposed to each other.

The flange 470 is formed of a non-magnetic metal material. Examples of the non-magnetic metal material include austenitic stainless steel such as SUS304. The flange 470 is formed in a hollow rectangular parallelepiped shape that is long in the right-left direction, and has its upper and lower surfaces open. The flange 470 is disposed between the housing 410 and the electromagnetic device 30 (sec FIGS. 10 and 11). In this embodiment, the flange 470 is airtightly joined to the housing 410 and a yoke upper plate 351 of the electromagnetic device 30 to be described later. In this way, the internal space of the contact device 40 surrounded by the housing 410, the flange 470, and the yoke upper plate 351 can be made airtight. The flange 470 does not have to be formed of such a non-magnetic metal material, but may be formed of an iron-based alloy such as 42 alloy, for example.

The insulating plate 480 is made of synthetic resin, has electrical insulation, and is formed in a rectangular plate shape. The insulating plate 480 is located below the movable contactor 430 and electrically insulates between the movable contactor 430 and the electromagnetic device 30.

In this embodiment, the insulating plate 480 has a through-hole 480*a* in its central portion. In this embodiment, the through-hole 480*a* is formed in a position corresponding to the through-hole 430*a* in the movable contactor 430. The through-hole 480*a* penetrates the insulating plate 480 in the thickness direction (vertical direction), and is a hole for inserting the shaft 380.

The spacer 481 is formed in a cylindrical shape, and can be formed using, for example, synthetic resin. In this embodiment, the spacer 481 is disposed between the electromagnetic device 30 and the insulating plate 480, and has its upper end coupled to the lower surface of the insulating plate 480 and its lower end coupled to the electromagnetic device 30. The insulating plate 480 is supported by the spacer 481. The shaft 380 is inserted into the hole of the spacer 481.

The first and second busbars 440A and 440B are made of a conductive metal material. The busbars 440A and 440B are made of, for example, copper or copper alloy, and are formed in a band plate shape. In this embodiment, the busbars 440A and 440B are formed by bending a metal plate. One end in the longitudinal direction of the first busbar 440A is electrically connected, for example, to the first fixed terminal 420A of the contact device 40. Meanwhile, the other end in the longitudinal direction of the first busbar 440A is electrically connected, for example, to the battery for traveling. On the other hand, one end in the longitudinal direction of the second busbar 440B is electrically connected, for example, to the second fixed terminal 420B of the contact device 40. Meanwhile, the other end in the longitudinal direction of the second busbar 440B is electrically connected, for example, to a load.

Furthermore, in this embodiment, the first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has an approximately square shape in plan view, and is caulked and coupled to the first fixed terminal 420A at a caulking portion 423A of the first fixed terminal 420A. The fast extension portion 443A is connected to the first fixed portion 441A, and is disposed to the left of the housing 410 so as to extend downward from the left end portion of the first fixed portion 441A. Thus, in this embodiment, the first extension portion 443A overlaps with the first fixed terminal 420A to which the first fixed portion 441A having the first extension portion 443A connected thereto is fixed, as viewed from one side in the main current direction (right-left direction) of the current flowing through the movable contactor 430.

The first electric path piece (first electric path portion) 445A is connected to the first extension portion 443A, and is disposed behind the housing 410 so as to extend from the lower end of the extension portion 443A to the right (second fixed terminal 420B side when viewed from the first fixed terminal 420A). The first electric path piece 445A is disposed such that the thickness direction (front-rear direction) perpendicular to the moving direction (vertical direction) of the movable contactor 430 (see FIGS. 9 and 11).

In this embodiment, the first extension portion 443A has a first opposed portion 444A opposed to at least one of the first fixed terminal 420A and the movable contactor 430, below (one end side) the upper wall (partition member) in the vertical direction (longitudinal direction) of the first fixed terminal 420A. The first opposed portion 444A extends in the longitudinal direction of the first fixed terminal 420A.

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has an approximately square shape in plan view, and is caulked and coupled to the second fixed terminal 420B at a caulking portion 423B of the second fixed terminal 420B. The second extension portion 443B is connected to the second fixed portion 441B, and is disposed to the right of the housing 410 so as to extend downward from the right end of the second fixed portion 441B. Thus, in this embodiment, the second extension portion 443B overlaps with the second fixed terminal 420B to which the second fixed portion 441B having the second extension portion 443B connected thereto is fixed, as viewed from one side in the main current direction (right-left direction) of the current flowing through the movable contactor 430.

The movable contactor 430 is disposed between the first and second electric path pieces 445A and 445B when viewed from one side of the moving direction (vertical direction) of the movable contactor 430.

The second electric path piece (second electric path portion) 445B is connected to the second extension portion 443B, and is disposed in front of the housing 410 so as to extend from the lower end portion of the second extension portion 443B to the left (first fixed terminal 420A side as viewed from the second fixed terminal 420B). The second electric path piece 445B is disposed such that the thickness direction (front-rear direction) is perpendicular to the moving direction (vertical direction) of the movable contactor 430 (see FIGS. 9 and 11).

In this embodiment, the second extension portion 443B has a second opposed portion 444B opposed to at least one of the second fixed terminal 420B and the movable contactor 430, below (one end side) the upper wall (partition member) in the vertical direction (longitudinal direction) of the second fixed terminal 420B. The second opposed portion 444B extends in the longitudinal direction of the second fixed terminal 420B.

Here, the busbars 440A and 440B have rigidity. Therefore, the busbars 440A and 440B have their one ends (fixed portions 441A and 441B) in the longitudinal direction mechanically connected to the fixed terminals 420A and 420B, resulting in a state where the busbars 440A and 440B are entirely supported by the fixed terminals 420A and 420B. Accordingly, the other end portions (electric path pieces 445A and 445B) in the longitudinal direction of the busbars 440A and 440B are self-supporting. Therefore, the busbars 440A and 440B have a structure integrated with the fixed terminals 420A and 420B.

Figure 16A:
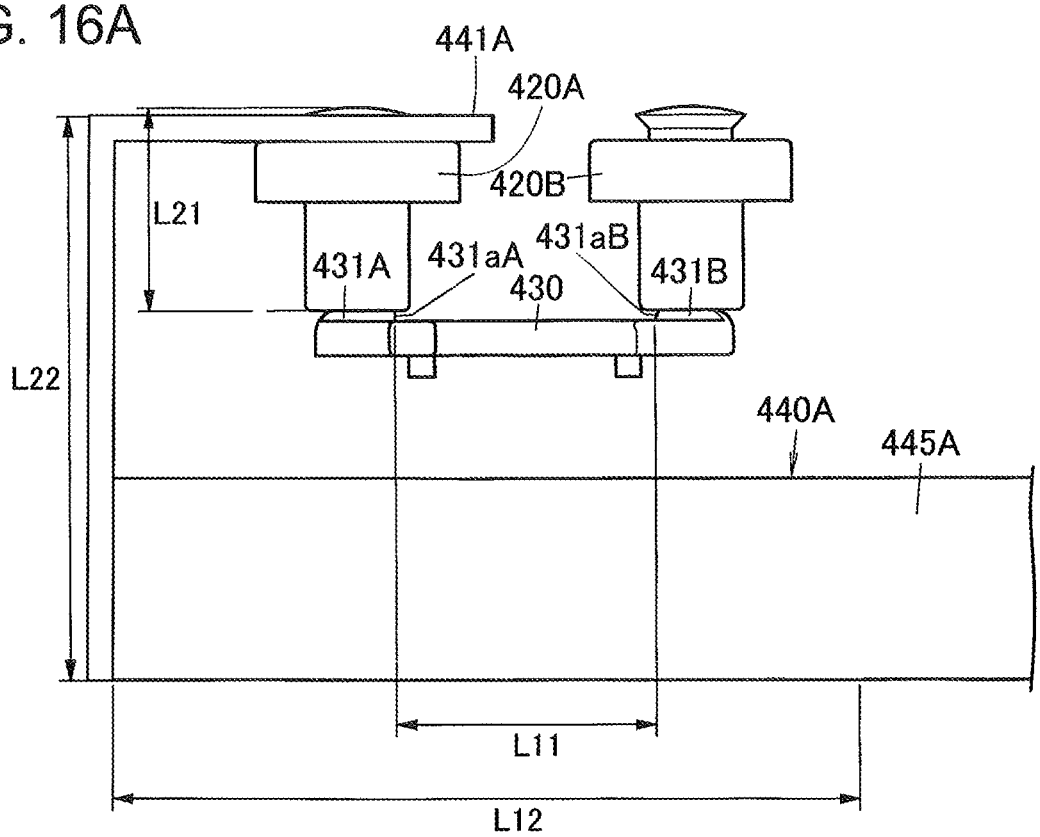
Figure 16B:
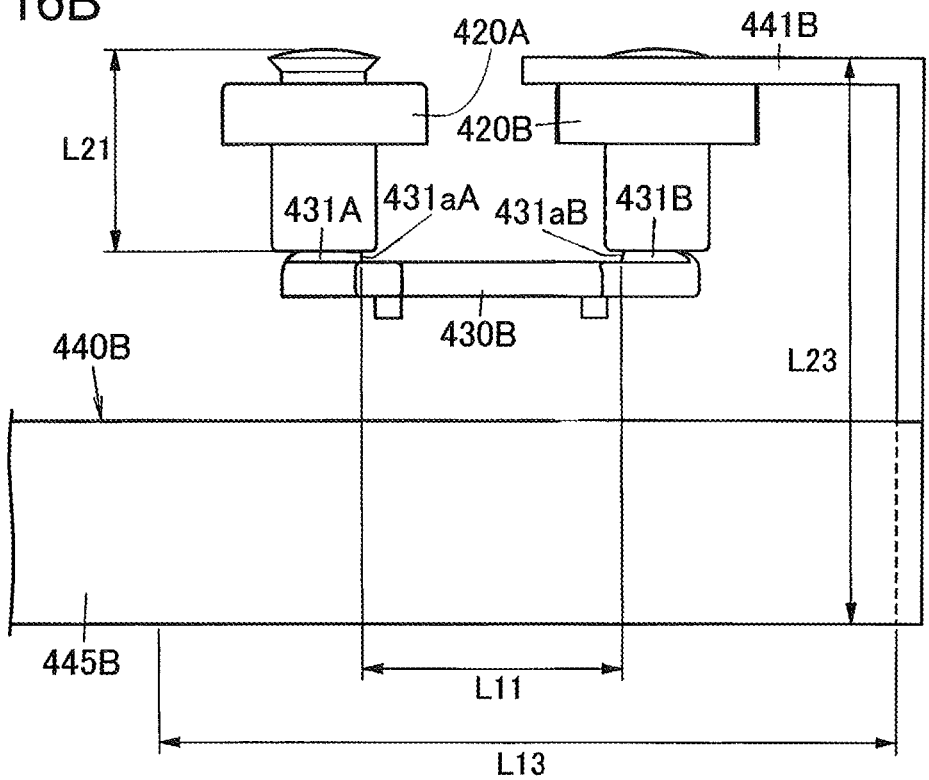
FIG. 16B is a diagram for explaining a length of a second electrical path portion connected to the second conductive member according to the second embodiment.
Figure 17:
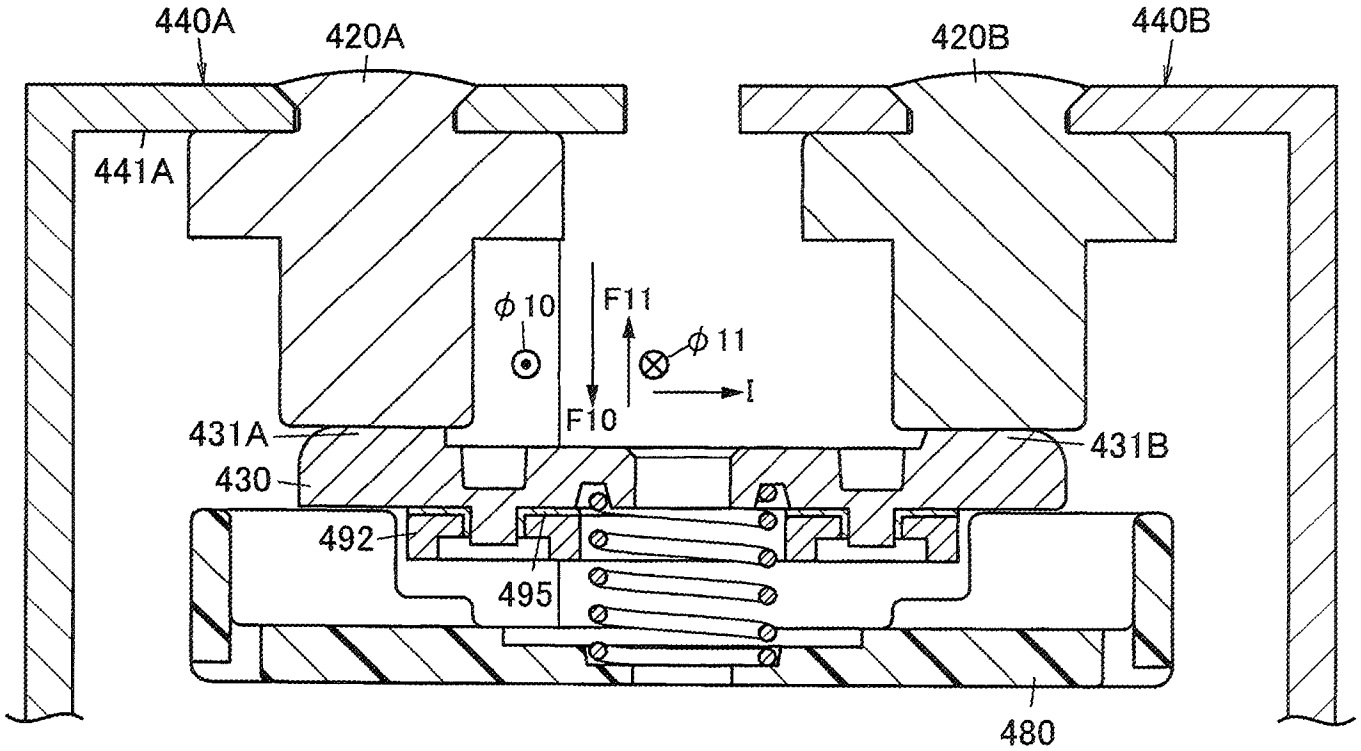
FIG. 17 is a diagram for explaining a Lorentz force generated due to a relationship between a magnetic flux generated by a current flowing through the fixed terminal and a current flowing through the movable contactor in the contact device according to the second embodiment, and for explaining a Lorentz force generated due to a relationship between a magnetic flux generated by a current flowing through the electrical path portion opposed to the fixed terminal and a current flowing through the movable contactor.

A length L22 of the first extension portion 443A and a length L23 of the second extension portion 443B are equal to or greater than a length L21 of the fixed terminals 420A and 420B in the vertical direction (see FIGS. 16A and 16B). In FIGS. 16A and 16B, the length L21 is the dimension from the upper end edge of the fixed terminal 420A (or 420B) to the lower end edge (including the fixed contact 421*a*A (or 421*a*B) of the fixed terminal 420A (or 420B). However, the length L21 to be in the above dimensional relationship with the lengths L22 and L23 is at least the length from the connection portion with the busbar 440A (440B) in the fixed terminal 420A (420B) to the retention portion of the fixed contact 421*a*A (421*a*B) in the fixed terminal 420A (420B).

Here, when the movable contactor 430 is located in the closed position, the movable contactor 430 is positioned between the electric path pieces 445A and 445B and the fixed contacts 421*a*A and 421*a*B as viewed from one side of the front-rear direction. The electric path pieces 445A and 445B are disposed substantially in parallel with the movable contactor 430 on the outside of the housing 410 so as to have such a positional relationship (see FIGS. 10 and 11). In other words, when the movable contactor 430 is located in the closed position, the movable contactor 430 is positioned between the electric path pieces 445A and 445B and the fixed contacts 421*a*A and 421*a*B in the moving direction (vertical direction) of the movable contactor 430.

Figure 13A:
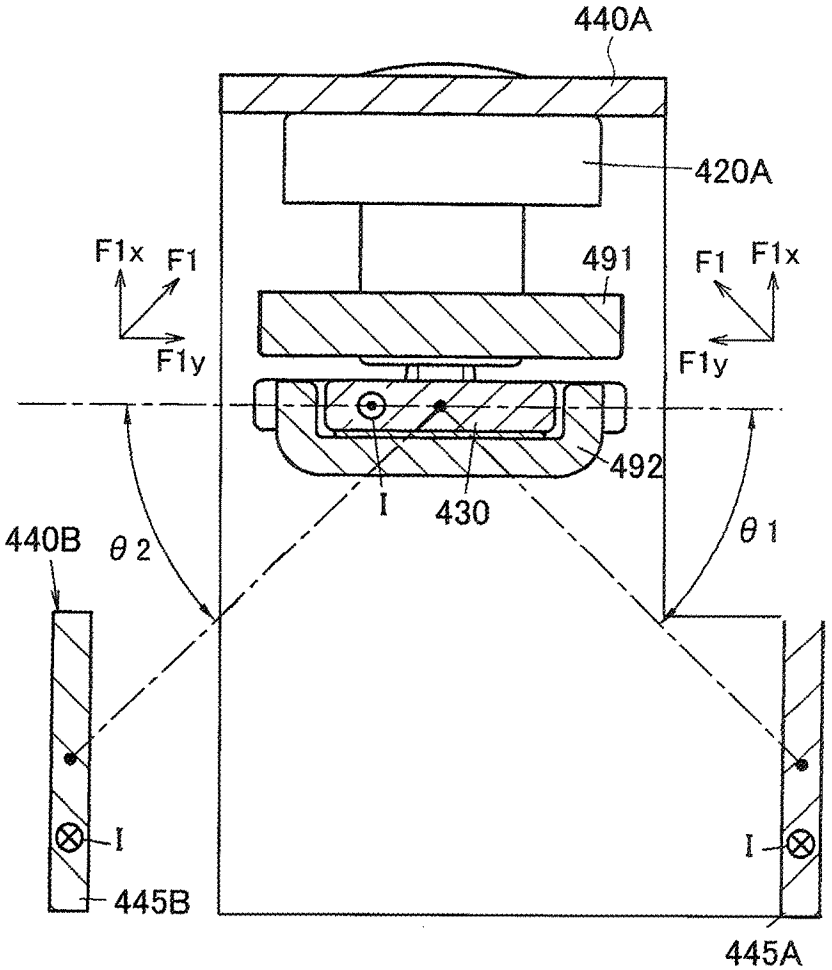

In this embodiment, as shown in FIG. 13A, in the cross-section perpendicular to the right-left direction, an angle θ1 between a straight line connecting the center point of the electric path piece 445A and the center point of the movable contactor 430 and a straight line along the front-rear direction is 45 degrees. Likewise, in the cross-section perpendicular to the right-left direction, an angle θ2 between a straight line connecting the center point of the electric path piece 445B and the center point of the movable contactor 430 and a straight line along the front-rear direction is identical to the angle θ1 (here, 45 degrees). Here, the term "identical" includes not only perfect matching but also cases where an error of about several degrees is within an allowable range. Moreover, the above value (45 degrees) is an example, and the angle is not limited to this value. In FIG. 13A, the current I is indicated at a position shifted from the central point of the cross-section of the movable contactor 430 so that the central point of the cross-section of the movable contactor 430 does not overlap with the notation of the current I. This, however, is not intended to specify the position where the current I actually flows. The same goes for the notation of the current I flowing through the electric path pieces 445A and 445B.

The electric path pieces 445A and 445B are disposed between the yoke upper plate 351 of the yoke 350 to be described later and the movable contactor 430 in the closed position.

A length L12 of the first electric path piece 445A and a length L13 of the second electric path piece 445B are each equal to or greater than a distance L11 between the movable contacts 431A and 431B (see FIGS. 16A and 16B). Here, the distance L11 between the movable contacts 431A and 431B is the shortest distance between the first and second movable contacts 431A and 431B (distance from the inner end 431*a*A of the first movable contact 431A to the inner end 431*a*B of the second movable contact 431B).

In this embodiment, the first electric path piece 445A extends (protrudes) to the right from the first extension portion 443A, while the second electric path piece 445B extends (protrudes) to the left from the second extension portion 443B.

Here, it is assumed that the current I flows through the movable contactor 430 from the first fixed terminal 420A toward the second fixed terminal. 420B. In this event, the current I flows through the first electric path piece 445A, the first extension portion 443A, the first fixed portion 441A, the first fixed terminal 420A, the movable contactor 430, the second fixed terminal 420B, the second fixed portion 441B, the second extension portion 443B, and the second electric path piece 445B in this order (see FIG. 12). In the electric path pieces 445A and 445B, the current I flows to the left (the first fixed terminal 420A side as viewed from the second fixed terminal 420B). Meanwhile, in the movable contactor 430, the current I flows to the right (the second fixed terminal 420B side as viewed from the first fixed terminal 420A). On the other hand, when the current I flows through the movable contactor 430 from the second fixed terminal 420B toward the first fixed terminal 420A, the current I flows to the right in the electric path pieces 445A and 445B, while the current I flows to the left in the movable contactor 430.

That is, the electric path pieces 445A and 445B extend (protrude) in opposite directions from the extension portions 443A and 443B. Therefore, the direction of the current I flowing through the electric path pieces 445A and 445B is opposite to the direction of the current I flowing through the movable contactor 430.

Furthermore, the direction of the current I flowing through the first extension portion 443A is opposite to that of the current I flowing through the first fixed terminal 420A. Likewise, the direction of the current I flowing through the second extension portion 443B is opposite to that of the current I flowing through the second fixed terminal 420B. To be more specific, assuming that the current I flows from the first fixed terminal 420A to the second fixed terminal 420B, the current I flows upward in the first extension portion 443A, while the current I flows downward in the first fixed terminal 420A. On the other hand, the current I flows downward in the second extension portion 443B, while the current I flows upward in the second fixed terminal 420B.

As shown in FIG. 9, the electric path pieces 445A and 445B and the arc-extinguishing magnets 452A and 452B are arranged in the order of the arc-extinguishing magnets 452A and 452B and the electric path pieces 445A and 445B from above in the moving direction (vertical direction) of the movable contactor 430. In other words, the electric path pieces 445A and 445B are positioned below the arc-extinguishing magnets 452A and 452B in the vertical direction.

(1.3) Electromagnetic Device

Next, the configuration of the electromagnetic device 30 will be described.

The electromagnetic device 30 is disposed below the movable contactor 430. As shown in FIGS. 9 and 10, the electromagnetic device 30 includes a stator 360, a movable element 370, and an exciting coil 330. The electromagnetic device 30 attracts the movable element 370 to the stator 360 by a magnetic field generated by the exciting coil 330 when the current is applied to the exciting coil 330, thereby moving the movable element 370 upward.

Here, the electromagnetic device 30 includes the yoke 350 including the yoke upper plate 351, the shaft 380, a plunger cap (cylindrical body) 390, a contact pressure spring 401, a return spring 302, and a coil bobbin 320 in addition to the stator 360, the movable element 370, and the exciting coil 330.

The stator 360 is a fixed iron core formed in a cylindrical shape that protrudes downward from the lower surface central portion of the yoke upper plate 351. This stator 360 has its upper end fixed to the yoke upper plate 351.

The movable element 370 is a movable iron core formed in a cylindrical shape. The movable element 370 is disposed below the stator 360 so that the upper end face thereof is opposed to the lower end face of the stator 360. The movable element 370 is configured to be movable in the vertical direction. The movable element 370 moves between an exciting position (see FIGS. 10 and 11) at which the upper end face comes into contact with the lower end face of the stator 360 and a non-exciting position at which the upper end face is separated from the lower end face of the stator 360.

The exciting coil 330 is disposed below the housing 410 in a direction where the central axis direction coincides with the vertical direction. The stator 360 and the movable element 370 are disposed inside the exciting coil 330. The exciting coil 330 is electrically insulated from the busbars 440A and 440B.

The yoke 350 is disposed so as to surround the exciting coil 330, and forms a magnetic circuit through which a magnetic flux generated when the current is applied to the exciting coil 330 passes, along with the stator 360 and the movable element 370. Therefore, the yoke 350, the stator 360, and the movable element 370 are all formed of a magnetic material (ferromagnetic material). The yoke upper plate 351 constitutes a part of the yoke 350. In other words, at least a part of the yoke 350 (the yoke upper plate 351) is located between the exciting coil 330 and the movable contactor 430.

The contact pressure spring 401 is disposed between the lower surface of the movable contactor 430 and the upper surface of the insulating plate 480. The contact pressure spring 401 is a coil spring that biases the movable contactor 430 upward (see FIG. 10).

The return spring 302 is at least partially disposed inside the stator 360. The return spring 302 is a coil spring that biases the movable element 370 downward (to the non-exciting position). In this embodiment, the return spring 302 has its one end connected to the upper end face of the movable element 370 and the other end connected to the yoke upper plate 351 (see FIG. 10).

The shaft 380 is made of a non-magnetic material, and is formed in a vertically extending round rod shape. The shaft 380 transmits a driving force generated by the electromagnetic device 30 to the contact device 40 provided above the electromagnetic device 30. In this embodiment, the shaft 380 passes through the through-hole 430*a*, a through-hole 492*a*, the inside of the contact pressure spring 401, the through-hole 480*a*, the through-hole formed in the central portion of the yoke upper plate 351, the inside of the stator 360, and the inside of the return spring 302, and has its lower end fixed to the movable element 370. The first yoke 491 is fixed to the upper end of the shaft 380.

The coil bobbin 320 is made of synthetic resin, and the exciting coil 330 is wound around the coil bobbin 320.

The cylindrical body 390 is formed in a bottomed cylindrical shape with its upper surface open, and the upper end portion (opening peripheral portion) of the cylindrical body 390 is connected to the lower surface of the yoke upper plate 351. Thus, the cylindrical body 390 restricts the moving direction of the movable element 370 in the vertical direction, and defines the non-exciting position of the movable element 370. The cylindrical body 390 is airtightly joined to the lower surface of the yoke upper plate 351. Thereby, even if a through-hole is formed in the yoke upper plate 351, the airtightness of the internal space of the contact device 40 surrounded by the housing 410, the flange 470, and the yoke upper plate 351 can be ensured.

With such a configuration, the movable contactor 430 moves in the vertical direction as the movable element 370 moves in the vertical direction by the driving force generated by the electromagnetic device 30.

(2) OPERATIONS

Next, brief description is given of operations of the electromagnetic relay 1 including the contact device 40 and the electromagnetic device 30 having the configuration described above.

When no current is applied to the exciting coil 330 (when no current applied), no magnetic attractive force is generated between the movable element 370 and the stator 360. Therefore, the movable element 370 is located at the non-exciting position by the spring force of the return spring 302. In this event, the shaft 380 is pulled downward. Upward movement of the movable contactor 430 is restricted by the shaft 380. As a result, the movable contactor 430 is located in the open position which is the lower end position in the movable range. Therefore, the pair of movable contacts 431A and 431B are separated from the pair of fixed contacts 421*a*A and 421*a*B, resulting in the open state of the contact device 40. In this state, no electrical connection is achieved between the pair of fixed terminals 420A and 420B.

On the other hand, when the current is applied to the exciting coil 330, a magnetic attractive force is generated between the movable element 370 and the stator 360. Thus, the movable element 370 is drawn upward against the spring force of the return spring 302, and moves to the exciting position. In this event, since the shaft 380 is pushed upward, restriction on the upward movement of the movable contactor 430 by the shaft 380 is lifted. Then, as the contact pressure spring 401 biases the movable contactor 430 upward, the movable contactor 430 moves to the closed position that is the upper end position in the movable range. Therefore, the pair of movable contacts 431A and 431B comes into contact with the pair of fixed contacts 421*a*A and 421*a*B, resulting in the closed state of the contact device 40. In this state, since the contact device 40 is in the closed state, electrical connection is achieved between the pair of fixed terminals 420A and 420B.

As described above, the electromagnetic device 30 controls the attractive force acting on the movable element 370 by switching the state where the current is applied to the exciting coil 330, and moves the movable element 370 in the vertical direction to generate a driving force for switching between the open and closed states of the contact device 40.

(3) ADVANTAGES

Here, description is given of advantages of having the busbars 440A and 440B described above and of having the first and second yokes 491 and 492.

When the current is applied to the exciting coil 330, the movable element 370 moves from the non-exciting position to the exciting position in the electromagnetic device 30 as described above. In this event, the driving force generated by the electromagnetic device 30 moves the movable contactor 430 upward from the open position to the closed position. As a result, the movable contacts 431A and 431B come into contact with the fixed contacts 421*a*A and 421*a*B to set the contact device 40 in the closed state. When the contact device 40 is in the closed state, the movable contacts 431A and 431B are pressed against the fixed contacts 421*a*A and 421*a*B by the contact pressure spring 401.

When the contact device 40 is in the closed state, the current flowing through the contact device 40 (between the fixed terminals 420A and 420B) may generate an electromagnetic repulsion force which pulls the movable contacts 431A and 431B away from the fixed contacts 421*a*A and 421*a*B. That is, when a current flows through the contact device 40, a Lorentz force may cause a (downward) electromagnetic repulsion force to act on the movable contactor 430 to move the movable contactor 430 from the closed position to the open position. Since the electromagnetic repulsion force is usually smaller than the spring force of the contact pressure spring 401, the movable contactor 430 maintains the movable contacts 431A and 431B in contact with the fixed contacts 421*a*A and 421*a*B. However, when a very large current (abnormal current) such as a short-circuit current, for example, flows through the contact device 40, the electromagnetic repulsion force acting on the movable contactor 430 may exceed the spring force of the contact pressure spring 401. In this embodiment, the current flowing through the busbars 440A and 440B is first used as a measure against such electromagnetic repulsion force.

That is, in the contact device 40 according to this embodiment, the busbars 440A and 440B have electric path pieces (backward electric path portions) 445A and 445B in which the current I flows in the opposite direction to the direction in which the current I flows through the movable contactor 430. Therefore, when an abnormal current such as a short-circuit current, for example, flows through the contact device 40, a repulsion force F1 is generated between the electric path piece 445A and the movable contactor 430 and between the electric path piece 445B and the movable contactor 430 (see FIG. 13A). The "repulsion force F1" referred to in the present disclosure is a force in the direction away from each other among the forces acting between the movable contactor 430 and the electric path pieces 445A and 445B. Such a repulsion force F1 is a force received by the current I flowing through the movable contactor 430 and the electric path pieces 445A and 445B by the Lorentz force.

In this embodiment, when the movable contactor 430 is in the closed position, the movable contactor 430 is located between the electric path pieces 445A and 445B and the fixed terminals 420A and 420B in the moving direction (vertical direction) of the movable contactor 430. The electric path pieces 445A and 445B are fixed to the fixed terminals 420A and 420B, respectively, and thus do not move relative to the housing 410. On the other hand, the movable contactor 430 is movable in the vertical direction with respect to the housing 410. Therefore, a force component F1*x* in the vertical direction, rather than a three component F1*y* in the front-rear direction, of the repulsion force F1 is applied to the movable contactor 430 (see FIG. 13A). As a result, the force pushing up the movable contactor 430, that is, the force pressing the movable contacts 431A and 431B against the fixed contacts 421*a*A and 421*a*B is increased.

Therefore, even when an abnormal current such as a short-circuit current, for example, flows through the contact device 40, the connection between the movable contacts 431A and 431B and the fixed contacts 421*a*A and 421*a*B can be stabilized.

Figure 12:
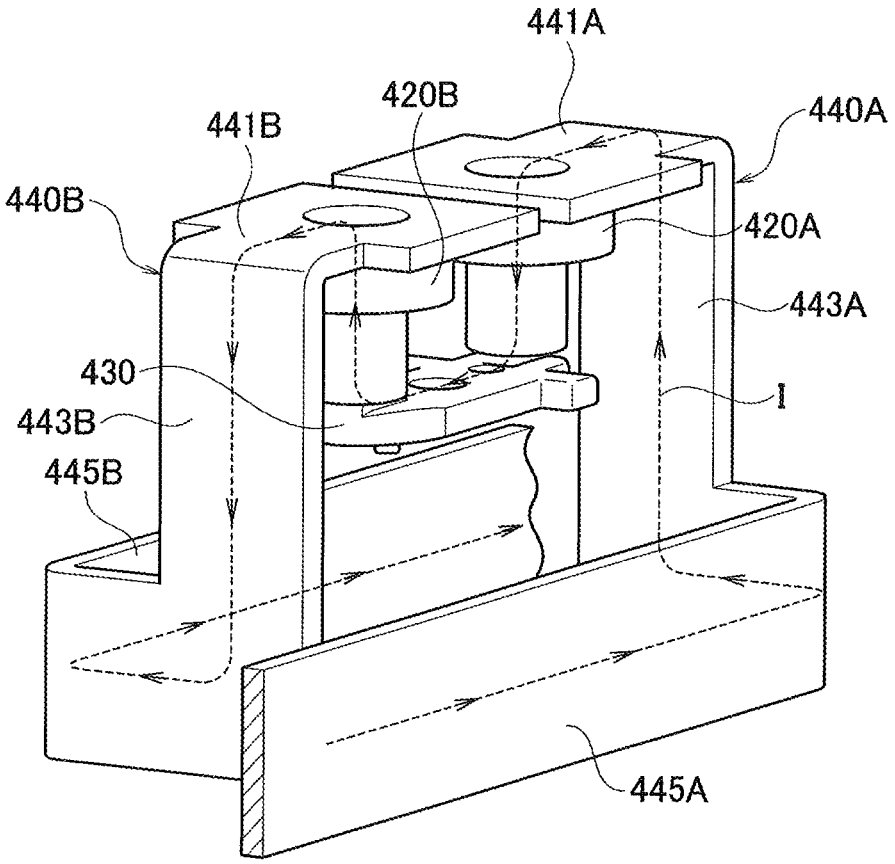
FIG. 12 is a diagram for explaining a current flow in a contact device included in the electromagnetic relay according to the second embodiment.

In the contact device 40 according to this embodiment, the busbars 440A and 440B have the extension portions 443A and 443B in which the current I flows in the direction opposite to the direction in which the current I flows through the fixed terminals 420A and 420B. Here, as shown in FIG. 12, it is assumed that the current I flows from the fixed terminal 420A toward the fixed terminal 420B. In this case, the current I flowing downward in the fixed terminal 420A generates a clockwise magnetic flux φ10 (see FIG. 17) in top view (as viewed from above) around the fixed terminal 420A. On the other hand, the current I flowing upward in the first extension portion 443A generates a counterclockwise magnetic flux φ11 (see FIG. 17) in top view (as viewed from above) around the first extension portion 443A.

In this event, a downward Lorentz force F10 acts on the movable contactor 430 based on the relationship between the rightward current I flowing through the movable contactor 430 and the magnetic flux φ10. Furthermore, an upward Lorentz force F11 acts on the movable contactor 430 based on the relationship between the rightward current I flowing through the movable contactor 430 and the magnetic flux φ11. That is, the contact device 40 can generate the upward Lorentz force F11 by providing the first extension portion 443A. Thus, at least a part of the downward Lorentz force F10 is offset (cancelled), so that the force moving the movable contactor 430 downward can be reduced.

Likewise, based on the relationship between the magnetic flux generated by the current I flowing through the fixed terminal 420B and the magnetic flux generated by the current I flowing through the second extension portion 443B, at least a portion of the downward Lorentz three acting on the movable contactor 430 is offset (cancelled). That is, the force moving the movable contactor 430 downward can be reduced by the second extension portion 443B.

Therefore, even when an abnormal current such as a short-circuit current, for example, flows through the contact device 40, the connection between the movable contacts 431A and 431B and the fixed contacts 421*a*A and 421*a*B can be stabilized.

In this embodiment, the thickness direction (front-rear direction) of the electric path pieces 445A and 445B is perpendicular to the moving direction (vertical direction) of the movable contactor 430. As a result, in the cross-section perpendicular to the longitudinal direction of the electric path pieces 445A and 445B, the distance between the central point of the electric path piece 445A (or 445B) and the central point of the movable contactor 430 can be relatively shortened (see FIG. 13A). As a comparative example, when the thickness direction of the electric path piece is parallel to the moving direction of the movable contactor 430, the distance between the central point of the electric path piece and the central point of the movable contactor 430 in the cross-section perpendicular to the longitudinal direction of the electric path piece is longer than the distance described above in this embodiment. Therefore, in the contact device 40 according to this embodiment, a repulsion force F1 larger than the repulsion force generated between the electric path piece of the comparative example and the movable contactor 430 can be generated between the electric path pieces 445A and 445B and the movable contactor 430.

As a result, compared with the comparative example, further stabilization of the connection between the movable contacts 431A and 431B and the fixed contacts 421*a*A and 421*a*B can be achieved when an abnormal current such as a short-circuit current, for example, flows through the contact device 40.

Furthermore, in this embodiment, the first yoke 491 and the second yoke 492 also serve as measures against the electromagnetic repulsion force.

That is, as shown in FIG. 13B, when the current I flows to the right (the fixed terminal 420B side as viewed from the fixed terminal 420A) through the movable contactor 430, a counterclockwise magnetic flux φ1 is generated around the movable contactor 430 as viewed from the right. In this event, the front end portion 491*c* of the first yoke 491 and the front end surface of the protrusion 492*c* serve as the N-pole. While the rear end portion 491*d* of the first yoke 491 and the front end surface of the protrusion 492*b* serve as the S-pole, as described above. Thus, an attractive force acts between the first and second yokes 491 and 492.

Since the first yoke 491 is fixed to the tip (upper end) of the shaft 380, the second yoke 492 is pulled upward by the attractive force if the movable element 370 is in the exciting position. As the second yoke 492 is pulled upward, an upward force from the second yoke 492 acts on the movable contactor 430. As a result, a force pushing up the movable contactor 430, that is, a force pressing the movable contacts 431A and 431B against the fixed contacts 421*a*A and 421*a*B is increased.

Therefore, the first and second yokes 491 and 492 provided in the contact device 40 according to this embodiment can achieve stable connection between the movable contacts 431A and 431B and the fixed contacts 421*a*A and 421*a*B even when an abnormal current such as a short-circuit current, for example, flows through the contact device 40.

(4) ELECTRICAL DEVICE

Figure 18B:
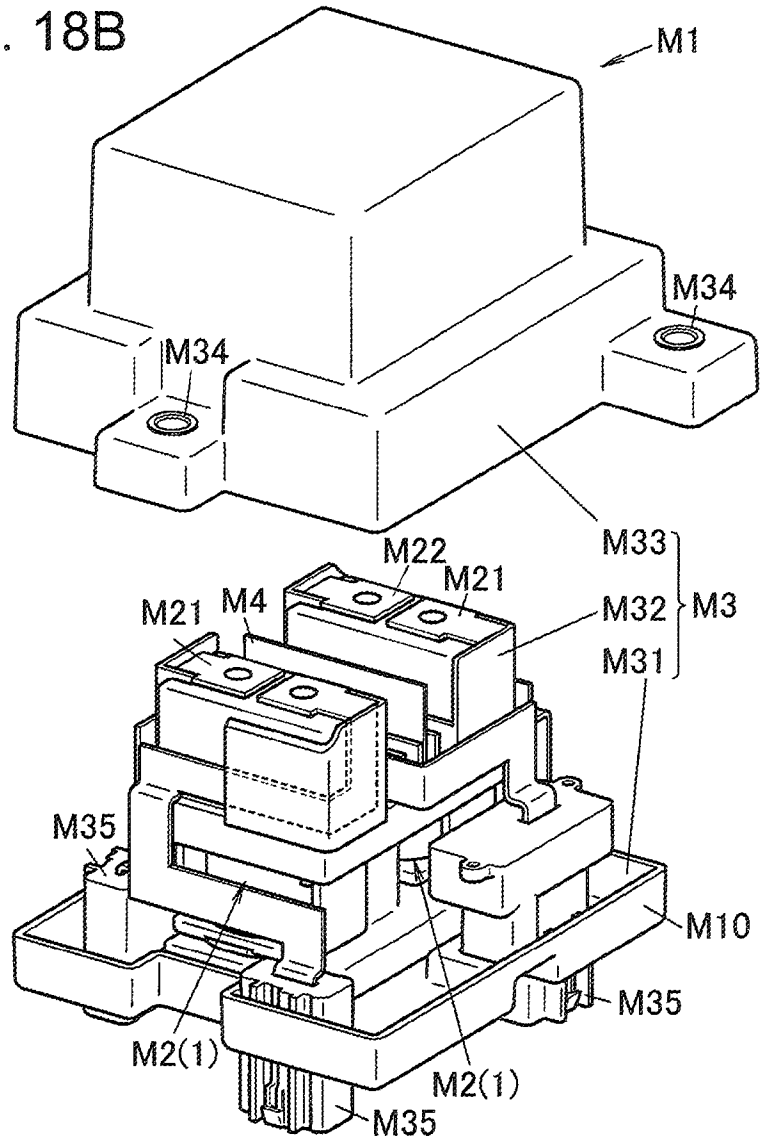
FIG. 18B is an exploded perspective view of the electrical device according to the second embodiment.
Figure 18A:
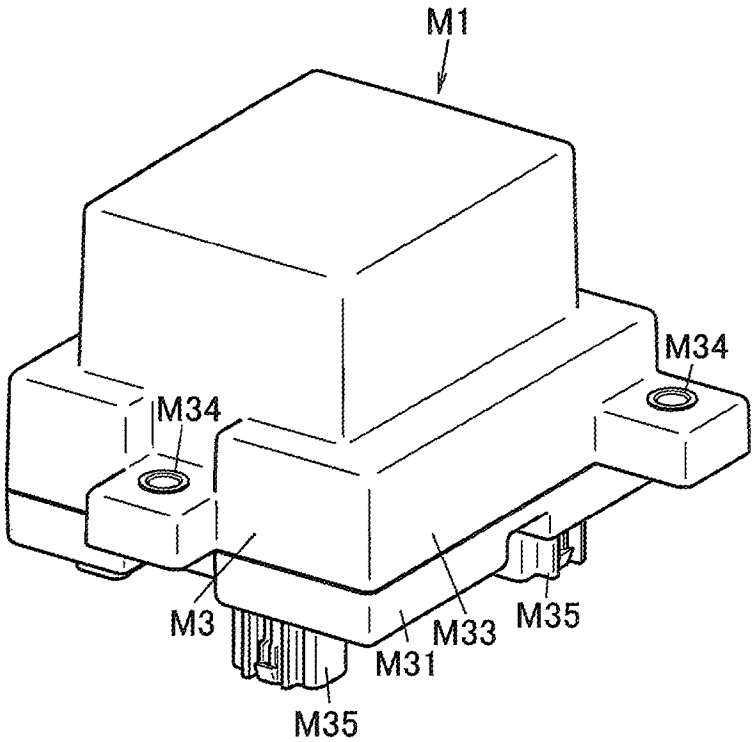
Figure 19:
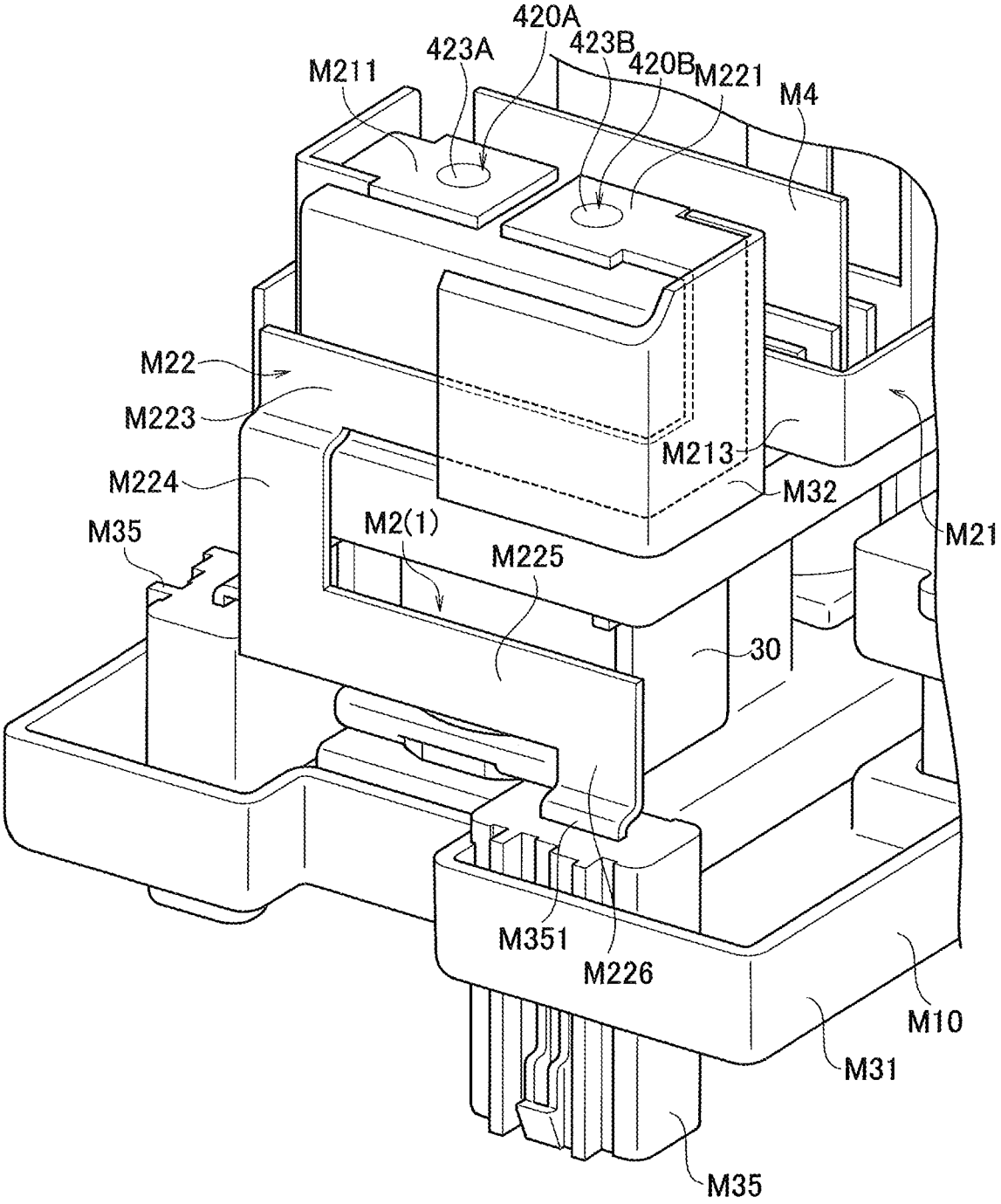
FIG. 19 is an enlarged perspective view of a main part of the electrical device according to the second embodiment.

Next, description is given of a configuration of an electrical device M1 with reference to FIGS. 18A to 19.

The electrical device M1 according to this embodiment includes two inner units M2 and a housing M3. The inner unit M2 is the electromagnetic relay 1 (the contact device 40 and the electromagnetic device 30) having the configuration described above. The electrical device M1 further includes conductive bars M21 and M22, instead of the busbars 440A and 440B described above, as the "conductive members", An electrical device case M10 includes the housing M3 and the conductive bars M21 and M22.

The housing M3 is made of an electrically insulating synthetic resin. In this embodiment, the housing M3 includes a base M31, an inner cover M32, and an outer cover M33.

The outer cover M33 has an open lower surface. The base M31 is mechanically connected to the outer cover M33 so as to close the lower surface of the outer cover M33, thereby forming a box-like outer shell that houses the inner unit M2 (here, the electromagnetic relay 1) together with the outer cover M33. The mechanical connection between the base M31 and the outer cover M33 is realized by welding or adhesion, for example.

The inner cover M32 is attached to the inner unit M2 so as to cover at least a part of the inner unit M2 between the base M31 and the outer cover M33. The inner cover M32 has an open lower surface. The inner cover M32 is placed on the inner unit M2 from above so as to cover a portion of the inner unit M2 corresponding to the contact device 10. An opening for inserting the fixed terminals 420A and 420B in the inner unit M2 is formed in the upper surface of the inner cover M32. This opening is formed in a circular shape, and penetrates the upper wall of the inner cover M32 in the thickness direction (vertical direction). In this embodiment, one inner cover M32 is attached over two inner units M2 (electromagnetic relays 1). Thus, two inner units M2, each consisting of the electromagnetic relay 1, are held in one housing M3.

The housing M3 further includes a plurality of fixed portions M34 and a plurality of connectors M35. The electrical device M1 is attached to an attachment target by the plurality of fixed portions M34. The electrical device M1 is electrically connected to a connection target by the plurality of connectors M35. Since it is assumed in this embodiment that the electromagnetic relay 1 is mounted on an electric vehicle, the electrical device M1 is fixed to a vehicle body (frame or the like) of the electric vehicle as an attachment target by the plurality of fixed portions M34. The electrical device M1 is also electrically connected to a battery for traveling, a load (for example, an inverter), and the like as a connection target by the plurality of connectors M35. Here, the plurality of fixed portions M34 are integrally formed with the outer cover M33 so as to protrude laterally from the outer cover M33. The plurality of connectors M35 are integrally formed with the base M31 so as to penetrate the base M31 in the vertical direction. Although the connectors M35 are integrated with the housing M3, the present invention is not limited to this configuration. The connector M35 may be separate from the housing M3 and may be held by the housing M3.

In the electrical device M1, as shown in FIG. 19, the conductive bars M21 and M22 as the conductive members are held by the housing M3. The conductive bars M21 and M22 correspond to the busbars 440A and 440B described above, respectively. That is, the conductive bar M21 includes electric path pieces M211, M212, and M213 corresponding to the electric path pieces 441A, 443A, and 445A of the busbar 440A. Likewise, the conductive bar M22 includes electric path pieces M221, M222, and M223 corresponding to the electric path pieces 441B, 443B, and 445B of the busbar 440B.

Here, the conductive bars M21 and M22 are held by the housing M3 by press-fitting a part of the electric path pieces M21 and M22 into the housing M3. To be more specific, the conductive bars M21 and M22 are held by the inner cover M32 by press-fitting the lower ends of the electric path pieces M212 and M222 into the inner cover M32. However, the holding structure of the conductive bars M21 and M22 with the housing M3 is not limited to the press-fitting, but the conductive bars M21 and M22 may be held in the housing M3, for example, by insert-molding the housing M3 using the conductive bars M21 and M22 as insert parts. Alternatively, the conductive bars M21 and M22 may be fixed to the housing M3, for example, by screwing, caulking, bonding or the like to be held by the housing M3.

The conductive bar M22 further includes electric path pieces M224, M225, and M226. The electric path piece M224 is connected to the electric path piece M223 and is disposed in front of the inner unit M2 so as to extend downward from the left end of the electric path piece M223. The electric path piece M225 is connected to the electric path piece M224 and is disposed in front of the inner unit M2 so as to extend rightward (to the fixed terminal 420B side as viewed from the fixed terminal 420A) from the lower end of the electric path piece M224. The electric path piece M226 is connected to the electric path piece M225 and is disposed in front of the inner unit M2 so as to extend downward from the right end of the electric path piece M225. The tip (lower end) of the electric path piece M226 is mechanically connected (coupled) to a contact M351 of the connector M35. Thus, in a state where the connector M35 is electrically connected to the load to be connected, the conductive bar M22 is electrically connected to the load through the connector M35. The thickness direction (front-rear direction) of each of the electric path pieces M224, M225, and M226 is perpendicular to the moving direction (vertical direction) of the movable contactor 430.

Although FIG. 19 shows a specific shape for the conductive bar M22 only among the conductive bars M21 and M22, the conductive bar M21 also includes an electric path piece connecting between the electric path piece M213 and the connector M35 as in the case of the conductive bar M22.

Therefore, in the electrical device M1, when an abnormal current such as a short-circuit current, for example, flows through the contact device 40 in the inner unit M2, repulsion forces are generated between the electric path piece M213 of the conductive bar M21 and the movable contactor 430 and between the electric path piece M223 of the conductive bar M22 and the movable contactor 430.

Here, the conductive bars M21 and M22 have rigidity as in the case of the busbars 440A and 440B. Therefore, the conductive bars M21 and M22 have their one end portions (electric path pieces M211 and M221) in the longitudinal direction mechanically connected to the fixed terminals 420A and 420B, resulting in a state of being entirely supported by the fixed terminals 420A and 420B. The conductive bars M21 and M22 also have their other end portions in the longitudinal direction mechanically connected to the connectors M35. Therefore, the conductive bars M21 and M22 are held directly or indirectly via the inner unit M2 (electromagnetic relay 1) in the housing M3 in a suspended state between the fixed terminals 420A and 420B and the connectors M35.

The electrical device M1 further includes a shield M4. The shield M4 is made of a magnetic material (ferromagnetic material), and has a function to shield the magnetic flux between the two inner units M2 (electromagnetic relays 1). In the electrical device M1 according to this embodiment, the two inner units M2 are disposed back to back in the direction (front-rear direction) perpendicular to the direction (right-left direction) in which the pair of fixed contacts 421*a*A, 421*a*B are arranged as viewed from above. That is, the two inner units M2 are positioned in the housing M3 such that the rear surface of one inner unit M2 is opposed to the rear surface of the other inner unit M2. The shield M4 has a rectangular plate shape and is disposed between the rear surfaces of these two inner units M2. The shield M4 is held by the inner cover M32. This makes it possible to reduce the influence of a magnetic flux generated due to a current flowing through the conductive bar M21 electrically connected to one of the inner units M2 on the other inner unit M2.

The electrical device M1 may also include various sensors in addition to the electromagnetic relay 1 as the inner unit M2. Such sensors are, for example, for measuring a current flowing through the inner unit M2 or through the conductive bars M21 and M22, for measuring a temperature in an internal space of the inner unit M2 or the housing M3, and the like.

In the electrical device according to this embodiment, the two busbars 440A and 440B having the pair of fixed terminals 420A and 420B connected thereto may also be not included in the components of the contact device 40 in FIGS. 9, 10, and the like.

(5) MODIFIED EXAMPLE

Hereinafter, description is given of modified examples of the second embodiment. Note that, in the following, the same components as those of the second embodiment are denoted by the same reference numerals, and description thereof is omitted as appropriate.

(5.1) First Modified Example

The shape of the busbar is not limited to the shape of the busbars 440A and 440B shown in the second embodiment, and busbars 440A and 440B shown in FIGS. 20A to 26 may be applied instead of the busbars 440A and 440B described above.

The first busbar 440A and the second busbar 440B of this modified example are made of a conductive metal material. The busbars 440A and 440B are made of, for example, copper or copper alloy, and are formed in a band plate shape. In this modified example, the busbars 440A and 440B are formed by bending a metal plate. The first busbar 440A has its one end, in the longitudinal direction, electrically connected to, for example, the first fixed terminal 420A of the contact device 40. The first busbar 440A also has its other end, in the longitudinal direction, electrically connected to, for example, a battery for traveling. Meanwhile, the second busbar 440B has its one end, in the longitudinal direction, electrically connected to, for example, the second fixed terminal 420B of the contact device 40. The second busbar 440B also has its other end, in the longitudinal direction, electrically connected to, for example, a load.

Furthermore, in this modified example, the first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has a substantially square shape in plan view, and is caulked and coupled to the first fixed terminal 420A at the caulking portion 423A of the first fixed terminal 420A. The first extension portion 443A is connected to the first fixed portion 441A and is disposed behind the housing 410 so as to extend downward from the rear end of the first fixed portion 441A. Thus, in this modified example, the first extension portion 443A overlaps with the first fixed terminal 420A to which the first fixed portion 441A having the first extension portion 443A connected thereto is fixed, as viewed front one side of the direction (front-rear direction) perpendicular to both of the main current direction (right-left direction) of the current flowing through the movable contactor 430 and the direction (vertical direction) of the current flowing through the first fixed terminal 420A.

The first electric path piece (first electric path portion) 445A is connected to the first extension portion 443A and is disposed behind the housing 410 so as to extend rightward (to the second fixed terminal 420B side as viewed from the first fixed terminal 420A) from the lower end of the extension portion 443A. The first electric path piece 445A is disposed such that the thickness direction (front-rear direction) is perpendicular to the moving direction (vertical direction) of the movable contactor 430 (see FIGS. 20A and 21).

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has a substantially square shape in plan view, and is caulked and coupled to the second fixed terminal 420B at the caulking portion 423B of the second fixed terminal 420B. The second extension portion 443B is connected to the second fixed portion 441B and is disposed in front of the housing 410 so as to extend downward from the front end of the second fixed portion 441B. Thus, in this modified example, the second extension portion 443B overlaps with the second fixed terminal 420B to which the second fixed portion 441B having the second extension portion 443B connected thereto is fixed, as viewed from one side of the direction (front-rear direction) perpendicular to both of the main current direction (right-left direction) of the current flowing through the movable contactor 430 and the direction (vertical direction) of the current flowing through the first fixed terminal 420A.

The movable contactor 430 is disposed between the first electric path piece 445A and the second electric path piece 445B as viewed from one side of the moving direction (vertical direction) of the movable contactor 430.

The second electric path piece (second electric, path portion) 445B is connected to the second extension portion 443B and is disposed in front of the housing 410 so as to extend leftward (to the first fixed terminal 420A side as viewed from the second fixed terminal 420B) from the lower end of the second extension portion 443B. The second electric path piece 445B is disposed such that the thickness direction (front-rear direction) is perpendicular to the moving direction (vertical direction) of the movable contactor 430 (see FIGS. 20A and 21).

Here, the busbars 440A and 440B have rigidity. Therefore, the busbars 440A and 440B have their one ends (fixed portions 441A and 441B) in the longitudinal direction mechanically connected to the fixed terminals 420A and 420B, resulting in a state where the busbars 440A and 440B are entirely supported by the fixed terminals 420A and 420B. Accordingly, the other end portions (electric path pieces 445A and 445B) in the longitudinal direction of the busbars 440A and 440B are self-supporting. Therefore, the busbars 440A and 440B have a structure integrated with the fixed terminals 420A and 420B.

Figure 23B:
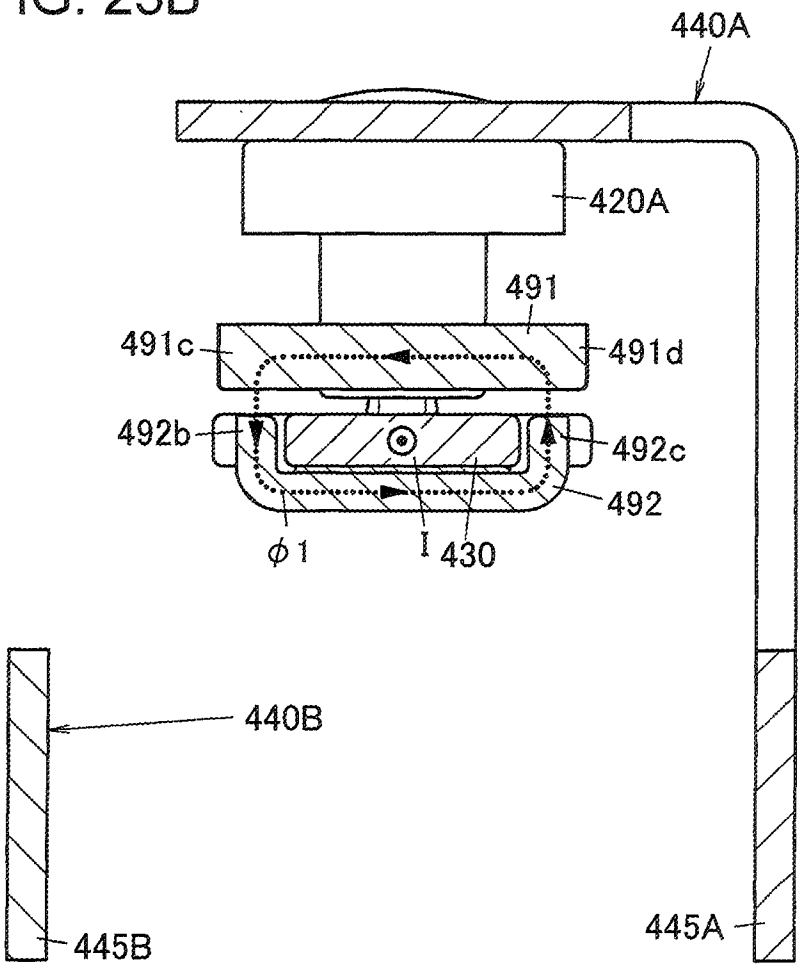
FIG. 23B is a diagram for explaining a first yoke and a second yoke attracting each other, which are included in the contact device according to the first modified example of the second embodiment.
Figure 23A:
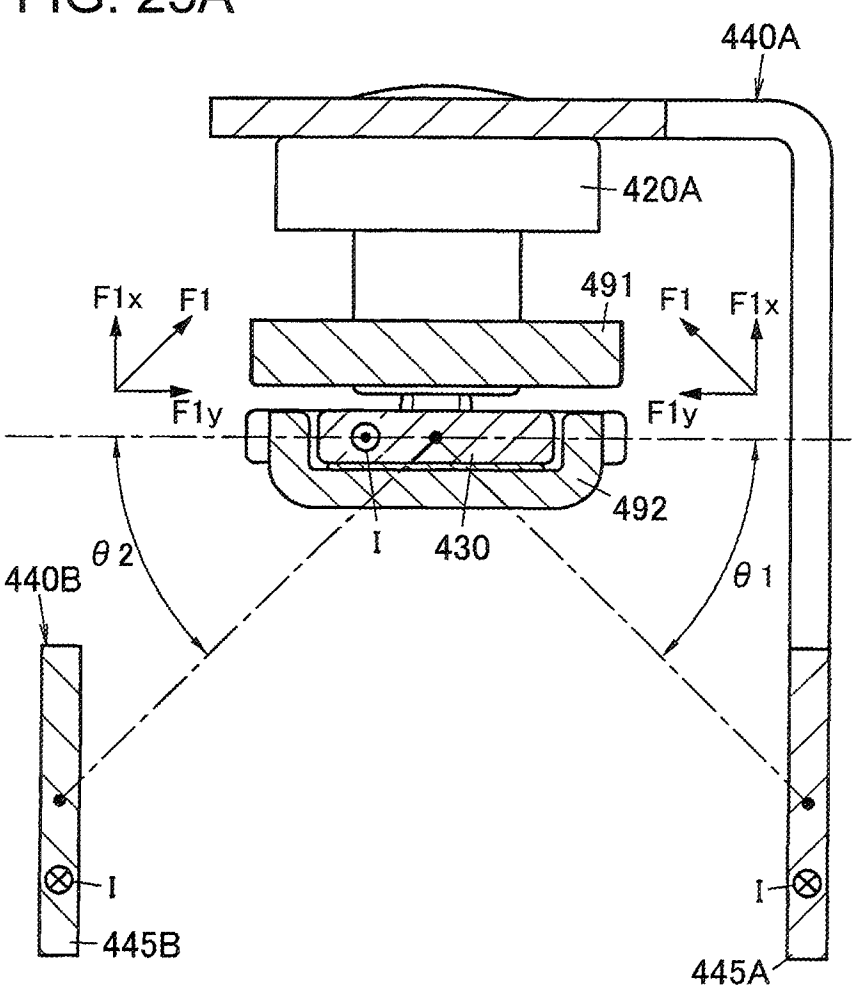
Figure 24:
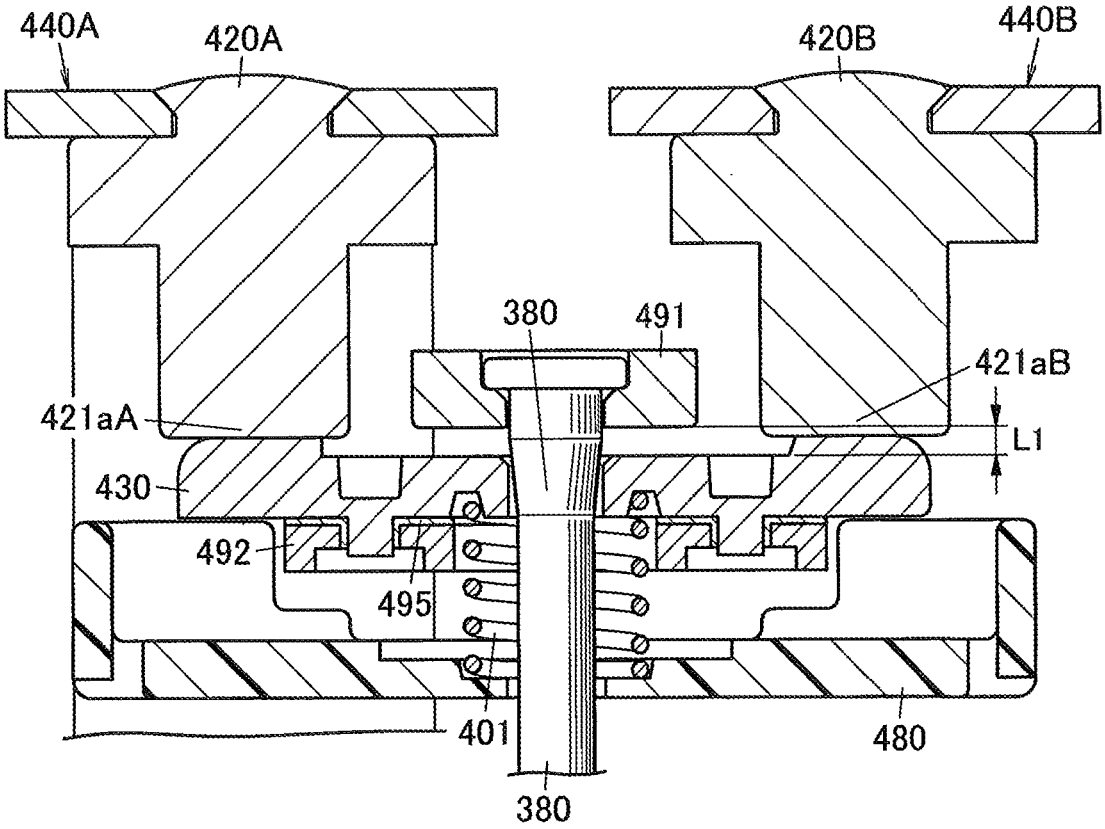
FIG. 24 is a diagram for explaining a positional relationship between the first yoke and the movable contactor according to the first modified example of the second embodiment.
Figure 25A:
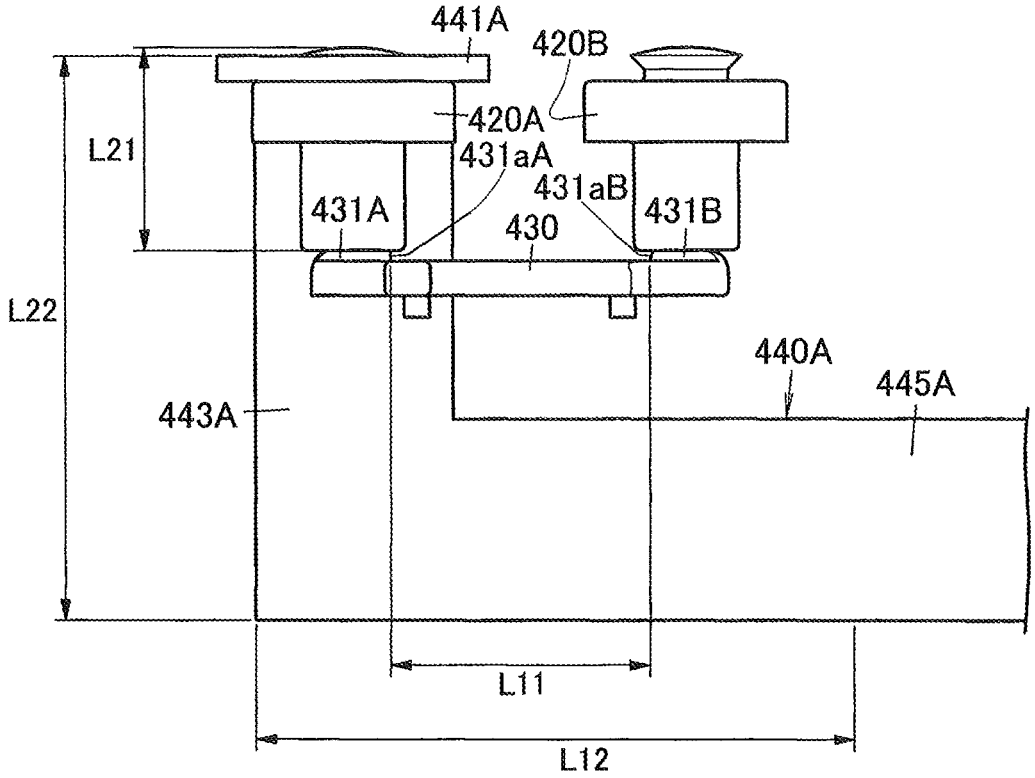
Figure 25B:
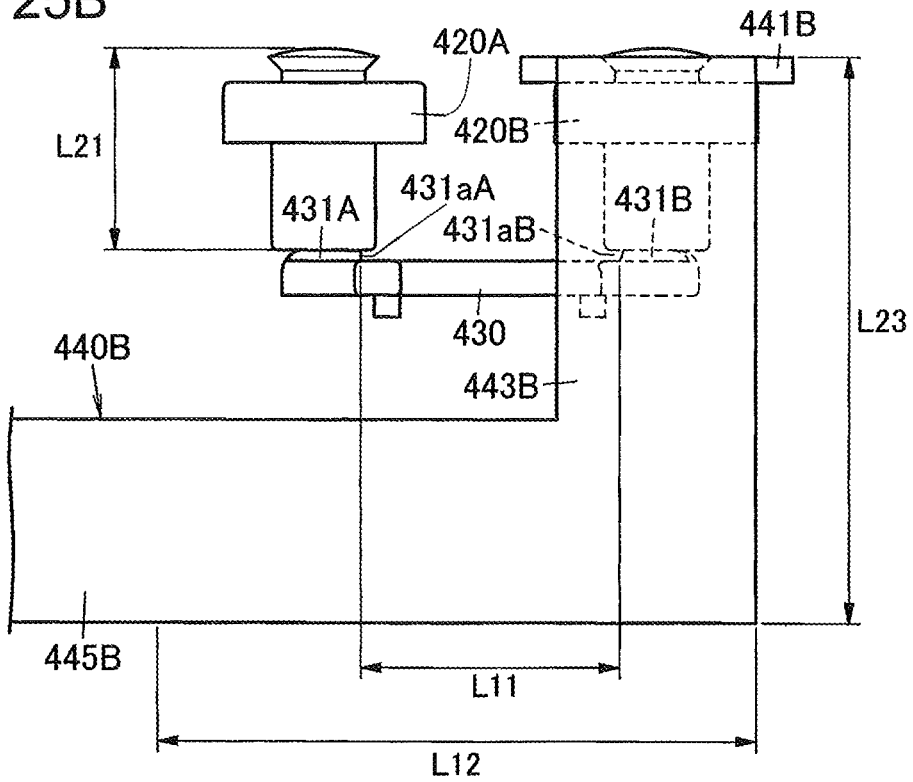
FIG. 25B is a diagram for explaining a length of a second electrical path portion connected to the second conductive member according to the first modified example of the second embodiment.
Figure 26:
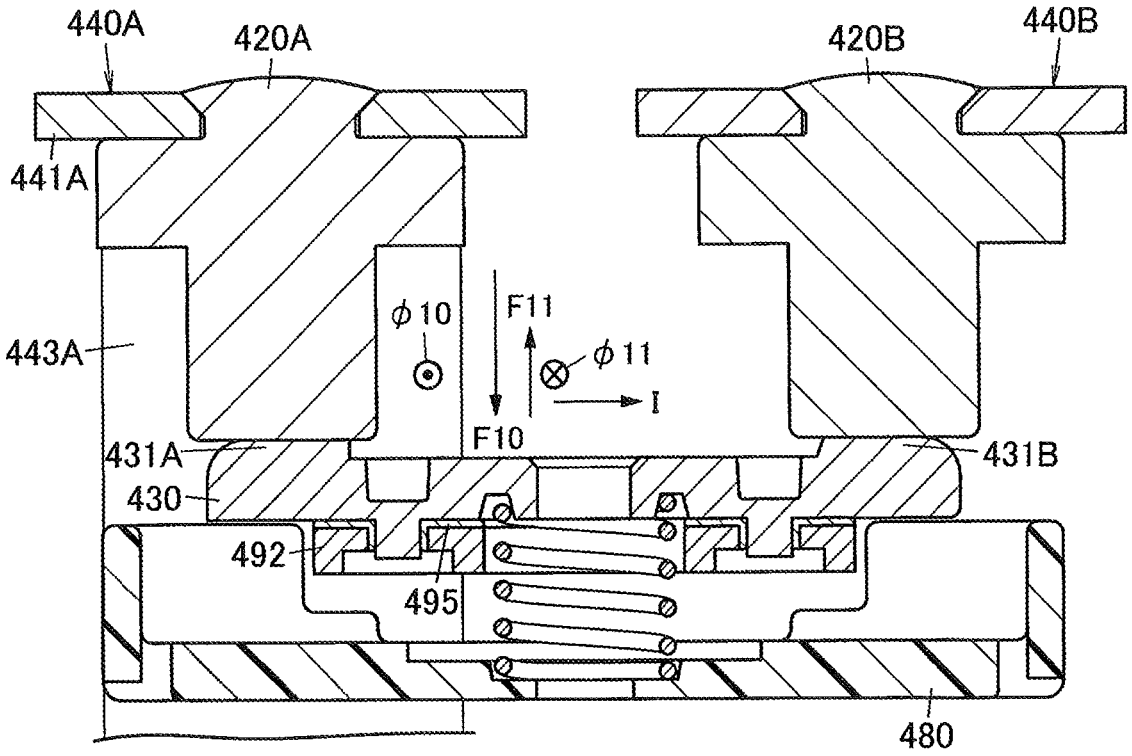
FIG. 26 is a diagram for explaining a Lorentz force generated due to a relationship between a magnetic flux generated by a current flowing through the fixed terminal and a current flowing through the movable contactor in the contact device according to the first modified example of the second embodiment, and for explaining a Lorentz force generated due to a relationship between a magnetic flux generated by a current flowing through the electrical path portion opposed to the fixed terminal and a current flowing through the movable contactor.

A length L22 of the first extension portion 443A and a length L23 of the second extension portion 443B are equal to or greater than a length L21 of the fixed terminals 420A and 420B in the vertical direction (see FIGS. 25A and 25B). In FIGS. 23A and 23B, the length L21 is the dimension from the upper end edge of the fixed terminal 420A (or 420B) to the lower end edge (including the fixed contact 421*a* A (or 421*a* B) of the fixed terminal 420A (or 420B). However, the length L21 to be in the above dimensional relationship with the lengths L22 and L23 is at least the length from the connection portion with the busbar 440A (440B) in the fixed terminal 420A (420B) to the retention portion of the fixed contact 421*a* A (421*a* B) in the fixed terminal 420A (420B).

Here, when the movable contactor 430 is located in the closed position, the movable contactor 430 is positioned between the electric path pieces 445A and 445B and the fixed contacts 421*a*A and 421*a*B as viewed from one side of the front-rear direction. The electric path pieces 445A and 445B are disposed substantially in parallel with the movable contactor 430 on the outside of the housing 410 so as to have such a positional relationship (see FIGS. 20B and 21). In other words, when the movable contactor 430 is located in the closed position, the movable contactor 430 is positioned between the electric path pieces 445A and 445B and the fixed contacts 421*a*A and 421*a*B in the moving direction (vertical direction) of the movable contactor 430.

In this modified example, as shown in FIG. 23A, in the cross-section perpendicular to the right-left direction, an angle θ1 between a straight line connecting the center point of the electric path piece 445A and the center point of the movable contactor 430 and a straight line along the front-rear direction is 45 degrees. Likewise, in the cross-section perpendicular to the right-left direction, an angle θ2 between a straight line connecting the center point of the electric path piece 445B and the center point of the movable contactor 430 and a straight line along the front-rear direction is identical to the angle θ1 (here, 45 degrees). Here, the term "identical" includes not only perfect matching but also cases where an error of about several degrees is within an allowable range. Moreover, the above value (45 degrees) is an example, and the angle is not limited to this value. In FIG. 23A, the current I is indicated at a position shifted from the central point of the cross-section of the movable contactor 430 so that the central point of the cross-section of the movable contactor 430 does not overlap with the notation of the current I. This, however, is not intended to specify the position where the current I actually flows. The same goes for the notation of the current flowing through the electric path pieces 445A and 445B.

The electric path pieces 445A and 445B are disposed between the yoke upper plate 351 of the yoke 350 to be described later and the movable contactor 430 in the closed position.

A length L12 of the first electric path piece 445A and a length L13 of the second electric path piece 445B are each equal to or greater than a distance L11 between the movable contacts 431A and 431B (see FIGS. 25A and 25B). Here, the distance L11 between the movable contacts 431A and 431B is the shortest distance between the first and second movable contacts 431A and 431B (distance from the inner end 431*a* A of the first movable contact 431A to the inner end 431*a* B of the second movable contact 431B).

In this modified example, the first electric path piece 445A extends (protrudes) to the right from the first extension portion 443A, while the second electric path piece 445B extends (protrudes) to the left from the second extension portion 443B.

Here, it is assumed that the current I flows through the movable contactor 430 from the first fixed terminal 420A toward the second fixed terminal 420B. In this event, the current I flows through the first electric path piece 445A, the first extension portion 443A, the first fixed portion 441A, the first fixed terminal 420A, the movable contactor 430, the second fixed terminal 420B, the second fixed portion 441B, the second extension portion 443B, and the second electric path piece 445B in this order (see FIG. 22). In the electric path pieces 145A and 445B, the current I flows to the left (the first fixed terminal 420A side as viewed from the second fixed terminal 420B). Meanwhile, in the movable contactor 430, the current I flows to the right (the second fixed terminal 420B side as viewed from the first fixed terminal 420A). On the other hand, when the current I flows through the movable contactor 430 from the second fixed terminal 420B toward the first fixed terminal 420A, the current I flows to the right in the electric path pieces 445A and 445B, while the current I flows to the left in the movable contactor 430.

That is, the electric path pieces 445A and 445B extend (protrude) in opposite directions from the extension portions 443A and 443B. Therefore, the direction of the current I flowing through the electric path pieces 445A and 445B is opposite to the direction of the current I flowing through the movable contactor 430.

Furthermore, the direction of the current I flowing through the first extension portion 443A is opposite to that of the current I flowing through the first fixed terminal 420A. Likewise, the direction of the current I flowing through the second extension portion 443B is opposite to that of the current I flowing through the second fixed terminal 420B. To be more specific, assuming that the current I flows from the first fixed terminal 420A to the second fixed terminal 420B, the current I flows upward in the first extension portion 443A, while the current I flows downward in the first fixed terminal 420A. On the other hand, the current I flows downward in the second extension portion 443B, while the current I flows upward in the second fixed terminal 420B.

Figure 20B:
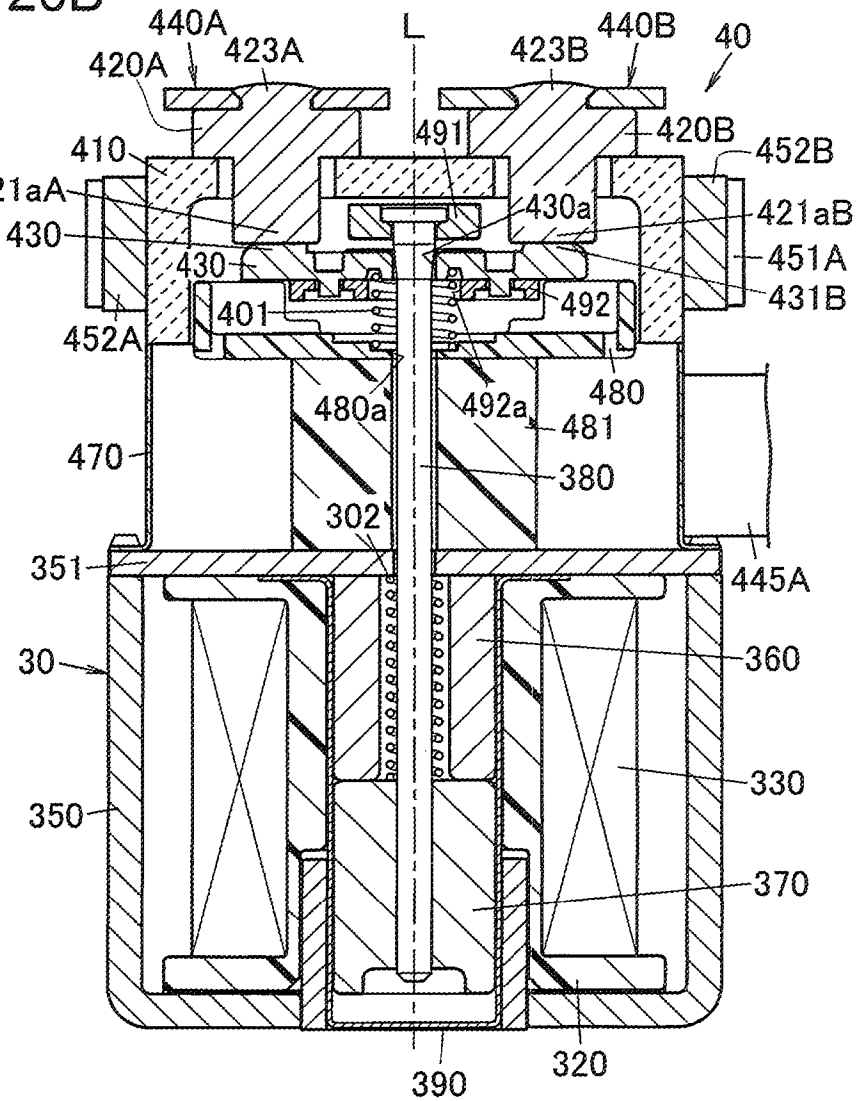
FIG. 20B is a cross-sectional view taken along the line X3-X3 in FIG. 20A.
Figure 20A:
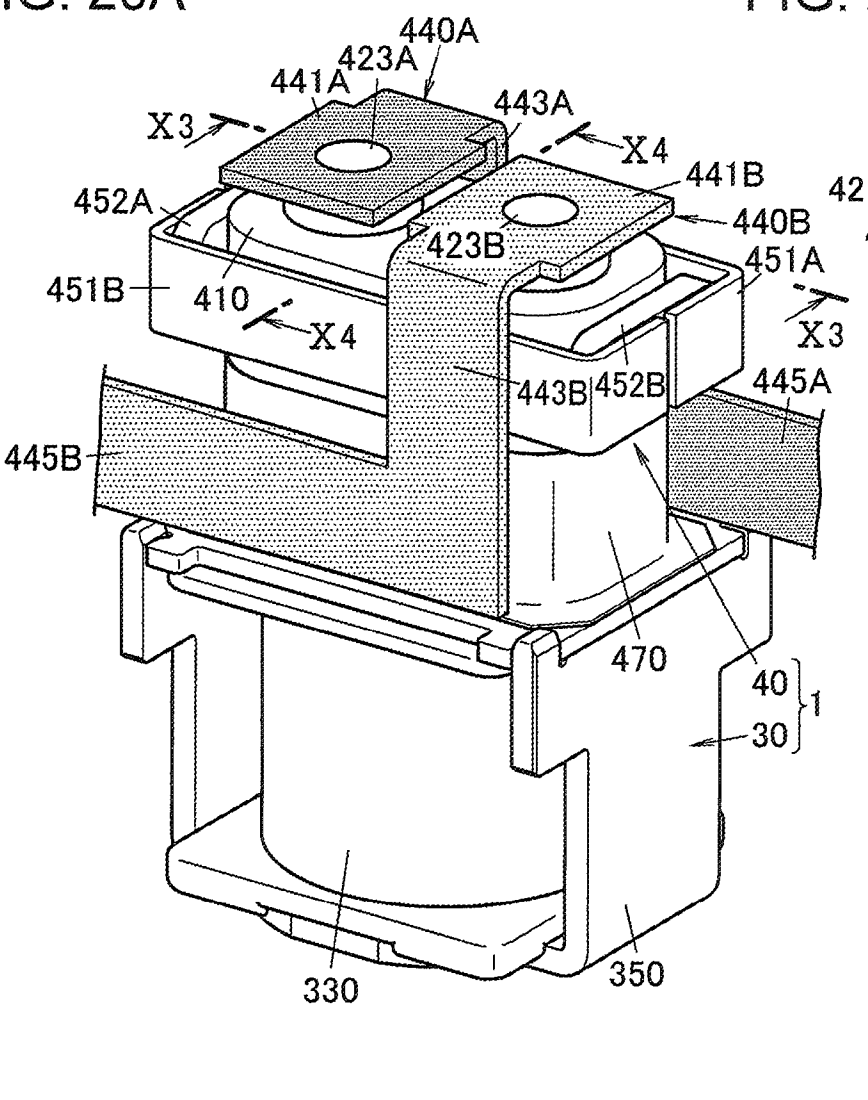
Figure 21:
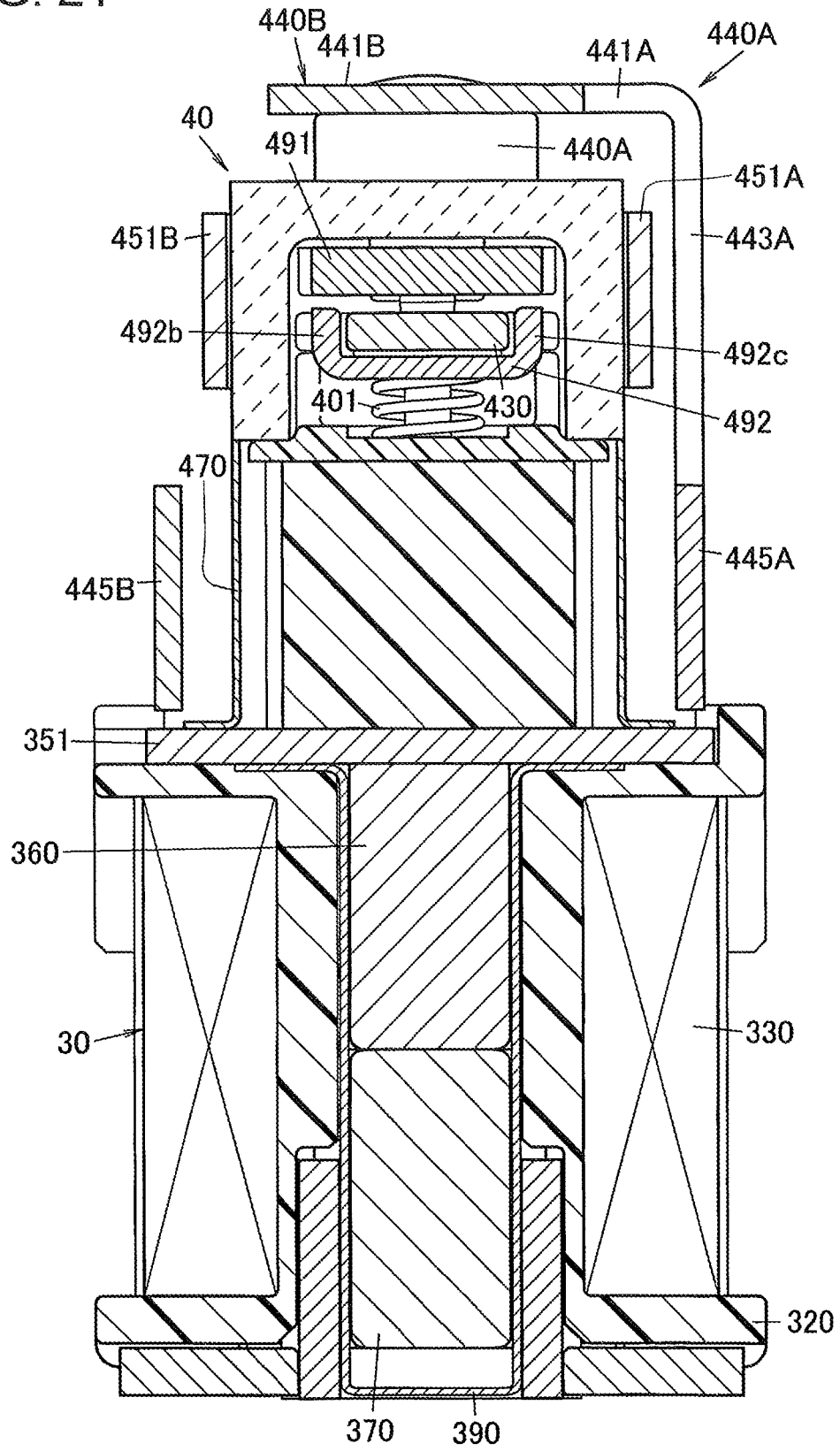
FIG. 21 is a cross-sectional view taken along the line X4-X4 in FIG. 20A.
Figure 22:
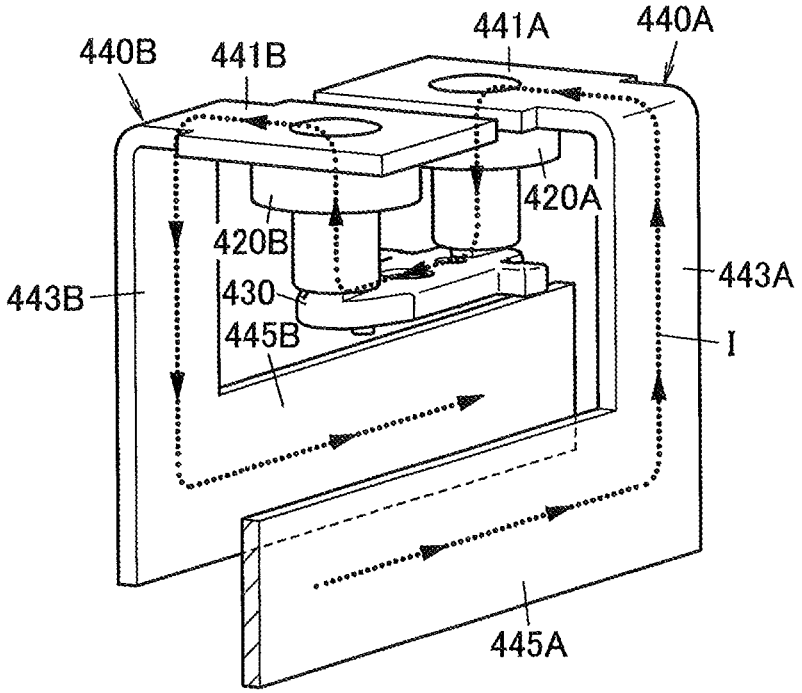
FIG. 22 is a diagram for explaining a current flow in a contact device included in the electromagnetic relay according to the first modified example of the second embodiment.

As shown in FIG. 20A, the electric path pieces 445A and 445B and the arc-extinguishing magnets 452A and 452B are arranged in the order of the arc-extinguishing magnets 452A and 452B and the electric path pieces 445A and 445B from above in the moving direction (vertical direction) of the movable contactor 430. In other words, the electric path pieces 445A and 445B are positioned below the arc-extinguishing magnets 452A and 452B in the vertical direction.

(5.2) Second Modified Example

Figure 27:
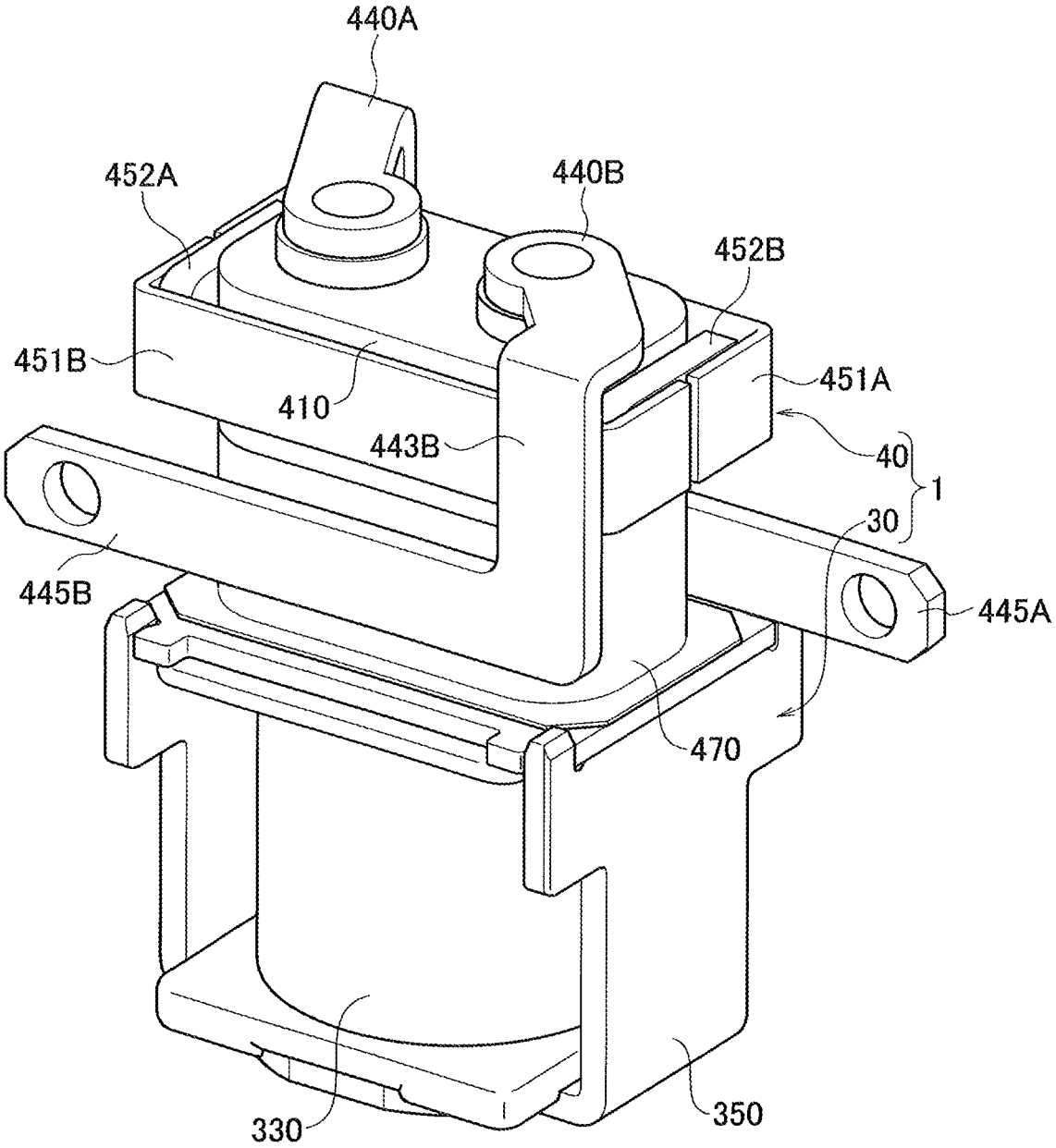
FIG. 27 is a perspective view of an electromagnetic relay according to a second modified example of the second embodiment.

Instead of the busbars 440A and 440B described in the second embodiment, busbars 440A and 440B shown in FIG. 27 may be applied.

In this modified example, the first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has a substantially circular shape in plan view, and is caulked and coupled to the first fixed terminal 420A at the caulking portion 423A of the first fixed terminal 420A. The first extension portion 443A is connected to the first fixed portion 441A and is disposed obliquely behind the housing 410 so as to extend downward front the left side and the rear end of the first fixed portion 441A. Thus, in this modified example, the first extension portion 443A overlaps with the first fixed terminal 420A to which the first fixed portion 441A having the first extension portion 443A connected thereto is fixed, as viewed from one side of a direction perpendicular to the direction (vertical direction) of the current flowing through the first fixed terminal 420A and that intersects with the main current direction (right-left direction) of the current flowing through the movable contactor 430 at an angle (about 45 degrees in FIG. 77) different from a right angle.

The first electric path piece (first electric path portion) 445A is connected to the first extension portion 443A and is disposed behind the housing 410 so as to extend rightward (to the second fixed terminal 420B side as viewed from the first fixed terminal 420A) from the lower end of the extension portion 443A.

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has a substantially circular shape in plan view, and is caulked and coupled to the second fixed terminal 420B at the caulking portion 423B of the second fixed terminal 420B. The second extension portion 443B is connected to the second fixed portion 441B and is disposed obliquely in front of the housing 410 so as to extend downward from the right side and the front end of the second fixed portion 441B. Thus, in this modified example, the second extension portion 443B overlaps with the second fixed terminal 420B to which the second fixed portion 441B having the second extension portion 443B connected thereto is fixed, as viewed from one side of the direction perpendicular to the direction (vertical direction) of the current flowing through the second fixed terminal 420B and that intersects with the main current direction (right-left direction) of the current flowing through the movable contactor 430 at an angle (about 45 degrees in FIG. 27) different from a right angle.

The movable contactor 430 is disposed between the first electric path piece 445A and the second electric path piece 445B as viewed from one side of the moving direction (vertical direction) of the movable contactor 430.

The second electric path piece (second electric path portion) 445B is connected to the second extension portion 443B and is disposed in front of the housing 410 so as to extend leftward (to the first fixed terminal 420A side as viewed from the second fixed terminal 420B) from the lower end of the second extension portion 443B.

(5.3) THIRD MODIFIED EXAMPLE

Figure 28:
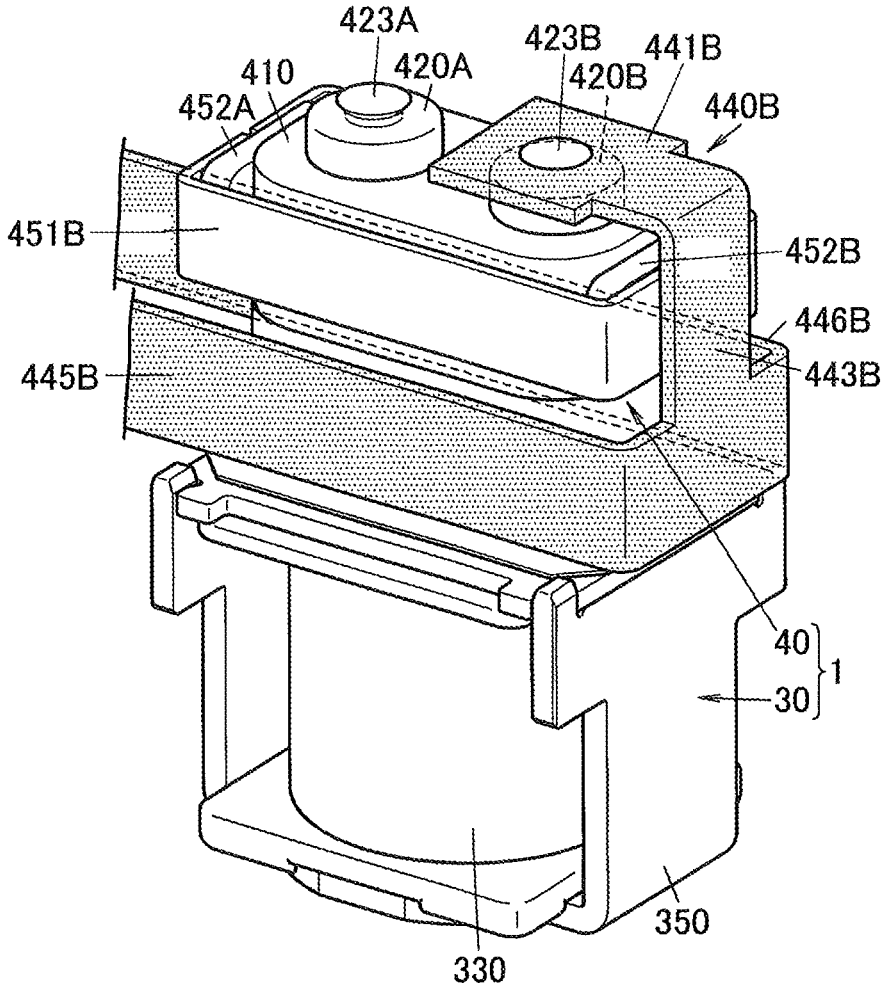
FIG. 28 is a perspective view of an electromagnetic relay according to a third modified example of the second embodiment.

Instead of the busbars 440A and 440B described in the second embodiment, busbars 440A and 440B shown in FIG. 28 may be applied.

In the second embodiment, the two busbars 440A and 440B are used to increase the force of the movable contactor 430 pushing up the fixed contacts 421*a*A and 421*a*B. However, the present invention is not limited to this configuration.

For example, in the contact device 40, one of the busbars 440A and 440B may be applied. That is, in the contact device 40, at least one of the busbars 440A and 440B may be applied.

When one of the busbars 440A and 440B is applied, the shape of the busbar may be the one described above or another shape.

In this modified example, a second busbar 440B having a shape different from that of the busbars 440A and 440B described in the second embodiment is used.

As shown in FIG. 28, the second busbar 440B has two electric path pieces (front electric path piece 445B and rear electric path piece 446B) connected to the second extension portion 443B. That is, the second busbar 440B shown in FIG. 28 has a shape in which two electric path pieces (front and rear electric path pieces 445B and 446B) are branched in the front-rear direction from the second extension portion 443B.

The second fixed portion 441B is mechanically connected to the second fixed terminal 420B. To be more specific, the second fixed portion 441B has a substantially square shape in plan view, and is caulked and coupled to the second fixed terminal 420B at the caulking portion 423B of the second fixed terminal 420B. The second extension portion 443B is connected to the second fixed portion 441B and is disposed obliquely in front of the housing 410 so as to extend downward from the right end portion of the second fixed portion 441B.

The front electric path piece (second electrical path portion) 445B is connected to the second extension portion 443B and is disposed in front of the housing 410 so as to extend leftward (to the first fixed terminal 420A side as viewed from the second fixed terminal 420B) from the lower end of the second extension portion 443B.

On the other hand, the rear electric path piece (second electrical path portion) 446B is connected to the second extension portion 443B and is disposed behind the housing 410 so as to extend leftward (to the first fixed terminal 420A side as viewed from the second fixed terminal 420B) from the lower end of the second extension portion 443B.

In this modified example, when the movable contactor 430 is located in the closed position, the movable contactor 430 is positioned between the two electric path pieces (front and rear electric path pieces 445B and 446B) and the fixed contacts 421*a*A and 421*a*B, as viewed from one side of the front-rear direction. The front electric path piece 445B and the rear electric path piece 446B are disposed substantially in parallel with the movable contactor 430 on the outside of the housing 410 so as to have such a positional relationship. The front and rear electric path pieces 445B and 446B have their ends, opposite to the second extension portion 443B, electrically connected to a load, for example.

In this modified example, for example, the current flowing through the movable contactor 430 from the first fixed terminal 420A toward the second fixed terminal 420B flows from the second extension portion 443B into the front electric path piece 445B and the rear electric path piece 446B, and then branches off at the front and rear electric path pieces 445B and 446B. Therefore, the direction of the current I flowing through the rear electric path piece 446B is opposite to the direction of the current I flowing through the movable contactor 430, as in the case of the front electric path piece 445B.

(5.4) FOURTH MODIFIED EXAMPLE

Figure 29:
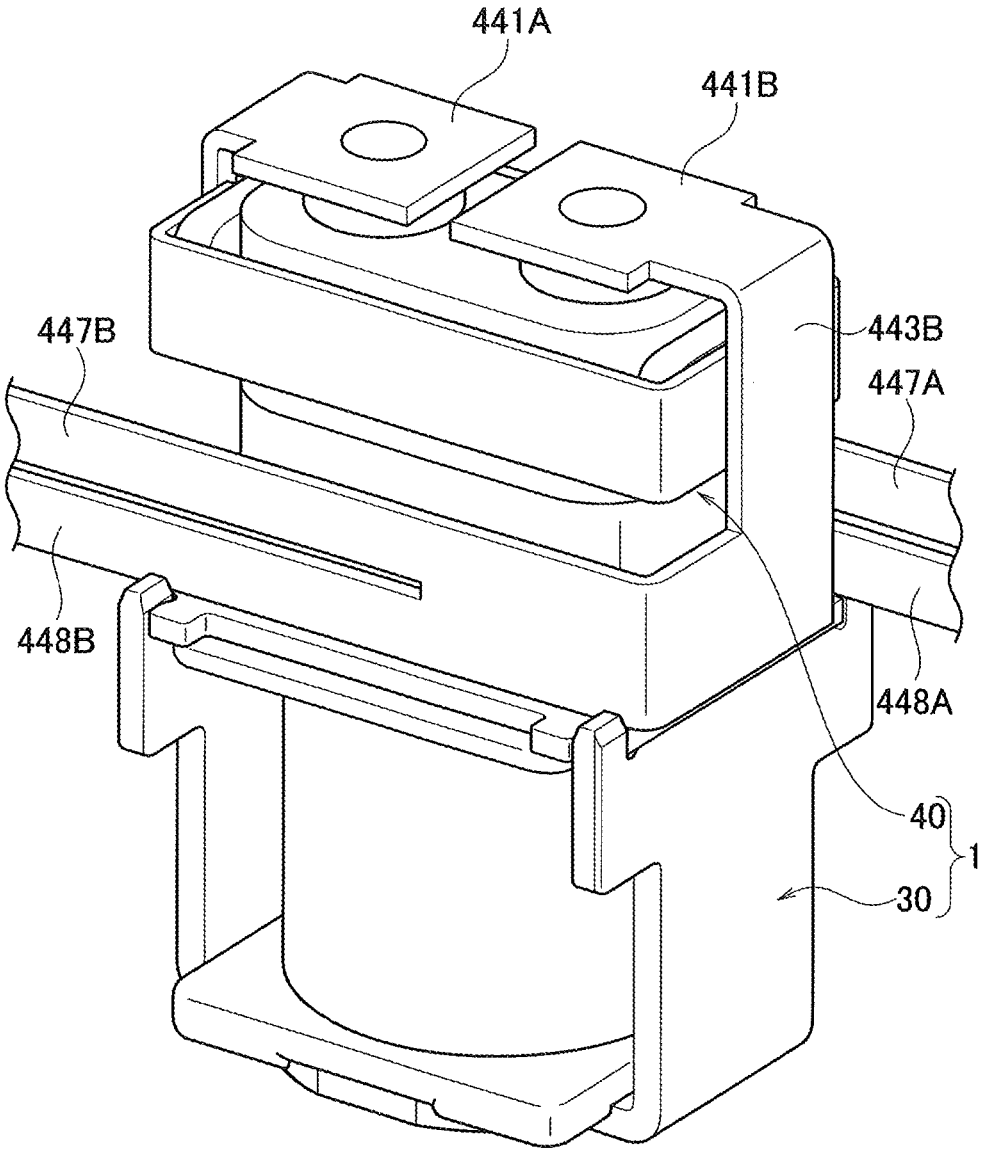
FIG. 29 is a perspective view of an electromagnetic relay according to a fourth modified example of the second embodiment.

Instead of the busbars 440A and 440B described in the second embodiment, busbars 440A and 440B shown in FIG. 29 may be applied.

In this modified example, busbars 440A and 440B different in shape from the busbars 440A and 440B described in the second embodiment are used.

The first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has an approximately square shape in plan view, and is caulked and coupled to the first fixed terminal 420A at a caulking portion 423A of the first fixed terminal 420A. The first extension portion 443A is connected to the first fixed portion 441A and is disposed to the left of the housing 410 so as to extend downward from the left end portion of the first fixed portion 441A. Thus, in this modified example, the first extension portion 443A overlaps with the first fixed terminal 420A to which the first fixed portion 441A having the first extension portion 443A connected thereto is fixed, as viewed from one side in the main current direction (right-left direction) of the current flowing through the movable contactor 430.

The first electric path piece (first electric path portion) 445A is connected to the first extension portion 443A and is disposed behind the housing 410 so as to extend to the right (second fixed terminal 420B side as viewed from the first fixed terminal 420A) from the lower end of the extension portion 443A.

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has an approximately square shape in plan view, and is caulked and coupled to the second fixed terminal 420B at a caulking portion 423B of the second fixed terminal 420B. The second extension portion 443B is connected to the second fixed portion 441B and is disposed to the right of the housing 410 so as to extend downward from the right end of the second fixed portion 441B. Thus, in this modified example, the second extension portion 443B overlaps with the second fixed terminal 420B to which the second fixed portion 441B having the second extension portion 443B connected thereto is fixed, as viewed from one side in the main current direction (right-left direction) of the current flowing through the movable contactor 430.

The movable contactor 430 is disposed between the first and second electric path pieces 445A and 445B as viewed from one side of the moving direction (vertical direction) of the movable contactor 430.

The second electric path piece (second electric path portion) 445B is connected to the second extension portion 443B and is disposed in front of the housing 410 so as to extend to the left (first fixed terminal 420A side as viewed from the second fixed terminal 420B) from the lower end of the second extension portion 443B.

Here, in this modified example, upper electric path pieces 447A and 447A and lower electric path pieces 448A and 448B are formed, respectively, by branching the tips of the first and second electric path pieces 445A and 445B into upper and lower pieces.

Note that the upper and lower electric path pieces 447A and 448A have their ends, opposite to the first extension portion 443A, electrically connected to a battery for traveling, for example. On the other hand, the upper and lower electric path pieces 447B and 448B have their ends, opposite to the second extension portion 443B, electrically connected to a load, for example.

In this modified example, when the movable contactor 430 is located in the closed position, the movable contactor 430 is positioned between the two electric path pieces (upper and lower electric path pieces 447A and 448A) and the fixed contacts 421*a*A and 421*a*B, as viewed from one side in the front-rear direction. Likewise, when the movable contactor 430 is located in the closed position, the movable contactor 430 is positioned between the two electric path pieces (upper and lower electric path pieces 447B and 448B) and the fixed contacts 421*a*A and 421*a*B, as viewed from one side in the front-rear direction. The upper electric path pieces 447A and 447B and the lower electric path pieces 448A and 448B are disposed substantially in parallel with the movable contactor 430 on the outside of the housing 410 so as to have such a positional relationship.

In this modified example, for example, the current flowing through the movable contactor 430 from the first fixed terminal 420A to the second fixed terminal 420B flows from the first extension portion 443A to the base side of the first electric path piece 445A, and is then split by the upper and lower electric path pieces 447A and 448A. Meanwhile, the current flows from the second extension portion 443B to the base side of the second electric path piece 445B, and is then split by the upper and lower electric path pieces 447B and 448B. Therefore, the direction of the current I flowing through the upper electric path pieces 447A and 447B and the direction of the current flowing through the lower electric path pieces 448A and 448B are opposite to the direction of the current I flowing through the movable contactor 430, as in the case of the electric path pieces 445A and 445B.

(5.5) Fifth Modified Example

Figure 30:
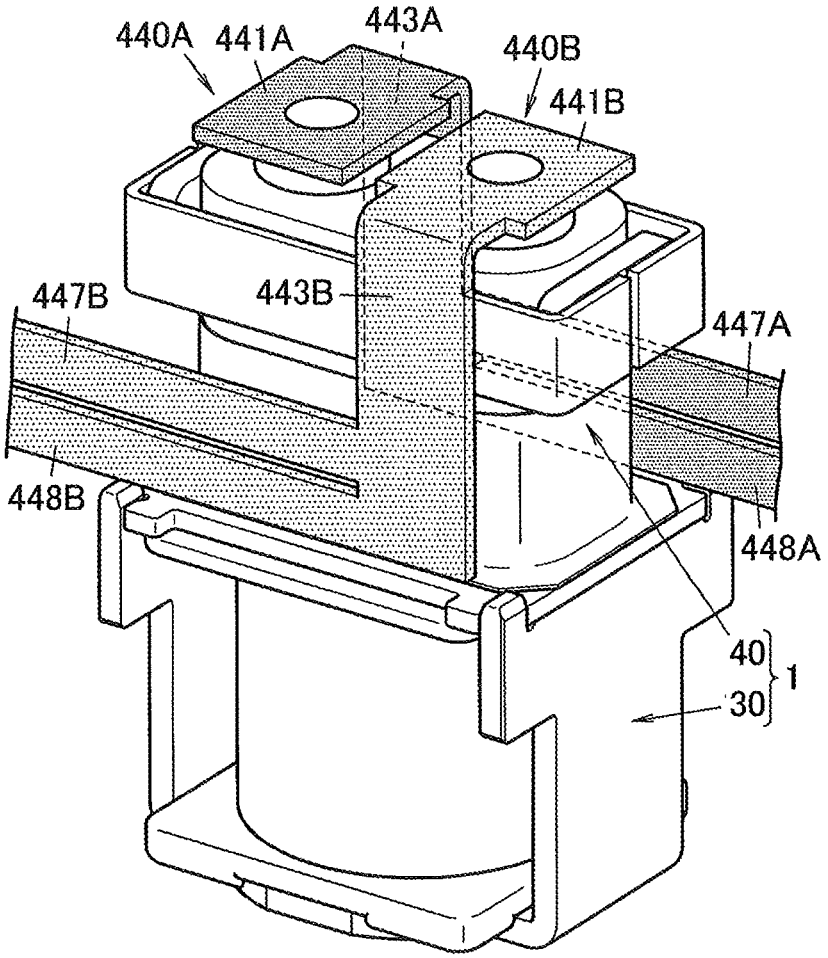
FIG. 30 is a perspective view of an electromagnetic relay according to a fifth modified example of the second embodiment.

Instead of the busbars 440A and 440B described in the second embodiment, busbars 440A and 440B shown in FIG. 30 may be applied.

In this modified example, busbars 440A and 440B different in shape from the busbars 440A and 440B described in the second embodiment are used.

The first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has a substantially square shape in plan view, and is caulked and coupled to the first fixed terminal 420A at the caulking portion 423A of the first fixed terminal 420A. The first extension portion 443A is connected to the first fixed portion 441A and is disposed behind the housing 410 so as to extend downward from the rear end of the first fixed portion 441A. Thus, in this modified example, the first extension portion 443A overlaps with the first fixed terminal 420A to which the first fixed portion 441A having the first extension portion 443A connected thereto is fixed, as viewed from one side of the direction (front-rear direction) perpendicular to both of the main current direction (right-left direction) of the current flowing through the movable contactor 430 and the direction (vertical direction) of the current flowing through the first fixed terminal 420A.

The first electric path piece (first electric path portion) 445A is connected to the first extension portion 443A and is disposed behind the housing 410 so as to extend rightward (to the second fixed terminal 420B side as viewed from the first fixed terminal 420A) from the lower end of the extension portion 443A.

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has a substantially square shape in plan view, and is caulked and coupled to the second fixed terminal 420B at the caulking portion 423B of the second fixed terminal 420B. The second extension portion 443B is connected to the second fixed portion 441B and is disposed in front of the housing 410 so as to extend downward from the front end of the second fixed portion 441B. Thus, in this modified example, the second extension portion 443B overlaps with the second fixed terminal 420B to which the second fixed portion 441B having the second extension portion 443B connected thereto is fixed, as viewed from one side of the direction (front-rear direction) perpendicular to both of the main current direction (right-left direction) of the current flowing through the movable contactor 430 and the direction (vertical direction) of the current flowing through the first fixed terminal 420A.

The movable contactor 430 is disposed between the first electric path piece 445A and the second electric path piece 445B as viewed from one side of the moving direction (vertical direction) of the movable contactor 430.

The second electric path piece (second electric path portion) 445B is connected to the second extension portion 443B and is disposed in front of the housing 410 so as to extend leftward (to the first fixed terminal 420A side as viewed from the second fixed terminal 420B) from the lower end of the second extension portion 443B.

Here, in this modified example, upper electric path pieces 447A and 447B and lower electric path pieces 448A and 448B are formed, respectively; by branching the tips of the first and second electric path pieces 445A and 445B into upper and lower pieces.

Note that the upper and lower electric path pieces 447A and 448A have their ends, opposite to the first extension portion 443A, electrically connected to a battery for traveling, for example. On the other hand, the upper and lower electric path pieces 447B and 448B have their ends, opposite to the second extension portion 443B, electrically connected to a load, for example.

In this modified example, when the movable contactor 430 is located in the closed position, the movable contactor 430 is positioned between the two electric path pieces (upper and lower electric path pieces 447A and 448A) and the fixed contacts 421*a*A and 421*a*B, as viewed from one side in the front-rear direction. Likewise, when the movable contactor 430 is located in the closed position, the movable contactor 430 is positioned between the two electric path pieces (upper and lower electric path pieces 447B and 448B) and the fixed contacts 421*a*A and 421*a*B, as viewed from one side in the front-rear direction. The upper electric path pieces 447A and 447B and the lower electric path pieces 448A and 448B are disposed substantially in parallel with the movable contactor 430 on the outside of the housing 410 so as to have such a positional relationship.

In this modified example, for example, the current flowing through the movable contactor 430 from the first fixed terminal 420A to the second fixed terminal 420B flows from the first extension portion 443A to the base side of the first electric path piece 445A, and is then split by the upper and lower electric path pieces 447A and 448A. Meanwhile, the current flows from the second extension portion 443B to the base side of the second electric path piece 445B, and is then split by the upper and lower electric path pieces 447B and 448B. Therefore, the direction of the current I flowing through the upper electric path pieces 447A and 447B and the direction of the current flowing through the lower electric path pieces 448A and 448B are opposite to the direction of the current I flowing through the movable contactor 430, as in the case of the electric path pieces 445A and 445B.

(5.6) Sixth Modified Example

A contact device 40 shown in FIG. 31 may be used.

In this modified example, busbars 440A and 440B having substantially the same shape as that of the busbars 440A and 440B described in the second embodiment are used.

The first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has an approximately square shape in plan view, and is caulked and coupled to the first fixed terminal 420A at a caulking portion 423A of the first fixed terminal 420A. The first extension portion 443A is connected to the first fixed portion 441A and is disposed to the left of the housing 410 so as to extend downward from the left end portion of the first fixed portion 441A. Thus, in this modified example, the first extension portion 443A overlaps with the first fixed terminal 420A to which the first fixed portion 441A having the first extension portion 443A connected thereto is fixed, as viewed from one side in the main current direction (right-left direction) of the current flowing through the movable contactor 430.

The first electric path piece (first electric path portion) 445A is connected to the first extension portion 443A and is disposed behind the housing 410 so as to extend to the right (second fixed terminal 420B side as viewed from the first fixed terminal 420A) from the lower end of the extension portion 443A.

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has an approximately square shape in plan view, and is caulked and coupled to the second fixed terminal 420B at a caulking portion 423B of the second fixed terminal 420B. The second extension portion 443B is connected to the second fixed portion 441B and is disposed to the right of the housing 410 so as to extend downward from the right end of the second fixed portion 441B. Thus, in this modified example, the second extension portion 443B overlaps with the second fixed terminal 420B to which the second fixed portion 441B having the second extension portion 443B connected thereto is fixed, as viewed from one side in the main current direction (right-left direction) of the current flowing through the movable contactor 430.

The movable contactor 430 is disposed between the first and second electric path pieces 445A and 445B as viewed from one side of the moving direction (vertical direction) of the movable contactor 430.

The second electric path piece (second electric path portion) 445B is connected to the second extension portion 443B and is disposed in front of the housing 410 so as to extend to the left (first fixed terminal 420A side as viewed from the second fixed terminal 420B) from the lower end of the second extension portion 443B.

In this modified example, the first yoke 496 is not fixed to the tip portion (upper end portion) of the shaft 380, and is fixed to the housing 410. That is, the first yoke 496 is provided in the housing 410 so that the relative position thereof is fixed with respect to the housing 410.

Figure 31A:
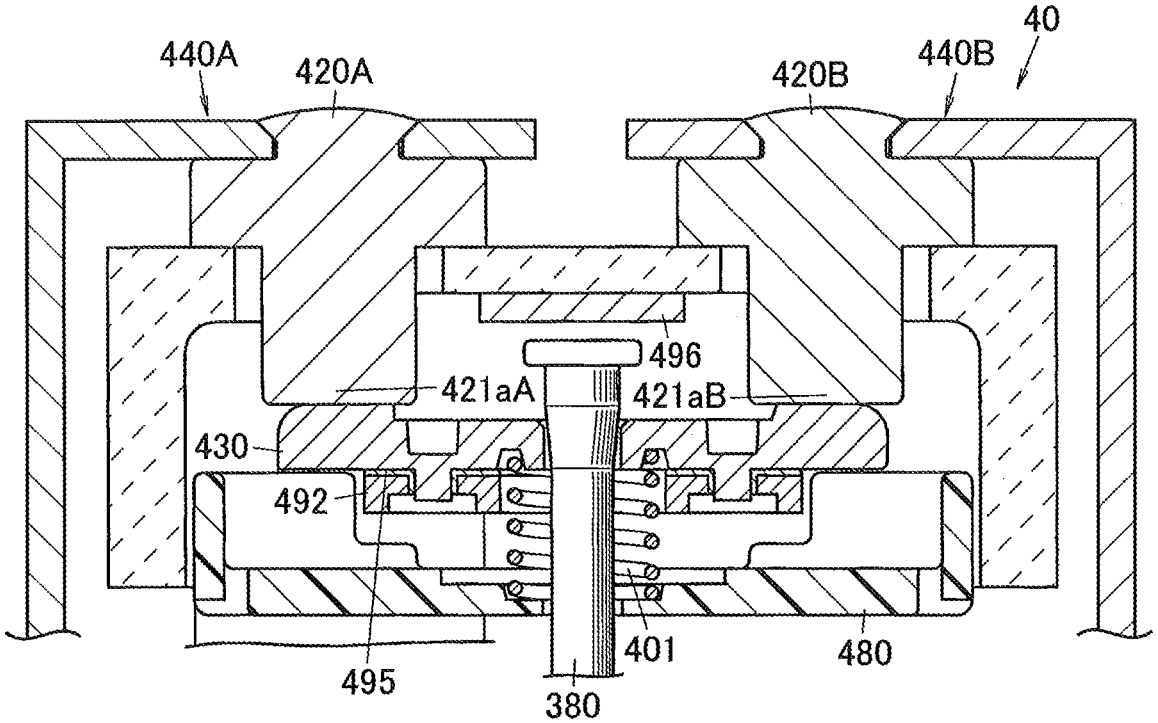
Figure 31B:
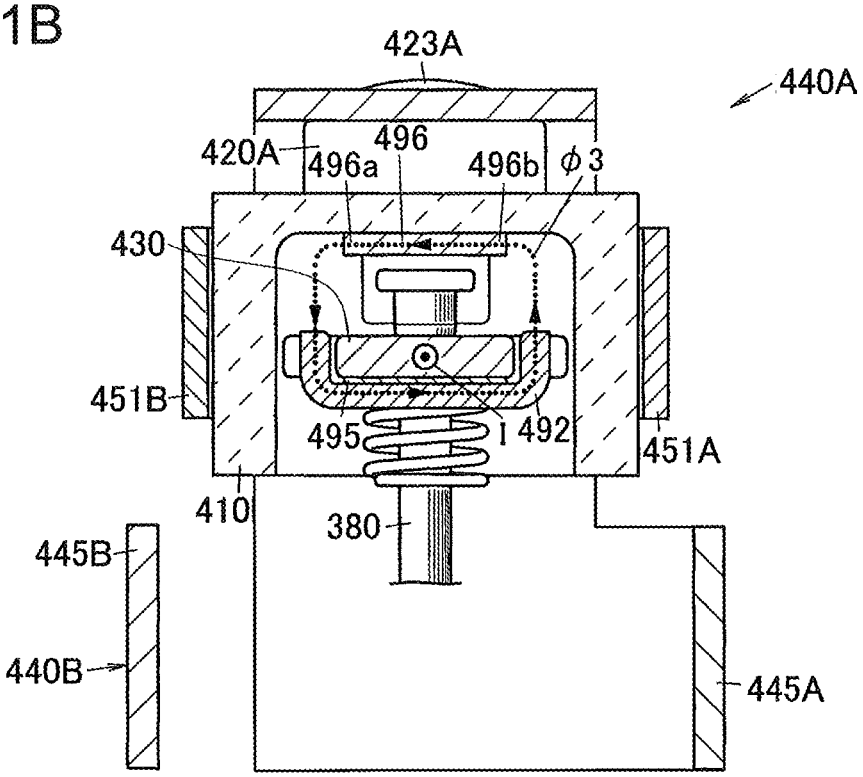
FIG. 31B is a longitudinal sectional view taken along the plane extending in a direction perpendicular to the alignment direction of the first and second fixed terminals and the moving direction of the movable contactor, for explaining the first yoke according to the sixth modified example of the second embodiment.

The first yoke 496 is fixed to a part of the inner circumferential surface of the housing 410, as shown in FIGS. 31A and 31B. In FIGS. 31A and 31B, the first yoke 496 is fixed at a position above the movable contactor 430 and opposed to the movable contactor 430. In this way, as shown in FIG. 31B, when the current I flows to the right (the second fixed terminal 420B side as viewed from the first fixed terminal 420A) through the movable contactor 430, a counterclockwise magnetic flux φ3 is generated around the movable contactor 430 as viewed from the right (see FIG. 31B). This magnetic flux φ3 thus generated causes the first and second yokes 496 and 492 to attract each other in the same manner as the first and second yokes 491 and 492 attracting each other in the second embodiment.

Note that the first yoke 496 may be fixed to the outer peripheral surface of the housing 410, or may be fixed to the fixed terminals 420A and 420B housed inside the housing 410.

(5.7) Seventh Modified Example

Figure 32A:
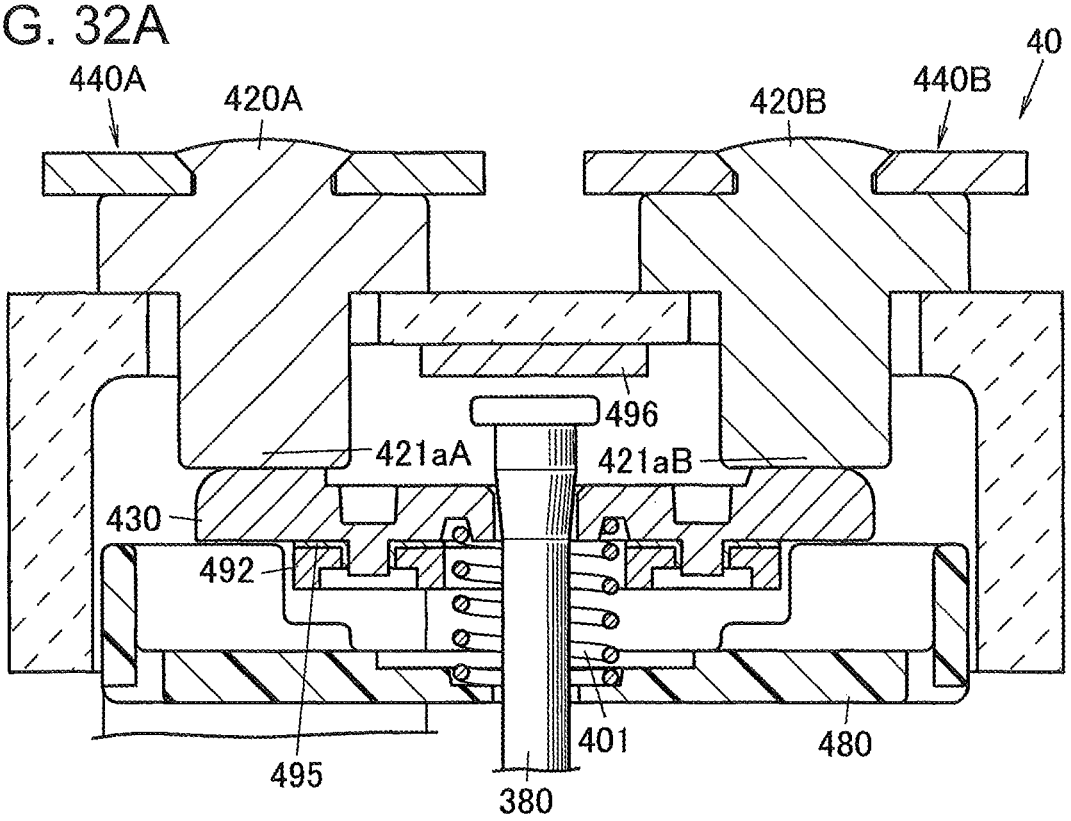

Alternatively, a first yoke 496 may be provided after busbars 440A and 440B shown in FIG. 32 are applied.

That is, the busbars 440A and 440B may be used, in which the extension portions 443A and 443B overlap with the fixed terminals 420A and 420B to which the fixed portions 441A and 441B having the extension portions 443A and 443B connected thereto are fixed, as viewed from one side of the direction (front-rear direction) perpendicular to both of the main current direction (right-left direction) of the current flowing through the movable contactor 430 and the direction (vertical direction) of the current flowing through the fixed terminals 420A and 420B.

Figure 32B:
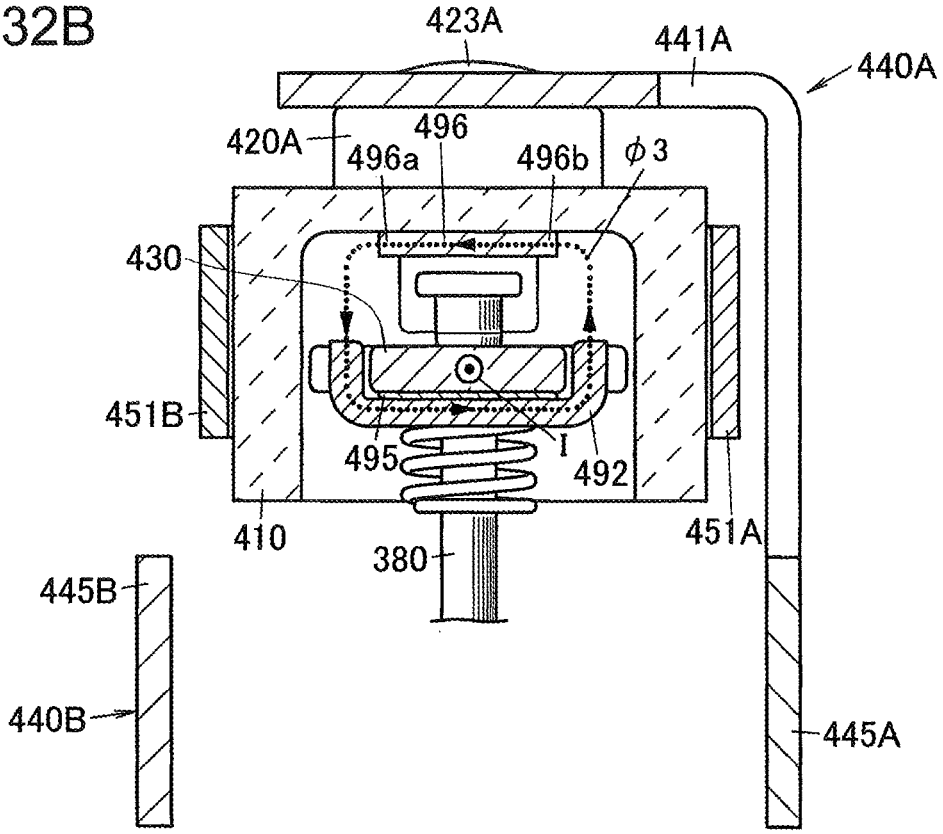
FIG. 32B is a longitudinal sectional view taken along the plane extending in a direction perpendicular to the alignment direction of the first and second fixed terminals and the moving direction of the movable contactor, for explaining the first yoke according to the seventh modified example of the second embodiment.

As in the case of FIG. 31, the first yoke 496 may be fixed to the housing 410, rather than to the tip portion (upper end portion) of the shaft 380. In this way, again, as shown in FIG. 32B, when the current I flows to the right (the second fixed terminal 420B side as viewed from the first fixed terminal 420A) through the movable contactor 430, a counterclockwise magnetic flux φ3 is generated around the movable contactor 430 as viewed from the right (see FIG. 32B). This magnetic flux φ3 thus generated causes the first and second yokes 496 and 492 to attract each other in the same manner as the first and second yokes 491 and 492 attracting each other in the second embodiment.

Note that the first yoke 496 may be fixed to the outer peripheral surface of the housing 410, or may be fixed to the fixed terminals 420A and 420B housed inside the housing 410.

(5.8) Eighth Modified Example

Figure 33:
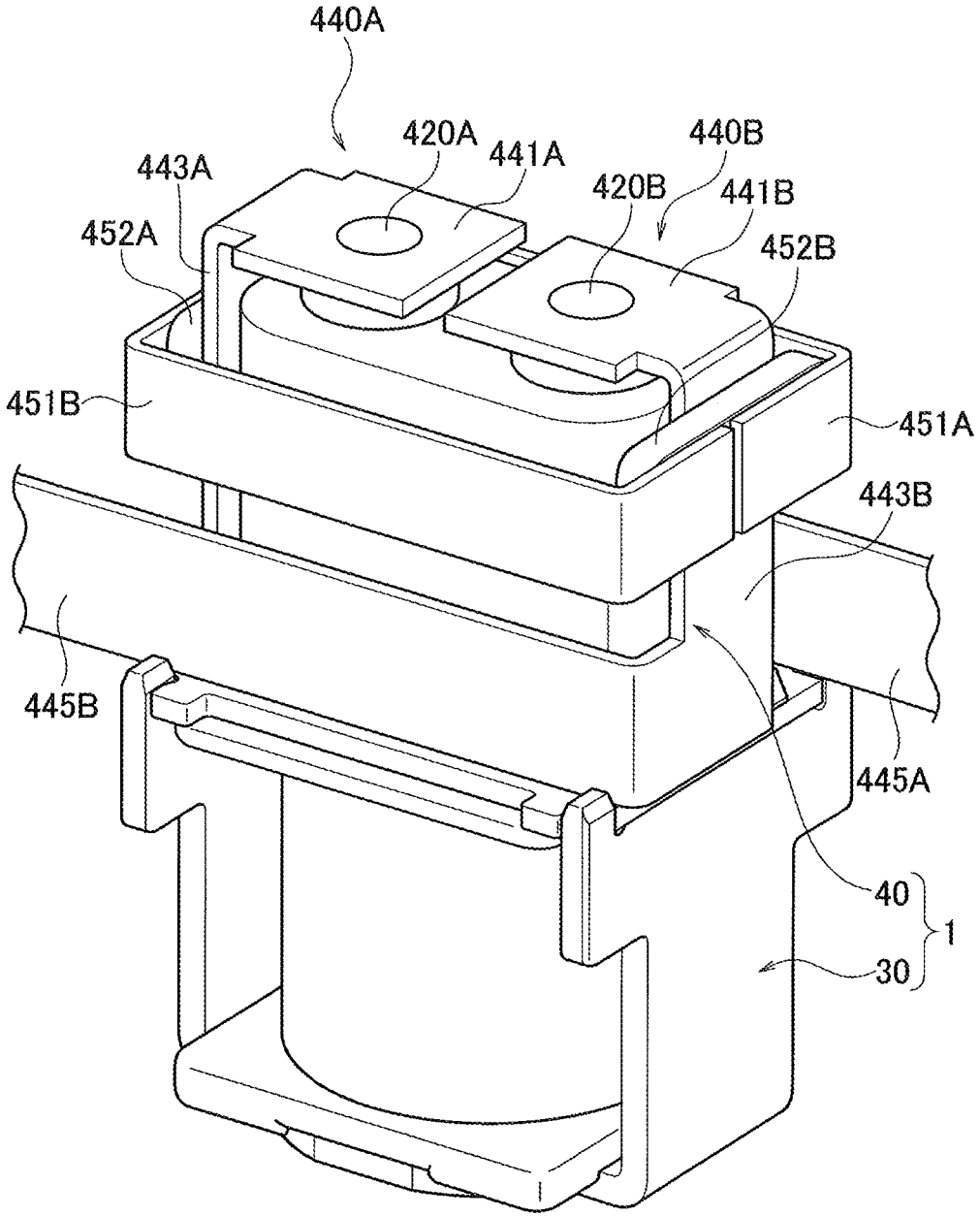
FIG. 33 is a perspective view of an electromagnetic relay according to an eighth modified example of the second embodiment.

A contact device 40 shown in FIG. 33 may be used.

In this modified example, busbars 440A and 440B having substantially the same shape as that of the busbars 440A and 440B described in the second embodiment are used.

The first busbar 440A includes a first fixed portion 441A, a first extension portion 443A, and a first electric path piece (first electric path portion) 445A. The first fixed portion 441A is mechanically connected to the first fixed terminal 420A. To be more specific, the first fixed portion 441A has an approximately square shape in plan view, and is caulked and coupled to the first fixed terminal 420A at a caulking portion 423A of the first fixed terminal 420A. The first extension portion 443A is connected to the first fixed portion 441A and is disposed to the left of the housing 410 so as to extend downward from the left end portion of the first fixed portion 441A. Thus, in this modified example, the first extension portion 443A overlaps with the first fixed terminal 420A to which the first fixed portion 441A having the first extension portion 443A connected thereto is fixed, as viewed from one side in the main current direction (right-left direction) of the current flowing through the movable contactor 430.

The first electric path piece (first electric path portion) 445A is connected to the first extension portion 443A and is disposed behind the housing 410 so as to extend to the right (second fixed terminal 420B side as viewed from the first fixed terminal 420A) from the lower end of the extension portion 443A.

On the other hand, the second busbar 440B includes a second fixed portion 441B, a second extension portion 443B, and a second electric path piece (second electric path portion) 445B. The second fixed portion 441B is mechanically connected to the second fixed terminal 420B. To be more specific, the second fixed portion 441B has an approximately square shape in plan view, and is caulked and coupled to the second fixed terminal 420B at a caulking portion 423B of the second fixed terminal 420B. The second extension portion 443B is connected to the second fixed portion 441B and is disposed to the right of the housing 410 so as to extend downward from the right end of the second fixed portion 441B. Thus, in this modified example, the second extension portion 443B overlaps with the second fixed terminal 420B to which the second fixed portion 441B having the second extension portion 443B connected thereto is fixed, as viewed from one side in the main current direction (right-left direction) of the current flowing through the movable contactor 430.

The movable contactor 430 is disposed between the first and second electric path pieces 445A and 445B as viewed from one side of the moving direction (vertical direction) of the movable contactor 430.

The second electric path piece (second electric path portion) 445B is connected to the second extension portion 443B and is disposed in front of the housing 410 so as to extend to the left (first fixed terminal 420A side as viewed front the second fixed terminal 420B) from the lower end of the second extension portion 443B.

In this modified example, as shown in FIG. 33, the extension portions 443A and 443B of the busbars 440A and 440B are positioned between the capsule yokes 451A and 451B and the housing 410 as viewed from above (one side of the moving direction of the movable contactor 430). Furthermore, in this modified example, the extension portions 443A and 443B of the busbars 440A and 440B are positioned between the arc-extinguishing magnet 452A and the housing 410 as viewed from above (one side of the moving direction of the movable contactor 430).

On the other hand, the electric path pieces 445A and 445B are also positioned between the capsule yokes 451A and 451B and the housing 410 as viewed from above.

With such a configuration, the electric path pieces 445A and 445B can be brought closer to the movable contactor 430 as compared with the case Where the extension portions 443A and 443B are located outside the capsule yokes 451A and 451B. Thus, a larger repulsion force can be generated. Therefore, the contact device 40 shown in FIG. 33 can further increase the force pushing up the movable contactor 430, that is, the force pressing the movable contacts 431A and 431B against the fixed contacts 421*a*A and 421*a*B.

(5.9) Ninth Modified Example

Figure 34:
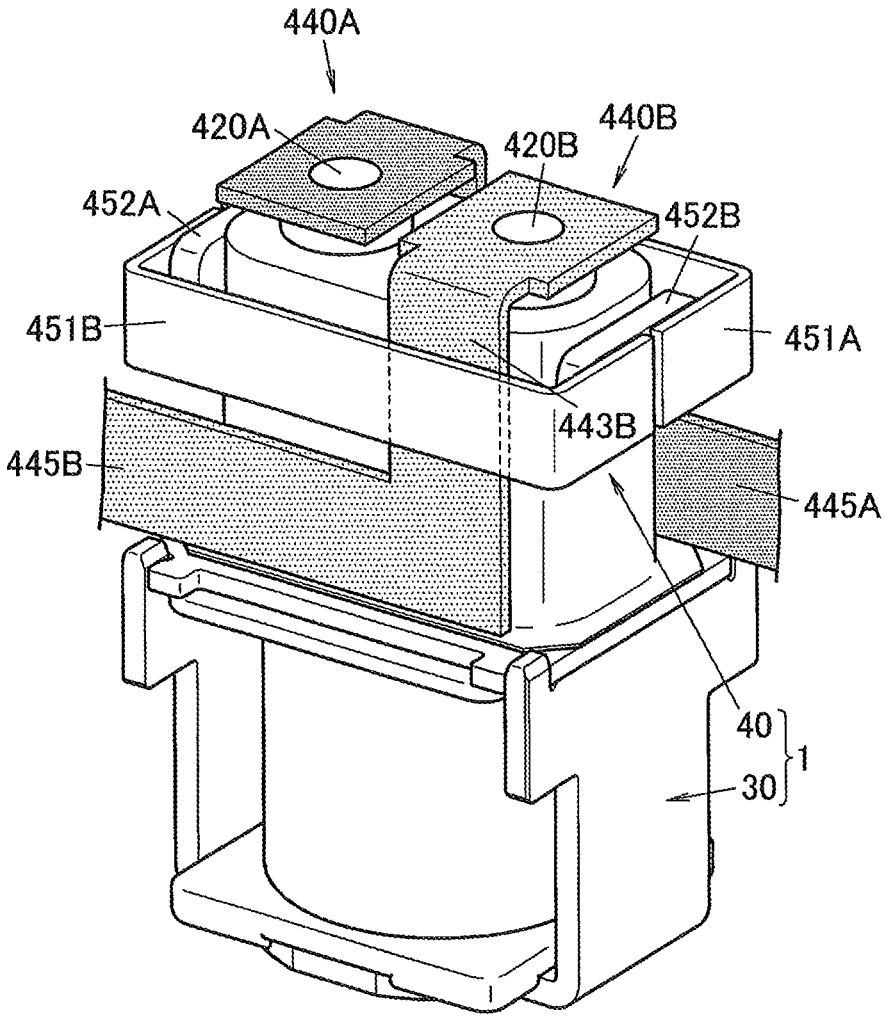
FIG. 34 is a perspective view of an electromagnetic relay according to a ninth modified example of the second embodiment.

Alternatively, the extension portions 443A and 443B may be disposed inside the capsule yokes 451A and 451B after busbars 440A and 440B shown in FIG. 34 are applied.

That is, the busbars 440A and 440B may be used, in which the extension portions 443A and 443B overlap with the fixed terminals 420A and 420B to which the fixed portions 441A and 441B having the extension portions 443A and 443B connected thereto are fixed, as viewed from one side of the direction (front-rear direction) perpendicular to both of the main current direction (right-left direction) of the current flowing through the movable contactor 430 and the direction (vertical direction) of the current flowing through the fixed terminals 420A and 420B.

As shown in FIG. 33, the first extension portion 443A of the first busbar 440A is positioned between the capsule yoke 451A and the housing 410 as viewed from above (one side of the moving direction of the movable contactor 430). Likewise, the second extension portion 443B of the second busbar 440B is positioned between the capsule yoke 451B and the housing 410 as viewed from above (one side of the moving direction of the movable contactor 430).

The first electric path piece 445A is also positioned between the capsule yoke 451A and the housing 410 as viewed from above. Likewise, the second electric path piece 445B is also positioned between the capsule yoke 451B and the housing 410 as viewed from above.

With such a configuration, the force pressing the movable contacts 431A and 431B against the fixed contacts 421*a*A and 421*a*B can still be further increased.

(5.10) Tenth Modified Example

Figure 35B:
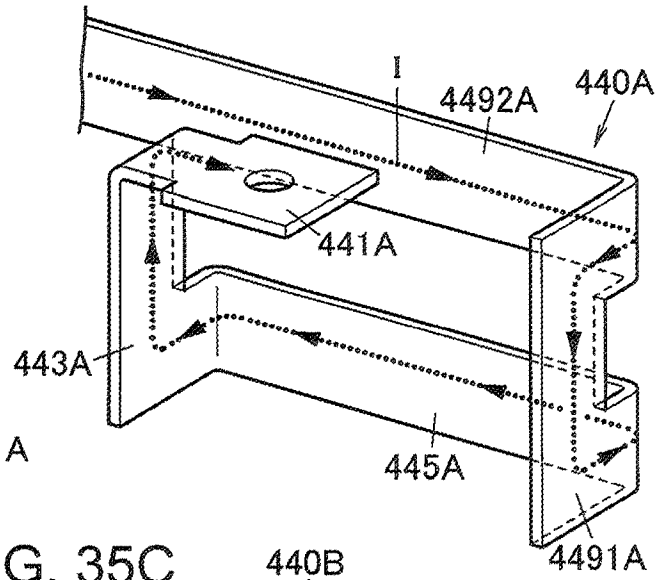
FIG. 35B is a diagram for explaining a first conductive member in a contact device included in the electromagnetic relay according to the tenth modified example of the second embodiment.
Figure 35C:
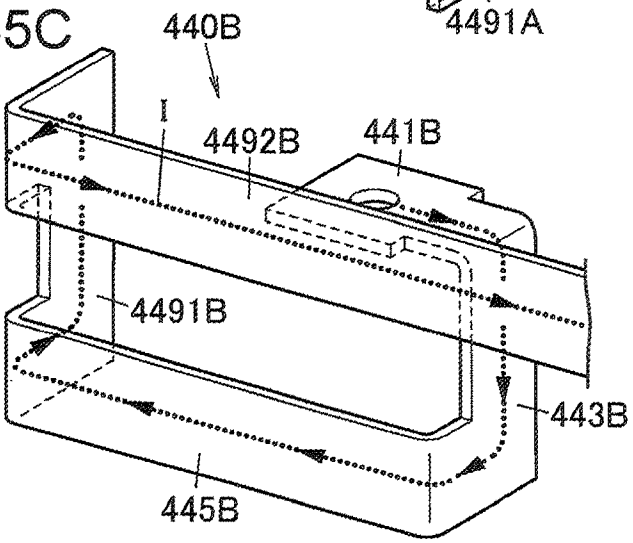
FIG. 35C is a diagram for explaining a second conductive member in the contact device included in the electromagnetic relay according to the tenth modified example of the second embodiment.
Figure 35A:
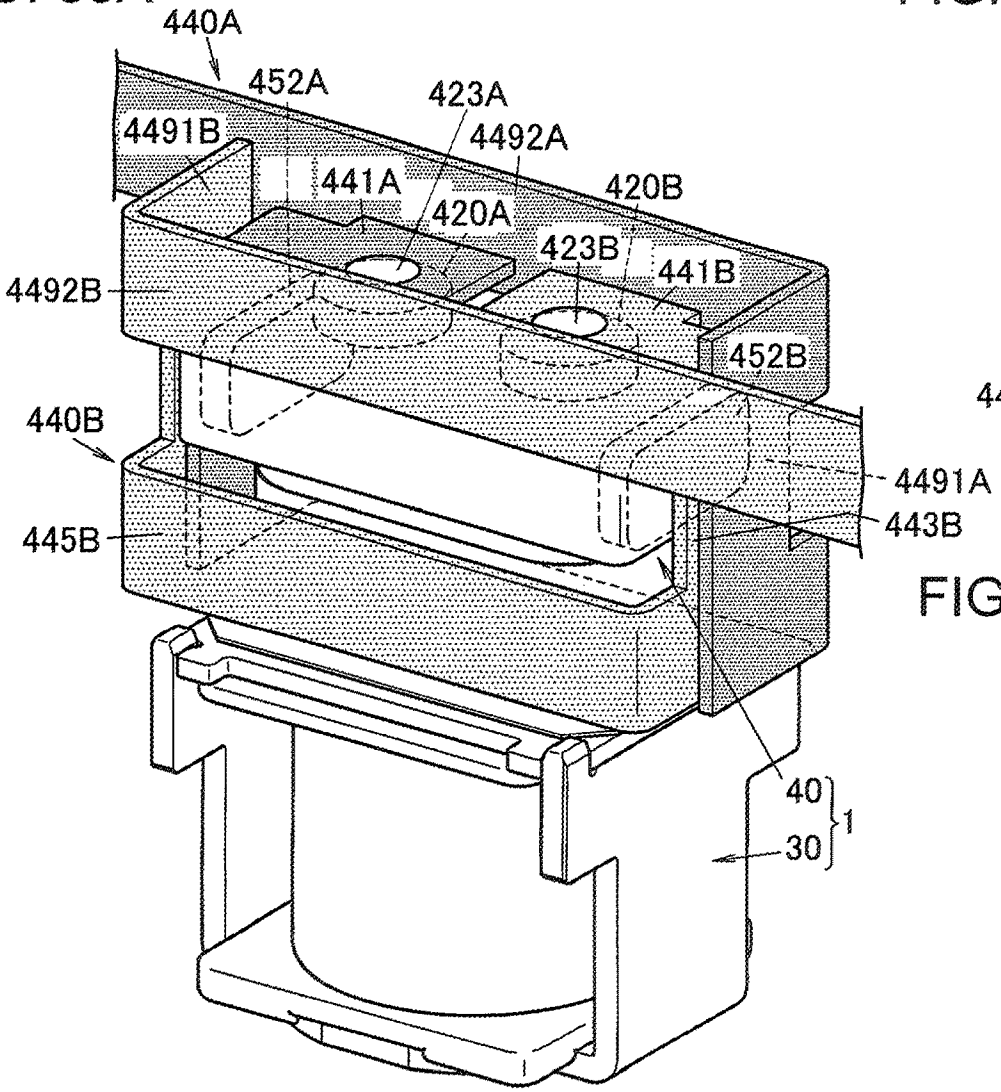
FIG. 35A is a perspective view of an electromagnetic relay according to a tenth modified example of the second embodiment.
Figure 36:
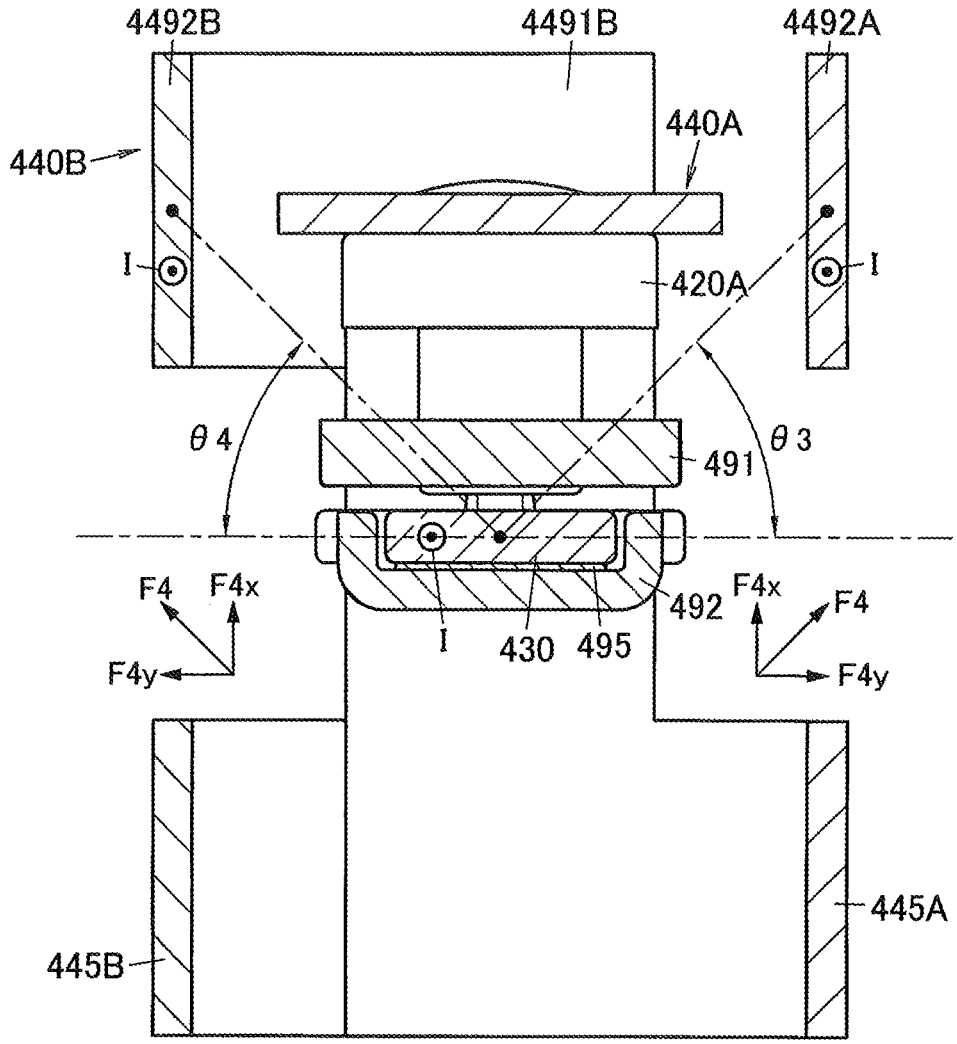
FIG. 36 is a diagram for explaining a positional relationship between the conductive member and the movable contactor included in the contact device according to the tenth modified example of the second embodiment, and for explaining an attractive force generated between the conductive member and the movable contactor.

Instead of the busbars 440A and 440B described in the second embodiment, busbars 440A and 440B shown in FIGS. 35A to 36 may be applied.

A contact device 40 according to this modified example is different from the second embodiment in that another electric path piece is provided above the electric path pieces 445A and 445B.

To be more specific, the first busbar 440A includes a first fixed portion 441A, a first extension portion 443A, a first electric path piece (first electric path portion) 445A, a first connection piece 4491A, and a first upper electric path piece 4492A (see FIG. 35B).

As described above, the first busbar 440A shown in FIGS. 35A to 36 is different from the first busbar 440A described in the second embodiment in further including the first connection piece 4491A and the first upper electric path piece 4492A.

The first connection piece 4491A is connected to the first electric path piece 445A and is disposed on a straight line connecting the first fixed terminal 420A to the second fixed terminal 420B so as to extend upward from the right end of the first electric path piece 445A. The first upper electric path piece 4492A is connected to the first connection piece 4491A and is disposed behind the housing 410 so as to extend leftward from the upper end portion of the first connection piece 4491A. The thickness direction of each of the first connection piece 4491A and the first upper electric path piece 4492A is perpendicular to the moving direction (vertical direction) of the movable contactor 430 (see FIG. 35A).

On the other hand, the second busbar 440B includes a second fixed portion 441B, a second extension portion 443B, a second electric path piece (second electric path portion) 445B, a second connection piece 4491B, and a second upper electric path piece 4492B (see FIG. 35B).

As described above, the second busbar 440B shown in FIGS. 35A to 36 is different from the second busbar 440B described in the second embodiment in further including the second connection piece 4491B and the second upper electric path piece 4492B.

The second connection piece 4491B is connected to the second electric path piece 445B and is disposed on a straight line connecting the first fixed terminal 420A to the second fixed terminal 420B so as to extend upward from the left end of the second electric path piece 445B. The second upper electric path piece 4492B is connected to the second connection piece 449B and is disposed in front of the housing 410 so as to extend rightward from the upper end portion of the second connection piece 449B. The thickness direction of each of the second connection piece 4491B and the second upper electric path piece 4492B is perpendicular to the moving direction (vertical direction) of the movable contactor 430 (see FIG. 35A).

When the movable contactor 430 is located in the closed position, the upper electric path pieces 4492A and 4492B are positioned on the same side as the fixed contacts 421*a*A and 421*a*B with respect to the movable contactor 430 as viewed from one side in the front-rear direction. In other words, the upper electric path pieces 4492A and 4492B are located on the same side as the fixed contacts 421*a*A and 421*a*B with respect to the movable contactor 430 in the moving direction (vertical direction) of the movable contactor 430. The upper electric path pieces 4492A and 4492B are disposed substantially in parallel with the movable contactor 430 on the outside of the housing 410 so as to have such a positional relationship.

Furthermore, lengths of the first and second upper electric path pieces 4492A and 4492B are equal to or greater than the distance L11 between the first and second movable contacts 431A and 431B (see FIGS. 16A and 16B).

The first upper electric path piece 4492A extends (protrudes) to the left from the first connection piece 4491A, while the second upper electric path piece 4492B extends (protrudes) to the right from the second connection piece 4491B. Here, as in the case of the second embodiment, it is assumed that the current I flows through the movable contactor 430 from the first fixed terminal 420A toward the second fixed terminal 420B. In this event, the current I flows through the first upper electric path piece 4492A, the first connection piece 4491A, the first electric path piece 445A, the first extension portion 443A, the first fixed portion 441A, the first fixed terminal 420A, the movable contactor 430, the second fixed terminal 420B, the second fixed portion 441B, the second extension portion 443B, the second electric path piece 445B, the second connection portion 4491B, and the second upper electric path piece 4492B in this order (see FIGS. 35A to 35C).

In the upper electric path pieces 4492A and 4492B, the current I flows to the right (the second fixed terminal 420B side as viewed from the first fixed terminal 420A). Meanwhile, the current I flows to the right in the movable contactor 430. On the other hand, when the current I flows through the movable contactor 430 from the second fixed terminal 420B toward the first fixed terminal 420A, the current I flows to the left in the upper electric path pieces 4492A and 4492B, and also flows to the left in the movable contactor 430.

That is, the direction of the current I flowing through the first upper electric path piece 4492A and the second upper electric path piece is the same as the direction of the current I flowing through the movable contactor 430, since the first upper electric path piece 4492A and the second upper electric path piece 4492B extend (protrude) in the opposite directions from the connection pieces 4491A and 4491B.

As described above, in this modified example, the busbars 440A and 440B include the electric path pieces 445A and 445B. Therefore, the repulsion force F1 (see FIG. 13A) generated between the first electric path piece 445A and the movable contactor 430 and between the second electric path piece 445B and the movable contactor 430 increases the force of the movable contactor 430 pushing up the fixed contacts 421*a*A and 421*a*B.

Furthermore, in this modified example, the busbars 440A and 440B include the upper electric path pieces 4492A and 4492B. Therefore, the force moving the movable contactor 430 downward can be reduced.

Furthermore, in this modified example, the upper electric path pieces 4492A and 4492B are forward electrical path portions through which the current I flows in the same direction as the current I flowing through the movable contactor 430. Therefore, when an abnormal current such as a short-circuit current, for example, flows through the contact device 40, an attractive force F4 is generated between the first upper electric path piece 4492A and the movable contactor 430 and between the second upper electric path piece 4492B and the movable contactor 430 (see FIG. 36). The "attractive three F4" in the present disclosure is a force attracting each other among the forces acting between the movable contactor 430 and the upper electric path pieces 4492A and 4492B. Such an attractive force F4 is received by the current I flowing through the movable contactor 430 and the upper electric path pieces 4492A and 4492B by the Lorentz force. In FIG. 36, the current I is indicated at a position shifted, from the central point of the cross-section of the movable contactor 430 so that the central point of the cross-section of the movable contactor 430 does not overlap with the notation of the current I. This, however, is not intended to specify the position where the current I actually flows. The same goes for the notation of the current I flowing through the upper electric path pieces 4492A and 4492B.

In this modified example, when the movable contactor 430 is located in the closed position, the movable contactor 430 is positioned below the upper electric path pieces 4492A and 4492B in the moving direction (vertical direction) of the movable contactor 430 (see FIG. 36). The upper electric path pieces 4492A and 4492B are fixed to the fixed terminals 420A and 420B and thus do not move relative to the housing 410. On the other hand, the movable contactor 430 is movable in the vertical direction with respect to the housing 410. Therefore, a force component F4*x* in the vertical direction, rather than a force component F4*y* in the front-rear direction, of the attractive force F4 is applied to the movable contactor 430 (see FIG. 36). As a result, the force pushing up the movable contactor 430, that is, the force pressing the movable contacts 431A and 431B against the fixed contacts 421*a*A and 421*a*B is increased.

Therefore, even when an abnormal current such as a short-circuit current, for example, flows through the contact device 40, stable connection can be achieved between the movable contacts 431A and 431B and the fixed contacts 421*a*A and 421*a*B.

Moreover, in this embodiment, the thickness direction (front-rear direction) of the electric path pieces 445A, 445B, 4492A, and 4492B is perpendicular to the moving direction (vertical direction) of the movable contactor 430. Thus, in the cross-section perpendicular to the longitudinal direction of the electric path piece 445A, 445B, 4492A, and 4492B, the distance between the central point of the electric path piece 445A (445B, 4492A, or 4492B) and the central point of the movable contactor 430 can be relatively shortened. Therefore, the contact device 40 according to this modified example can generate larger repulsion force F1 (see FIG. 13A) and attractive force F4 between the electric path pieces 445A, 445B, 4492A, and 4492B and the movable contactor 430.

As a result, more stable connection can be achieved between the movable contacts 431A and 431B and the fixed contacts 421*a*A and 421*a*B when an abnormal current such as a short-circuit current, for example, flows through the contact device 40.

Note that, although FIGS. 35A to 36 illustrate the busbars 440A and 440B having the electric path pieces 445A and 445B and the upper electric path pieces 4492A and 4492B, the present invention is not limited to this configuration. For example, the busbars 440A and 440B may have the upper electric path pieces 4492A and 4492B but not the electric path pieces 445A and 445B.

In this case, only the attractive force F4 of the repulsion force F1 and the attractive force F4 is generated between the busbars 440A and 440B and the movable contactor 430.

(5.11) Eleventh Modified Example

Figure 37:
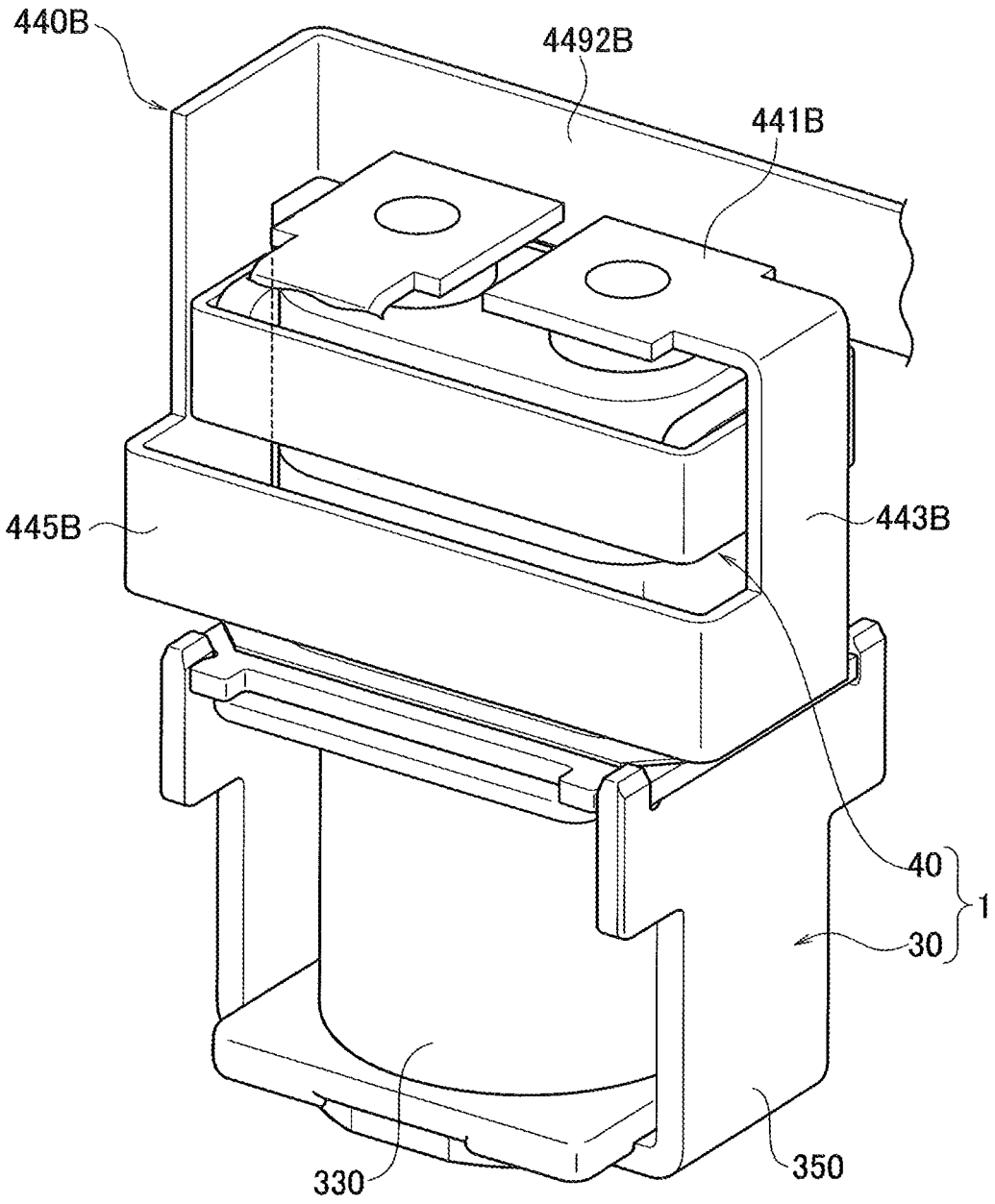
FIG. 37 is a perspective view of an electromagnetic relay according to an eleventh modified example of the second embodiment.

Instead of the busbars 440A and 440B described in the second embodiment, busbars 440A and 440B shown in FIG. 37 may be applied.

A contact device 40 according to this modified example includes the second electric path piece 445B and the second upper electric path piece 4492B, but does not include the first electric path piece 445A and the first upper electric path piece 4492A.

In this modified example, as shown in FIG. 37, the second busbar 440B has a shape wound along an outer peripheral surface of the contact device 40 so as to surround the contact device 40 as viewed from one side of the moving directions (vertical direction) of the movable contactor 430. Note that, in the configuration shown in FIG. 37, the movable contactor 430 is positioned between the second electric path piece 445B and the second upper electric path piece 4492B as viewed from one side of the moving direction (vertical direction) of the movable contactor 430.

In this case, again, an attractive force is generated between the second upper electric path piece 4492B and the movable contactor 430. Thus, stable connection can be achieved between the movable contacts 431A and 431B and the fixed contacts 421*a*A and 421*a*B when an abnormal current flows through the contact device 40.

(5.12) Twelfth Modified Example

Figure 38:
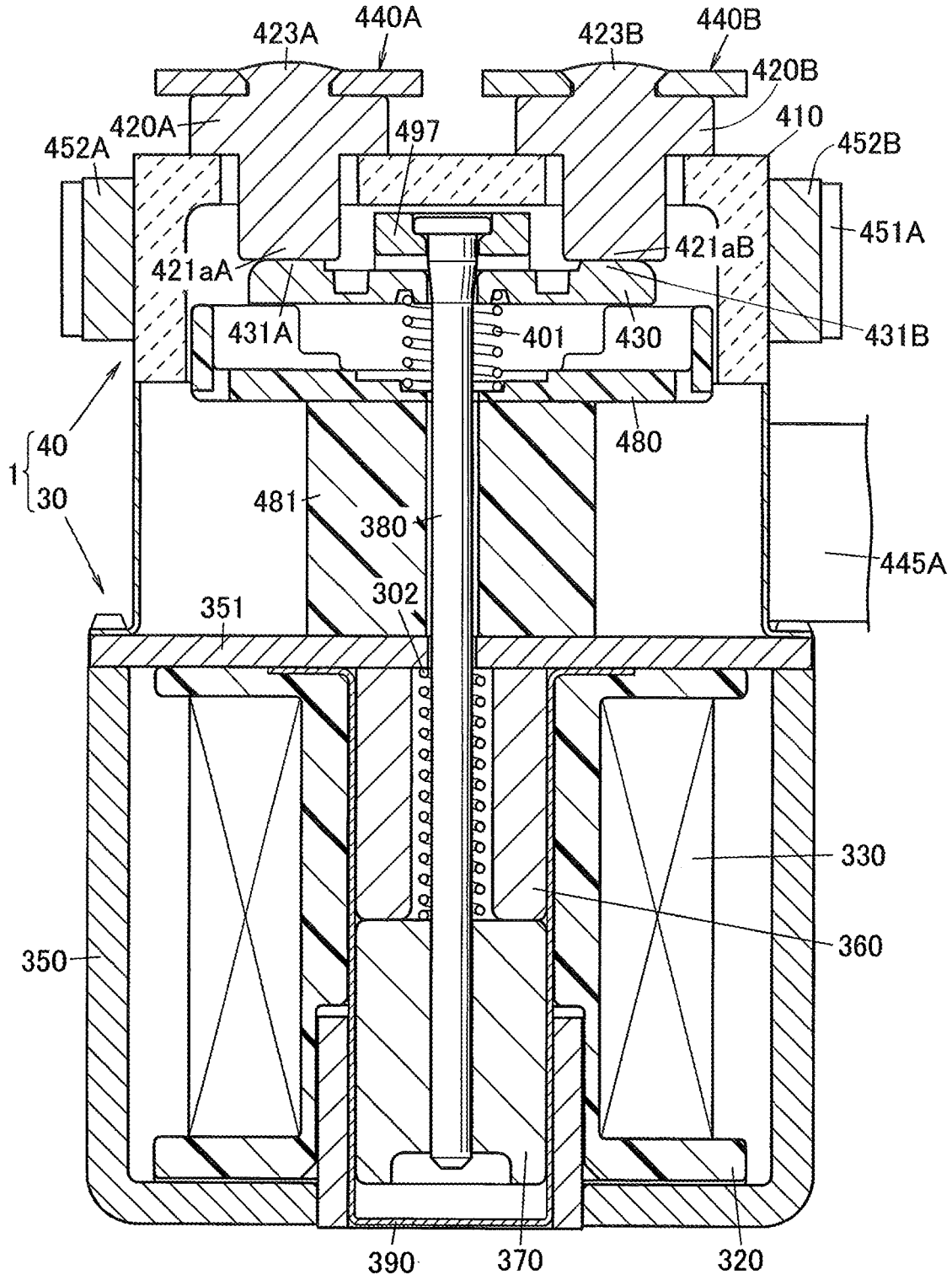
FIG. 38 is a longitudinal sectional view taken along the plane extending in an alignment direction of first and second fixed terminals and a moving direction of a movable contactor, showing an electromagnetic relay according to a twelfth modified example of the second embodiment.
Figure 39:
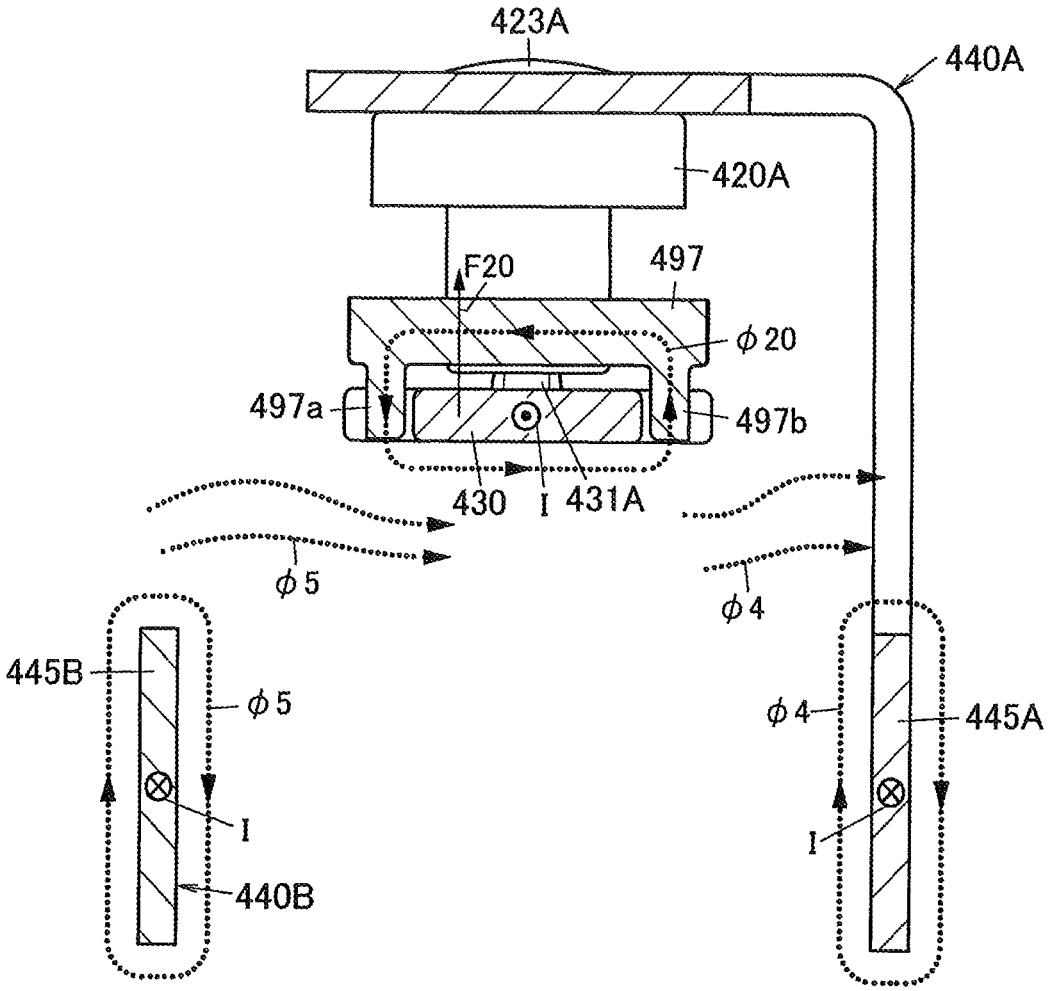
FIG. 39 is a diagram for explaining an upward force applied to the movable contactor in the contact device included in the electromagnetic relay according to the twelfth modified example of the second embodiment.

Alternatively, a contact device 40 shown in FIGS. 38 and 39 may be used.

The contact device 40 according to this modified example is different from the second embodiment in including only a yoke corresponding to the first yoke 491 out of the first and second yokes 491 and 492 described in the second embodiment.

To be more specific, the contact device 40 includes a yoke 497 corresponding to the first yoke 491 (see FIG. 38). That is, the second yoke 492 of the second embodiment is omitted in the contact device 40.

The yoke 497 is a ferromagnetic body and is formed of, for example, a metal material such as iron. The yoke 497 is fixed to the tip (upper end) of the shaft 380 and is located above the movable contactor 430 (see FIG. 38).

When the movable contactor 430 is located in the closed position, a predetermined gap is created between the movable contactor 430 and the yoke 497. Thus, electrical insulation is ensured between the movable contactor 430 and the yoke 497.

The yoke 497 also includes a pair of protrusions 497*a* and 497*b* protruding downward at both end portions in the front-rear direction (see FIG. 39). In other words, the protrusions 497*a* and 497*b* protruding in the same direction as the direction (downward) in which the movable contactor 430 moves from the closed position to the open position are formed at the both end portions in the front-rear direction of the lower surface of the yoke 497.

When the current I flows to the right (the second fixed terminal 420B side as viewed from the first fixed terminal 420A) through the movable contactor 430, a counterclockwise magnetic flux y 20 is generated around the movable contactor 430 as viewed from the right (see FIG. 39). In this event, since the protrusion 497*a* of the yoke 497 serves as an N-pole and the protrusion 497*b* of the yoke 497 serves as an S-pole, the magnetic flux w 20 passing through the movable contactor 430 is directed to the right (the protrusion 497*b* side as viewed from the protrusion 497*a*). Based on the relationship between the rightward current I flowing through the movable contactor 430 and the magnetic flux φ20 passing through the movable contactor 430, an upward Lorentz force F20 acts on the movable contactor 430.

Furthermore, a part of the magnetic flux φ4 generated by the current I flowing through the electric path piece 445A and a part of the magnetic flux φ5 generated by the current I flowing through the electric path piece 445B become a rightward magnetic flux passing through the yoke 497. Thus, the rightward magnetic flux passing through the movable contact 430 is increased, and the upward Lorentz force F20 acting on the movable contactor 430 is increased. Therefore, stable connection can be achieved between the movable contacts 431A and 431B and the fixed contacts 421*a*A and 421*a*B when an abnormal current flows.

Note that, although the yoke 497 includes the protrusions 497*a* and 497*b* in this modified example, providing the protrusions 497*a* and 497*b* in the yoke 497 is not an essential requirement. That is, the yoke 497 may have the same shape as the first yoke 491 described in the second embodiment.

(5.13) Thirteenth Modified Example

Alternatively, a contact device 40 shown in FIG. 40 may be used.

The contact device 40 according to this modified example is different from that of the second embodiment in arrangement of a pair of arc-extinguishing magnets.

To be more specific, the contact device 40 includes two capsule yokes 451*a*A and 451*a*B and two arc-extinguishing magnets 452*a*A and 452*a*B instead of the two capsule yokes 451A and 451B and the two are-extinguishing magnets 452A and 452B described in the second embodiment (see FIGS. 40A and 40B)).

Figure 40A:
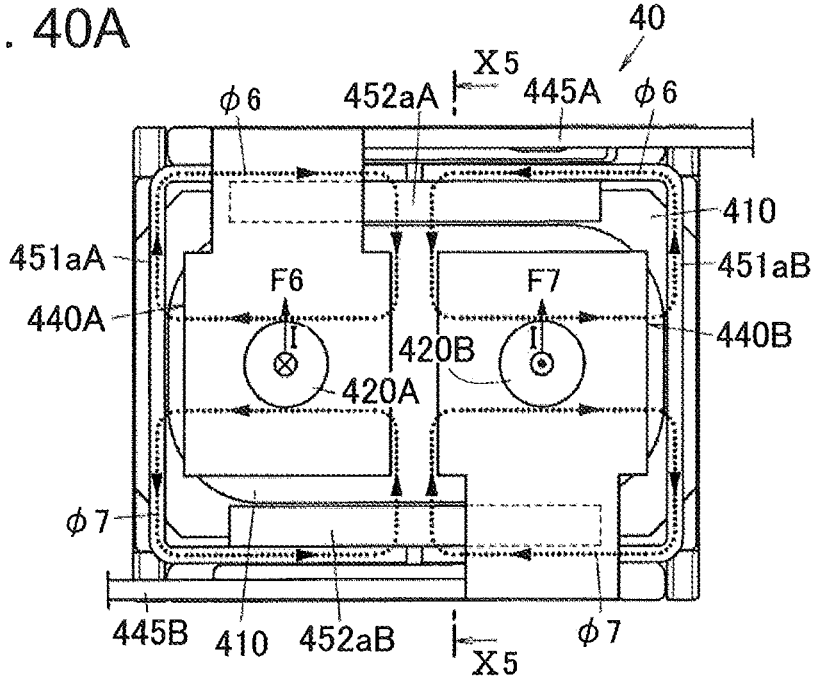

The capsule yokes 451*a*A and 451*a*B are disposed on both sides in the right-left direction with respect to the housing 410 so as to surround the housing 410 from the both sides in the right-left direction (see FIG. 40A).

The arc-extinguishing magnets 452*a*A and 452*a*B are arranged such that the same poles (for example, N-poles) are opposed to each other in the front-rear direction. The arc-extinguishing magnets 452*a*A and 452*a*B are disposed on the both sides of the housing 410 in the front-rear direction. The capsule yokes 451*a*A and 45*a*B surround the housing 410 together with the arc-extinguishing magnets 452*a*A and 452*a*B. That is, the arc-extinguishing magnets 452*a*A and 452*a*B are disposed such that the direction from the arc-extinguishing magnets 452*a*A and 452*a*B to the fixed contacts 421*a*A and 421*a*B does not coincide with the direction of the current flowing through the movable contactor 430, as viewed from one side of the moving directions of the movable contactor 430.

According to the configuration described above, as shown in FIG. 40A, the capsule yoke 45*a*A forms a part of a magnetic circuit through which the magnetic flux φ6 generated by the arc-extinguishing magnet 452*a*A passes, and a part of a magnetic circuit through which the magnetic flux φ7 generated by the arc-extinguishing magnet 452*a*B passes. Likewise, the capsule yoke 451*a*B forms a part of a magnetic circuit through which the magnetic flux φ6 generated by the arc-extinguishing magnet 452*a*A passes, and a part of a magnetic circuit through which the magnetic flux φ7 generated by the are-extinguishing magnet 452*a*B passes. The magnetic fluxes φ6 and φ7 act on contact points between the pair of fixed contacts 421*a*A and 421*a*B and the pair of movable contacts 431A and 431B when the movable contactor 430 is located in the closed position.

In the example shown in FIG. 40A, leftward magnetic fluxes φ6 and φ7 are generated at the first fixed terminal 420A, while rightward magnetic fluxes φ6 and φ7 are generated at the second fixed terminal 420B. It is assumed that a downward current I flows through the first fixed terminal 420A and an upward current I flows through the second fixed terminal 420B. When the movable contactor 430 moves from the closed position to the open position in this state, a downward discharge current (arc) generated from the first fixed contact 421*a*A to the first movable contact 431A between the first fixed contact 421*a*A and the first movable contact 431A. Therefore, a backward Lorentz force F6 acts on the arc due to the magnetic fluxes φ6 and φ7 (see FIG. 40A). That is, the arc generated between the first fixed contact 421*a*A and the first movable contact 431A is pulled rearward to be extinguished. On the other hand, an upward discharge current (arc) is generated from the second movable contact 431B to the second fixed contact 421*a*B between the second fixed contact 421*a*B and the second movable contact 431B. Therefore, a backward Lorentz force F7 acts on the arc due to the magnetic fluxes φ6 and φ7 (see FIG. 40A). That is, the arc generated between the second fixed contact 421*a*B and the second movable contact 431B is pulled rearward to be extinguished.

(5.14) FOURTEENTH MODIFIED EXAMPLE

Alternatively, a contact device 40 shown in FIG. 41 may be used.

Figure 41B:
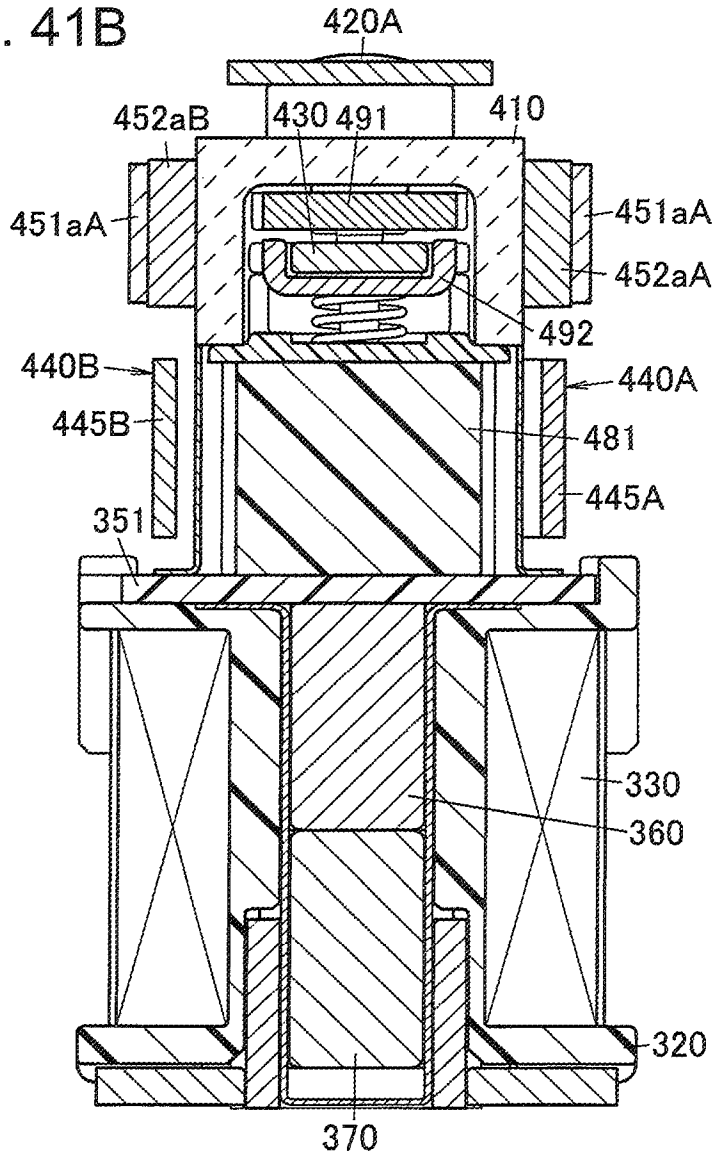
FIG. 41B is a cross-sectional view taken along the line X6-X6 in FIG. 41A.
Figure 41A:
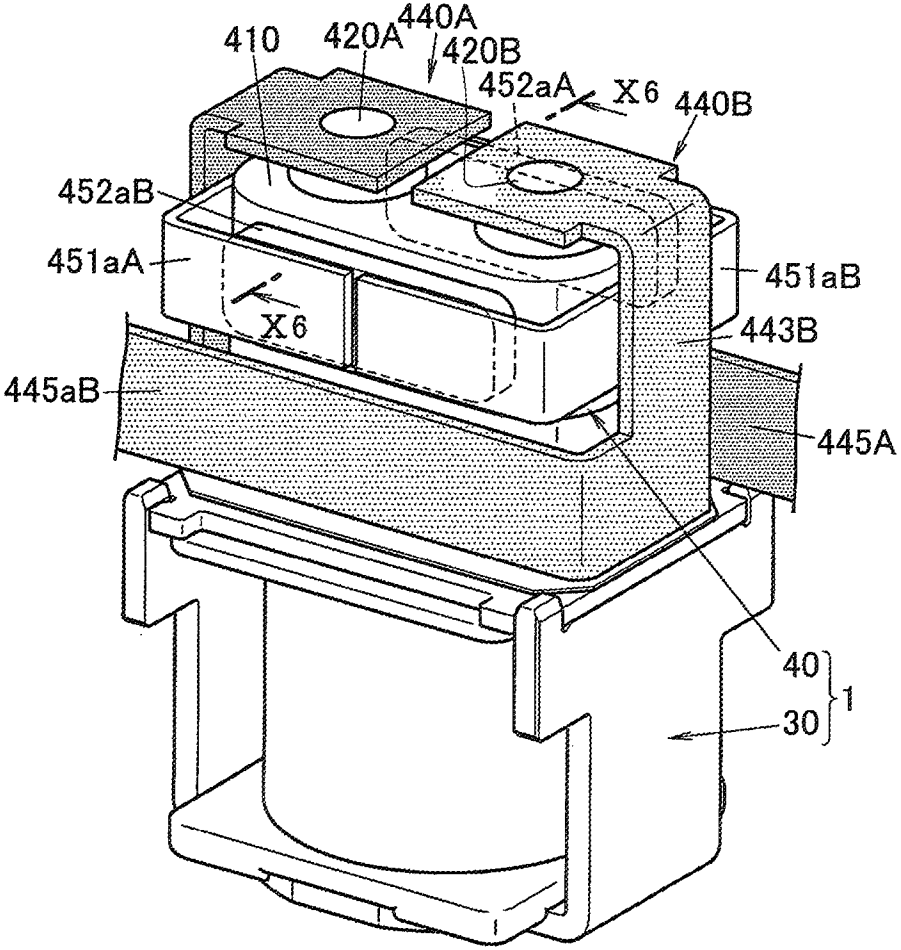

The contact device 40 according to this modified example is different from the contact device 40 shown in FIG. 40A in the configuration of the busbars 440A and 440B as shown in FIGS. 41A and 41B.

To be more specific, the busbars 440A and 440B described in the second embodiment are used in the contact device 40 according to this modified example.

Figure 40B:
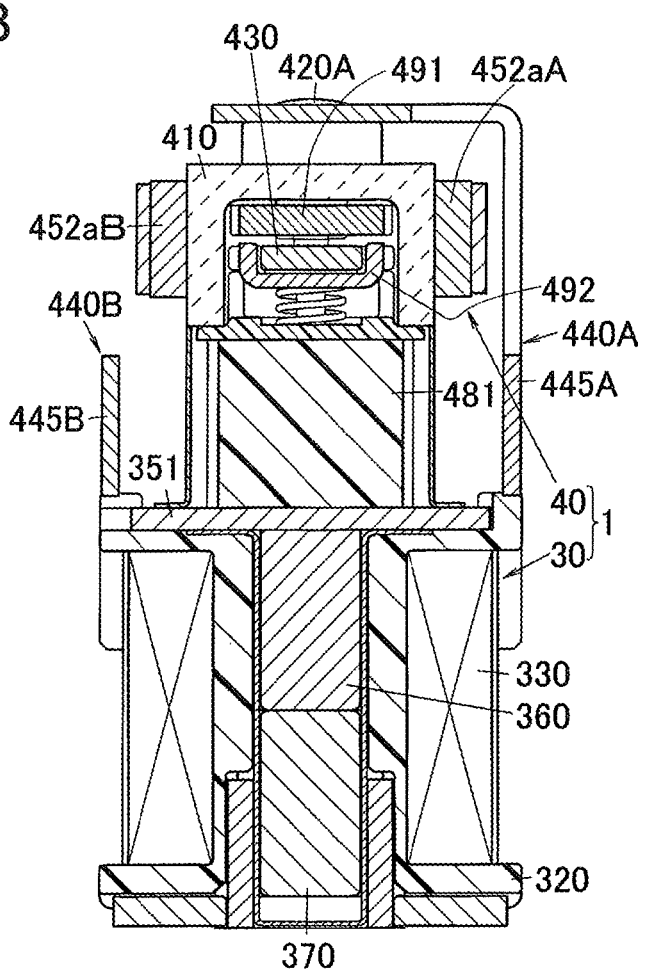
FIG. 40B is a cross-sectional view taken along the line X5-X5 in FIG. 40A.

That is, the contact device 40 according to this modified example include the two capsule yokes 451*a*A and 451*a*B and the two arc-extinguishing magnets 452*a*A and 452*a*B shown in FIGS. 40A and 40B, instead of the two capsule yokes 451A and 451B and the two arc-extinguishing magnets 452A and 452B in the contact device 40 described in the second embodiment.

In this case, the extension portions 443A and 443B are positioned on both sides in the right-left direction of the housing 410 (both sides in the direction in which the two arc-extinguishing magnets 452*a*A and 452*a*B are not disposed) (see FIG. 41A). Therefore, as shown in FIG. 41B, the distance between the first electric path piece 445A connected to the first extension portion 443A and the second electric path piece 445B connected to the second extension portion 443B can be set shorter than the distance between the first and second electric path pieces 445A and 445B in the contact device 40 shown in FIG. 40A (see FIGS. 40B and 41B). Thus, the repulsion force between the electric path pieces 445A and 445B and the movable contactor 430 can be further increased. Therefore, the force pushing up the movable contactor 430 can be increased compared with the contact device 40 shown in FIG. 40A.

(5.15) Fifteenth Modified Example

Figure 42:
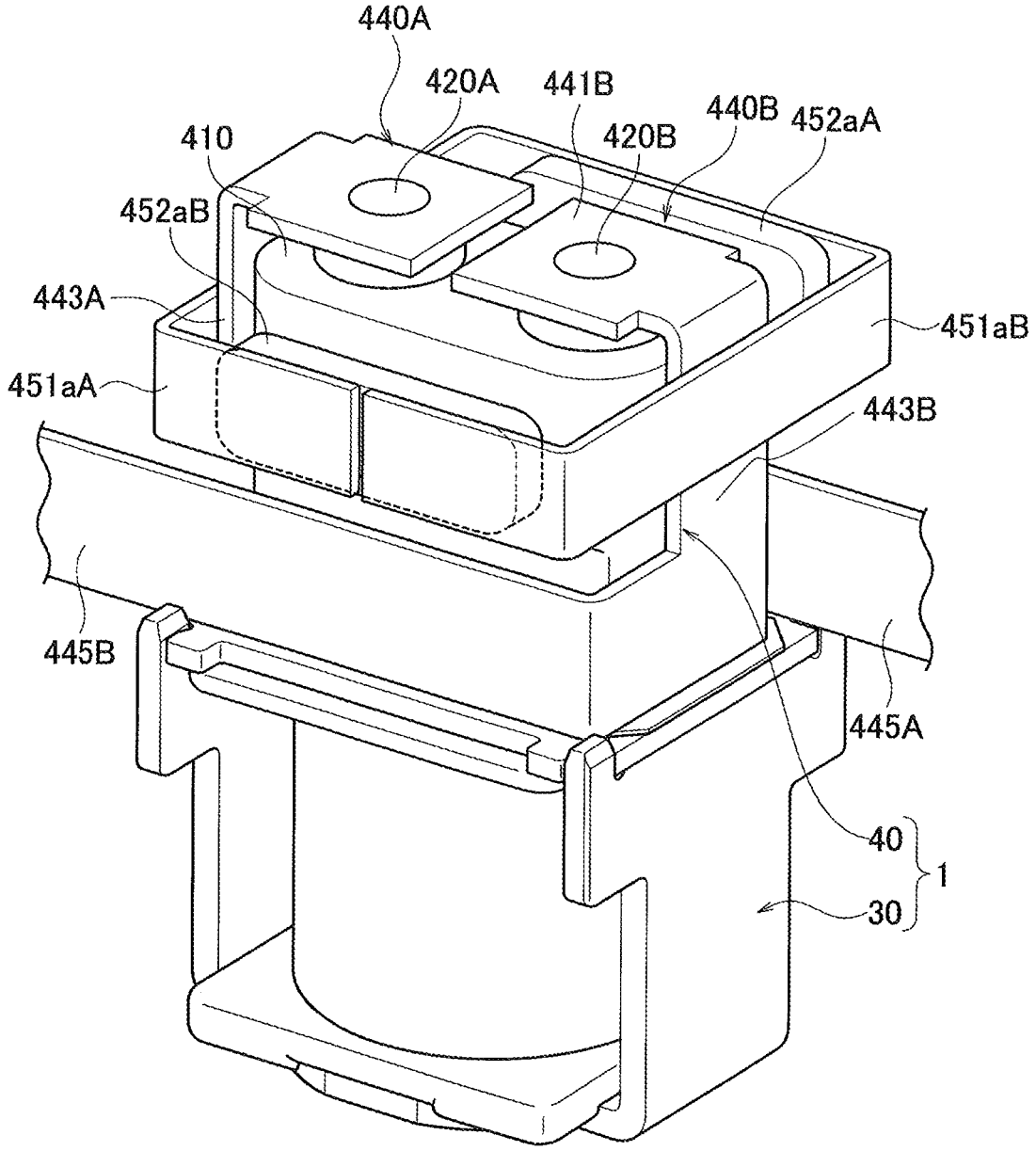
FIG. 42 is a perspective view of an electromagnetic relay according to a fifteenth modified example of the second embodiment.

Alternatively, a contact device 40 shown in FIG. 42 may be used.

In the contact device 40 according to this modified example, again, busbars 440A and 440B having substantially the same shape as those in the contact device 40 shown in FIG. 41A are used.

The first extension portion 443A of the first busbar 440A is positioned between the capsule yoke 451*a*A and the housing 410, while the second extension portion 443*b* of the second busbar 440B is positioned between the capsule yoke 451*a*B and the housing 410 (see FIG. 42).

With such a configuration, the electric path pieces 445A and 445B can be brought closer to the movable contactor 430. Thus, a larger repulsion force can be generated between the electric path pieces 445A and 445B and the movable contactor 430. Therefore, the contact device 40 according to this modified example can further increase the force pushing up the movable contactor 430.

(5.16) Sixteenth Modified Example

Figure 43:
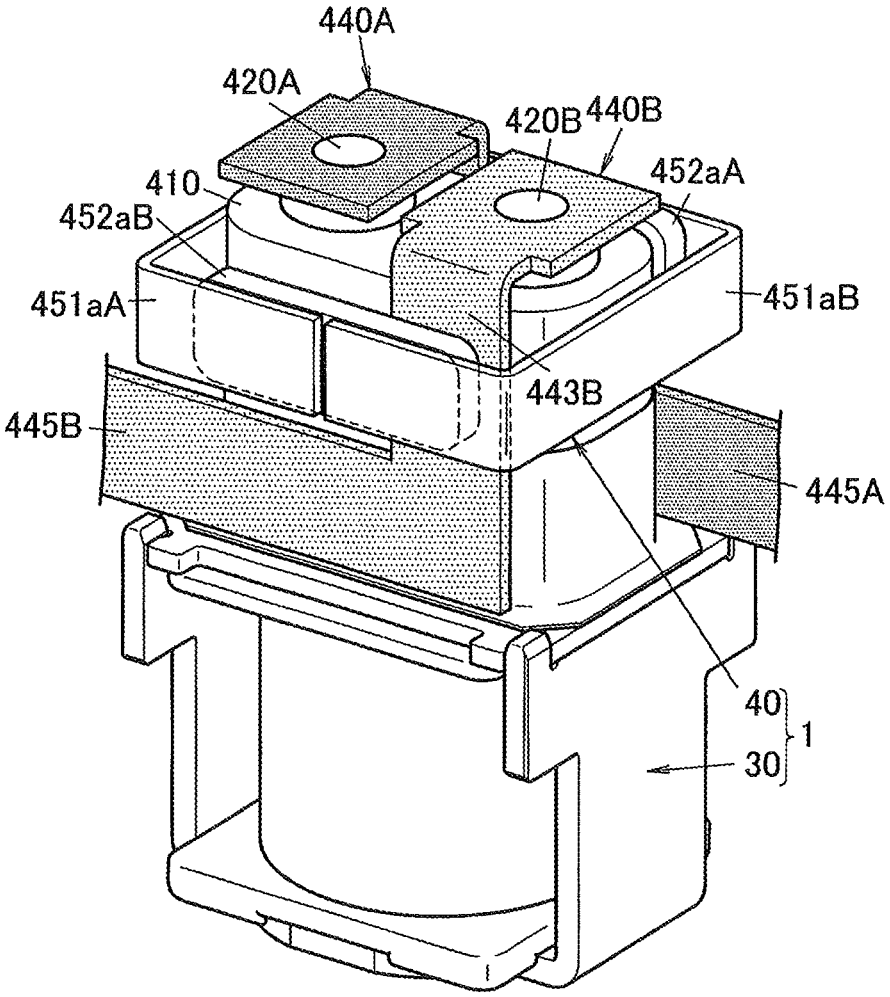
FIG. 43 is a perspective view of an electromagnetic relay according to a sixteenth modified example of the second embodiment.

Alternatively, a contact device 40 shown in FIG. 43 may be used.

In the contact device 40 according to this modified example, busbars 440A and 440B having substantially the same shape as those in the contact device 40 shown in FIG. 40 are used.

The first extension portion 443A of the first busbar 440A is positioned between the arc-extinguishing magnet 452*a*A and the housing 410, while the second extension portion 443*b* of the second busbar 440B is positioned between the arc-extinguishing magnet 452*a*B and the housing 410 (see FIG. 43).

In this case, as shown in FIG. 43, the first electric path piece 445A is positioned between the arc-extinguishing magnet 452*a*A and the movable contactor 430 as viewed from one side of the moving directions of the movable contactor 430. Likewise, as shown in FIG. 43, the second electric path piece 445B is positioned between the arc-extinguishing magnet 452*a*B and the movable contactor 430 as viewed from one side of the moving direction of the movable contactor 430.

Note that, in FIG. 43, the arc-extinguishing magnets 452*a*A and 452*a*B are not coupled to the housing 410, but the capsule yokes 451*a*A and 451*a*B are coupled to the housing 410. To be more specific, one surface (left end face) in the right-left direction of the housing 410 is coupled to the capsule yoke 451*a*A, while the other surface (right end face) in the right-left direction of the housing 410 is coupled to the capsule yoke 451*a*B.

With such a configuration, the electric path pieces 445A and 445B can be brought closer to the movable contactor 430. Thus, a larger repulsion force can be generated between the electric path pieces 445A and 445B and the movable contactor 430. Therefore, the contact device 40 according to this modified example can further increase the force pushing up the movable contactor 430.

OTHER MODIFIED EXAMPLES

Other modified examples are listed below. The modified examples described below can be applied in appropriate combination with the above embodiments (including the modified examples of the embodiments). Moreover, the configurations described in the above embodiments and the modified examples thereof can also be applied in appropriate combination.

For example, in the above embodiments, the housing 410 holds the fixed terminals 420A and 420B in a state where the fixed terminals 420A and 420B are partially exposed. However, the present invention is not limited to this configuration. The housing 410 may accommodate the entire fixed terminals 420A and 420B inside the housing 410. That is, the housing 410 may be configured to accommodate at least the fixed contacts 421*a*A and 421*a*B and the movable contactor 430.

Although the contact device including the capsule yokes has been described in the above embodiments, the contact device does not have to include any capsule yokes. If a capsule yoke is provided, the capsule yoke may weaken the repulsion force between the electric path pieces 445A and 445B and the movable contactor 430. Therefore, such reduction in repulsion force caused by the capsule yoke may be suppressed by omitting the capsule yoke, thus allowing the force pushing up the movable contactor 430 to be further increased.

In the above embodiments, the electromagnetic relay is a so-called normally-off type electromagnetic relay in which the movable contactor 430 is located in the open position when no current is applied to the exciting coil 330. However, a normally-on type electromagnetic relay may be used.

Although the number of the movable contacts held by the movable contactor 430 is two in the above embodiments, the present invention is not limited to this configuration. The number of the movable contacts held by the movable contactor 430 may be one or three or more. Likewise, the number of the fixed terminals (and the fixed contacts) is not limited to two, but may be one or three or more.

Although the electromagnetic relay according to the above embodiments is a holderless-type electromagnetic relay, the present invention is not limited to this configuration but an electromagnetic relay with a holder may be used. Here, the holder has a rectangular cylindrical shape, for example, in which both sides in the right-left direction are open, and the holder is combined with the movable contactor 430 such that the movable contactor 430 penetrates the holder in the right-left direction. A contact pressure spring 401 is disposed between a lower wall of the holder and the movable contactor 430. That is, the central portion in the right-left direction of the movable contactor 430 is held by the holder. The upper end portion of the shaft 380 is fixed to the bolder. When a current is applied to the exciting coil 330, the shaft 380 is pushed up to move the holder upward. Along with this movement, the movable contactor 430 moves upward to position the pair of movable contacts 431A and 431B in the closed position to conic into contact with the pair of fixed contacts 421*a*A and 421*a*B.

Moreover, although the contact device according to the above embodiments is a plunger-type contact device, a hinge-type contact device may be used.

Although the busbars in the above embodiments are configured to be mechanically connected to the fixed terminals 420A and 420B by being caulked and coupled to the fixed terminals 420A and 420B, the busbars may be mechanically connected to the fixed terminals 420A and 420B with screws.

Although the arc-extinguishing magnets in the above embodiments are disposed outside the housing 410 (that is, between the capsule yokes and the housing 410), the present invention is not limited to this configuration. For example, the arc-extinguishing magnets may be disposed inside the housing 410.

In the contact device according to the above embodiments, the yokes, the arc-extinguishing magnets, and the capsule yokes are not essential components.

Such various configurations according to the above embodiments and the modified examples thereof can be applied in appropriate combination with the electrical device M1 according to the second embodiment.

This application claims the benefit of priority from Japanese Patent Application No. 2017-002493 filed on Jan. 11, 2017, the contents of which are herein incorporated by reference in their entireties.

INDUSTRIAL APPLICABILITY

The present disclosure can provide a contact device, an electromagnetic relay and an electrical device capable of further reducing the electromagnetic repulsion force acting between the contacts.

REFERENCE SIGNS LIST

1 electromagnetic relay
10 contact device
30 electromagnetic device (drive unit)
410 housing
410*a* non-magnetic portion
411 top wall (partition member)
420 A first fixed terminal
421*a*A first fixed contact
420B second fixed terminal
421*a*B second fixed contact
440A first busbar (first conductive member)
441A first fixed portion
443A first extension portion
443*a*A upper end
443*b*A lower end
444A first opposed portion
444*a*A upper end
444*b*A lower end
445A first electric path piece (first electric path portion: backward electric path portion)
4492A first upper electric path piece (forward electric path portion)
440B second busbar (second conductive member)
441B second fixed portion
443B second extension portion
443*a*B upper end
443*b*B lower end
444B second opposed portion
444*a*B upper end
444*b*B lower end
445B second electric path piece (second electric path portion: backward electric path portion)
4492B second upper electric path piece (forward electric path portion)
430 movable contactor
431A first movable contact
431B second movable contact
M1 electrical device
M2 inner unit
M3 housing
M21, M22 conductive bar (conductive member)

The invention claimed is:

1. A contact device comprising:

a first fixed terminal including a first fixed contact at one end in a longitudinal direction;

a second fixed terminal including a second fixed contact at one end in a longitudinal direction;

a movable contactor moved relative to at least one of the first fixed contact and the second fixed contact, so as to switch an electrical connection between the first fixed terminal and the second fixed terminal;

a first conductive member including a first fixed portion fixed to another end of the first fixed terminal in the longitudinal direction;

a second conductive member including a second fixed portion fixed to another end of the second fixed terminal in the longitudinal direction; and a partition member to which the first fixed terminal and the second fixed terminal are fixed, the partition member partitioning the one end and the other end of the first fixed terminal in the longitudinal direction and partitioning the one end and the other end of the second fixed terminal in the longitudinal direction, wherein an extension portion is connected to at least one of the first fixed portion and the second fixed portion, the extension portion has an opposed portion opposed to at least one of the fixed terminal, to which the fixed portion having the extension portion connected thereto is fixed, and the movable contactor, at one end side of the partition member in the longitudinal direction of the fixed terminal to which the fixed portion having the extension portion connected thereto is fixed, and the opposed portion extends in the longitudinal direction of the fixed terminal to which the fixed portion having the extension portion connected thereto is fixed.

2. The contact device according to claim 1, wherein:

a fixed contact included in the fixed terminal to which the fixed portion having the extension portion connected thereto is fixed is located between one end and the other end in the longitudinal direction of the fixed terminal to which the fixed portion having the extension portion connected thereto is fixed in the opposed portion.

3. The contact device according to claim 1, wherein:

the opposed portion extends in parallel with the longitudinal direction of the fixed terminal to which the fixed portion having the extension portion connected thereto is fixed.

4. The contact device according to claim 1, wherein:

the first fixed terminal and the second fixed terminal are aligned in the partition member such that the first fixed contact and the second fixed contact are opposed to the movable contactor;

the first fixed portion fixed to the first fixed terminal extends in a direction away from the second fixed terminal in a direction in which the first fixed terminal and the second fixed terminal are aligned; and the second fixed portion fixed to the second fixed terminal extends in a direction away from the first fixed terminal in the direction in which the first fixed terminal and the second fixed terminal are aligned.

5. The contact device according to claim 1, wherein:

the first fixed terminal and the second fixed terminal are aligned in the partition member such that the first fixed contact and the second fixed contact are opposed to the movable contactor;

the first fixed portion fixed to the first fixed terminal extends in a direction perpendicular to a direction in which the first fixed terminal and the second fixed terminal are aligned;

the second fixed portion fixed to the second fixed terminal extends in a direction perpendicular to the direction in which the first fixed terminal and the second fixed terminal are aligned; and the extending directions of the first fixed portion and the second fixed portion are identical to each other.

6. The contact device according to claim 1, wherein:

the first fixed terminal and the second fixed terminal are aligned in the partition member such that the first fixed contact and the second fixed contact are opposed to the movable contactor;

the first fixed portion fixed to the first fixed terminal extends in a direction perpendicular to a direction in which the first fixed terminal and the second fixed terminal are aligned;

the second fixed portion fixed to the second fixed terminal extends in a direction perpendicular to the direction in which the first fixed terminal and the second fixed terminal are aligned; and the extending directions of the first fixed portion and the second fixed portion are opposite to each other.

7. The contact device according to claim 1, wherein:

the first fixed terminal and the second fixed terminal are aligned in the partition member such that the first fixed contact and the second fixed contact are opposed to the movable contactor;

one of the first fixed portion fixed to the first fixed terminal and the second fixed portion fixed to the second fixed terminal extends in a direction away from the fixed terminal to which another fixed portion is fixed in a direction in which the first fixed terminal and the second fixed terminal are aligned; and the other fixed portion extends in a direction perpendicular to the direction in which the first fixed terminal and the second fixed terminal are aligned.

8. The contact device according to claim 1, further comprising:

a housing having the partition member and in which the movable contactor, the first fixed contact, and the second fixed contact are accommodated, wherein the extension portion is electrically connected to the fixed terminal to which the fixed portion is fixed through the extension portion and the fixed portion having the extension portion connected thereto, and an electric path portion extending along a main current direction of a current flowing through the movable contactor is connected to the extension portion, and the movable contactor moves between a closed position to come into contact with the first fixed contact and the second fixed contact and an open position to separate from at least one of the first and second fixed contacts.

9. The contact device according to claim 8, further comprising:

a first conductive member fixed to the first fixed terminal and a second conductive member fixed to the second fixed terminal, wherein the electric path portion includes a first electric path portion connected to the first conductive member, and a second electric path portion connected to the second conductive member, and the movable contactor is disposed between the first electric path portion and the second electric path portion as viewed from one side of the moving direction of the movable contactor.

10. An electrical device comprising:

an inner unit consisting of the contact device according to claim 1; and a housing holding the inner unit.

11. The electrical device according to claim 10, wherein:

at least one of the first and second conductive members is held by the housing.

12. The contact device according to claim 8, wherein:

two electric path portions are connected to at least one of the first and second fixed portions, and the movable contactor is disposed between the two electric path portions as viewed from one side of the moving direction of the movable contactor.

13. The contact device according to claim 8, wherein:

the electric path portion includes a backward electric path portion disposed outside the housing and through which a current flows in a direction opposite to the main current direction of the current flowing through the movable contactor, when the movable contactor is located in the closed position, and the movable contactor in the closed position is located between the first and second fixed contacts and the backward electric path portion in the moving direction of the movable contactor.

14. The contact device according to claim 8, wherein:

the electric path portion includes a forward electric path portion disposed outside the housing and through which a current flows in the same direction as the main current direction of the current flowing through the movable contactor, when the movable contactor is located in the closed position, and the forward electric path portion is positioned on the same side as the first and second fixed contacts with respect to the movable contactor in the moving direction of the movable contactor.

15. The contact device according to claim 8, wherein:

the electric path portion includes a backward electric path portion disposed outside the housing and through which a current flows in a direction opposite to the main current direction of the current flowing through the movable contactor, when the movable contactor is located in the closed position, and a forward electric path portion disposed outside the housing and through which a current flows in the same direction as the main current direction of the current flowing through the movable contactor, when the movable contactor is located in the closed position, wherein the movable contactor in the closed position is located between the first and second fixed contacts and the backward electric path portion in the moving direction of the movable contactor, and the forward electric path portion is positioned on the same side as the first and second fixed contacts with respect to the movable contactor in the moving direction of the movable contactor, and the forward electric path portion and the backward electric path portions are connected to each other.

16. The contact device according to claim 15, wherein:

the backward electric path portion and the forward electric path portion are located on the same side with respect to the movable contactor, as viewed from one side of the moving direction of the movable contactor.

17. The contact device according to claim 15, wherein:

the movable contactor is positioned between the backward electric path portion and the forward electric path portion as viewed from one side of the moving direction of the movable contactor.

18. The contact device according to claim 8, wherein:

a length of the extension portion in its extending direction is equal to or longer than a length from a connection portion with the fixed portion in the fixed terminal to which the fixed portion having the extension portion connected thereto is fixed to a retention portion of the fixed contact.

19. The contact device according to claim 8, wherein:

the movable contactor includes a first movable contact and a second movable contact that come into contact with the first fixed contact and the second fixed contact, respectively, when located in the closed position, and the length of the electric path portion is equal to or greater than a distance between the first and second movable contacts, as viewed from one side of the moving direction of the movable contactor.

20. The contact device according to claim 8, wherein:

the housing includes a non-magnetic portion formed of a non-magnetic material from one end to the other end in the thickness direction of the housing, and the non-magnetic portion is formed in at least a part of a portion overlapping with the electric path portion and a region opposed to the movable contactor located in the closed position.

21. The contact device according to claim 8, wherein:

the housing includes a non-magnetic portion formed of a non-magnetic material from one end to the other end in the thickness direction of the housing, and the non-magnetic portion is formed in at least a part of a portion overlapping with the extension portion and a region opposed to the movable contactor located in the closed position.

22. The contact device according to claim 1, wherein:

the extension portion overlaps with the fixed terminal to which the fixed portion having the extension portion connected thereto is fixed, as viewed from one side of the main current direction of the current flowing through the movable contactor.

23. The contact device according to claim 1, wherein:

the extension portion overlaps with the fixed terminal to which the fixed portion having the extension portion connected thereto is fixed, as viewed from one side of a direction perpendicular to both of the main current direction of the current flowing through the movable contactor and the direction of the current flowing through the fixed terminal.

24. The contact device according to claim 1, wherein:

the extension portion overlaps with the fixed terminal to which the fixed portion having the extension portion connected thereto is fixed, as viewed from one side of a direction perpendicular to the direction of the current flowing through the fixed terminal and that intersects with the main current direction of the current flowing through the movable contactor at an angle different from a right angle.

25. The contact device according to claim 1, wherein:

at least one of the first and second fixed portions is mechanically connected to the fixed terminal to which the fixed portion is fixed.

26. An electromagnetic relay comprising:

the contact device according to claim 1; and an electromagnetic device that moves the movable contactor.

27. An electrical device comprising:

an inner unit consisting of the electromagnetic relay according to claim 26; and a housing holding the inner unit.

28. The electrical device according to claim 27, wherein:

at least one of the first and second conductive members is held by the housing.

* * * * *